US006821042B2

(12) United States Patent
Baker et al.

(10) Patent No.: US 6,821,042 B2
(45) Date of Patent: Nov. 23, 2004

(54) COMPOSITIONS FOR TREATING SHOES AND METHODS AND ARTICLES EMPLOYING SAME

(75) Inventors: Keith Homer Baker, Cincinnati, OH (US); Michael Peter Siklosi, Cincinnati, OH (US); Henry Cheng Na, Cincinnati, OH (US); Janine Morgens Strang, Cincinnati, OH (US); Donna Jean Haeggberg, Cincinnati, OH (US); William Michael Scheper, Lawrenceburg, IN (US); Connie Lynn Sheets, Cincinnati, OH (US); Fernando Ray Tolléns, Indian Hill, OH (US); Michael Glen Murray, South Lebanon, OH (US); Michael Timothy Creedon, Cincinnati, OH (US); Errol Hoffman Wahl, Cincinnati, OH (US); Toan Trinh, Maineville, OH (US); Eugene Steven Sadlowski, Cincinnati, OH (US); Vincent John Becks, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/672,854

(22) Filed: Sep. 26, 2003

(65) Prior Publication Data

US 2004/0102350 A1 May 27, 2004

Related U.S. Application Data

(62) Division of application No. 10/007,449, filed on Nov. 5, 2001, which is a division of application No. 09/693,224, filed on Oct. 20, 2000, now abandoned.

(60) Provisional application No. 60/161,240, filed on Oct. 22, 1999, provisional application No. 60/161,187, filed on Oct. 22, 1999, provisional application No. 60/161,151, filed on Oct. 22, 1999, provisional application No. 60/161,118, filed on Oct. 22, 1999, provisional application No. 60/198,019, filed on Apr. 18, 2000, provisional application No. 60/198,507, filed on Apr. 18, 2000, and provisional application No. 60/202,291, filed on May 5, 2000.

(51) Int. Cl.[7] ..... A43D 8/36

(52) U.S. Cl. ..... 401/38; 401/40; 401/42; 401/47; 401/118; 401/119

(58) Field of Search ..... 401/38, 40, 42, 401/47, 118, 119

(56) References Cited

U.S. PATENT DOCUMENTS 2,403,575 A * 7/1946 Brack ..... 401/38

* cited by examiner

*Primary Examiner*—Brian P. Mruk
*Assistant Examiner*—Eisa Elhilo
(74) *Attorney, Agent, or Firm*—Jeffrey V. Bamber; Kim William Zerby; Steven W. Miller

(57) ABSTRACT

The present invention relates to compositions for treating shoes, especially leather-containing shoes, such as athletic shoes, and methods and articles of manufacture employing same to treat the shoes prior to and/or during and/or after washing the shoes. More particularly, the present invention relates to compositions applied to one or more shoes in need of treatment prior to and/or during and/or after washing the shoes for imparting a desired benefit to the shoes such as cleaning and/or conditioning and/or disinfecting and/or deodorizing.

14 Claims, 33 Drawing Sheets

COMPOSITIONS FOR TREATING SHOES AND METHODS AND ARTICLES EMPLOYING SAME

CROSS REFERENCES TO RELATED PATENT APPLICATIONS

This application is a divisional of application Ser. No. 10/007,449 filed Nov. 5, 2001, which is a divisional of U.S. application Ser. No. 09/693,224 filed Oct. 20, 2000 now abandoned which claims priority under 35 U.S.C. §119 of U.S. provisional patent applications Ser. No. 60/161,240 filed Oct. 22, 1999; No. 60/161,187 filed Oct. 22, 1999; No. 60/161,151 filed Oct. 22, 1999; No. 60/161,118 filed Oct. 22, 1999; No. 60/198,019 filed Apr. 18, 2000; No. 60/198,507 filed Apr. 18, 2000; and No. 60/202,291 filed May 5, 2000, the substances of which are hereby fully incorporated herein by reference, as is the disclosure of the application entitled "Shoe Bags for Use in Laundering Processes" filed on Oct. 20, 2000, Ser. No. 09/693,314.

FIELD OF THE INVENTION

The present invention relates to compositions for treating shoes, especially leather-containing shoes, such as athletic shoes and methods and articles of manufacture employing same to treat the shoes prior to and/or during and/or after washing the shoes. More particularly, the present invention relates to compositions applied to one or more shoes prior to and/or during and/or after washing the shoes for imparting a desired benefit to the shoes such as cleaning and/or conditioning and/or disinfecting and/or deodorizing.

BACKGROUND OF THE INVENTION

Soiled and/or stained shoes, especially athletic shoes, have been a problem since the advent of shoes. Traditional attempts at cleaning soiled and/or stained shoes have included washing the soiled shoes manually in wash basins and/or sinks, with a conventional garden hose, clapping the shoes together to attempt to dislodge clay, mud and other dirt fixed to the shoes, or using a conventional washing machine with or without detergent being added. However, consumers have encountered less than satisfactory cleaning by these conventional methods. Further, consumers have witnessed the damage to the shoes as a result of employing these "harsh" conventional methods, especially when washing the shoes in a conventional washing machine. Examples of such problems include, but are not limited to, poor, less than satisfactory cleaning of the shoes and/or the ability of water and/or detergent to remove tanning agents and/or fatliquors from leather in the shoes resulting in loss of stability and/or softness and/or suppleness and/or flexibility.

Cleaning represents a significant and largely unmet consumer need for shoes. especially shoes that contain canvas, nylon, mesh, synthetic leather and/or natural leather surfaces, particularly leather-containing shoes, such as athletic shoes. Athletic shoes are worn not just for athletic use but also for casual use both indoor and outdoor. The outdoor and athletic use of these shoes can lead to significant soiling of these shoes. For instance, dirt, mud, and clay soils may soil these when worn outdoors for either sporting or casual use. Similarly, grass stains and soils may soil these shoes under similar circumstances. A particular problem for cleaning shoes is that unlike many "dress" or formal shoes, the outer parts of the athletic shoes may consist of leather or fabrics or combinations of the two. Most formal shoes have a glossy smooth outside surface and are generally not as heavily soiled as athletic shoes often are. Thus for the formal shoes, wiping with a damp cloth is often sufficient to clean these shoes under most circumstances. Unlike most formal shoes with glossy smooth outside finishes, the athletic shoes are more heavily soiled and that soil is often more difficult to remove because of the many types of outer coverings for the athletic shoes. In particular, it is difficult to simply wipe the off the soil from the fabric parts in these shoes. Similarly the soil from the rough or uneven plastic, synthetic or rubber surfaces found on the bottom portions of these shoes is also often difficult to remove. As such, a better method for cleaning athletic shoes is needed and is highly desirable.

Further, while not wishing to be bound by theory, it is believe that the conventional washing of shoes in water and/or detergent-containing water has deleterious effects on the shoes, especially leather-containing shoes because among other reasons, the loss of fatliquors and/or oils and/or tanning agents such as chromium from the leather.

Conventional washing of shoes in an automatic clothes washing machine damages the shoes as a result of the shoes coming into contact with the agitator in the washing machine and/or walls of the washing machine and/or with other articles, such as other shoes, being washed. Without being bound by theory, it is believed that such contact can damage the paint on the shoes as well as damage other surfaces and/or components of the shoes.

Accordingly, there is a need for compositions for treating shoes and methods employing same to treat shoes prior to and/or during and/or after washing the shoes; compositions used prior to and/or during and/or after washing the shoes for imparting one or more benefits to the shoes such as cleaning and/or conditioning and/or disinfecting and/or deodorizing; compositions for treating shoes that provide effective cleaning without significant damage, if any, to the shoes; methods for cleaning shoes that provide satisfactory cleaning of the shoes in the eyes of the consumer; methods for conditioning shoes such that the damage to the shoes as a result of the cleaning is mitigated if not prevented; methods for disinfecting the shoes to provide an overall "clean" shoe; compositions for cleaning and/or conditioning and/or disinfecting the shoes particularly useful in the methods of the present invention; and articles of manufacture that use such treating composition.

SUMMARY OF THE INVENTION

The methods, compositions and articles of manufacture of the present invention fulfill the needs described above. The present invention relates to methods for treating shoes, especially shoes that contain canvas, nylon, mesh, synthetic leather and/or natural leather surfaces, particularly leather-containing shoes such as athletic shoes, compositions useful in the methods of the present invention and articles of manufacture that use the compositions to treat shoes.

In accordance with one aspect of the present invention, a treating composition for treating one or more shoes in need of treatment comprising an effective amount of one or more benefit agents, preferably selected from the group consisting of cleaning agents, conditioning agents, disinfecting agents, odor control agents and mixtures thereof, more preferably selected from the group consisting of conditioning agents and optionally, but preferably one or more additional benefit agents, wherein when the treating composition is applied to the one or more shoes prior to and/or during and/or after washing the one or more shoes one or more desired benefits is imparted to the one or more shoes, is provided.

In accordance with another aspect of the present invention, a treating system for treating one or more shoes in need of treatment comprising:

a) a cleaning composition comprising one or more cleaning agents capable of being applied in a manner such that the one or more cleaning agents contacts one or more exterior surfaces of the one or more shoes; and b) a conditioning composition physically and/or chemically separated from the cleaning composition of a) wherein the conditioning composition comprises one or more conditioning agents capable of being applied in a manner such that the one or more conditioning agents contacts one or more interior surfaces of the one or more shoes;

such that the cleaning composition and/or conditioning composition imparts cleaning and/or conditioning benefits to the one or more shoes when the cleaning composition and/or conditioning composition are applied to the one or more shoes prior to and/or during and/or after washing the one or more shoes, is provided.

In accordance with yet another aspect of the present invention, a treating composition for treating one or more shoes in need of treatment comprising:

a) one or more cleaning agents; and b) one or more conditioning agents wherein cleaning benefits and/or conditioning benefits are imparted to the one or more shoes when the treating composition is applied to the one or more shoes prior to and/or during and/or after washing the one or more shoes, is provided.

In accordance with yet another aspect of the present invention, a method for treating one or more shoes in need of treatment comprising contacting the one or more shoes with one or more treating compositions of the present invention, and optionally, but preferably washing the one or more shoes, such that the one or more shoes are treated, is provided.

In accordance with yet another aspect of the present invention, a method for treating one or more shoes in need of treatment comprising the steps, preferably sequential steps of:

a) applying a treating composition in accordance with the present invention to a shoe;

b) placing the shoe in a bag;

c) placing the bag in a washing machine; and d) operating the washing machine as prescribed by the manufacturer is provided.

In accordance with still yet another aspect of the present invention, an article of manufacture comprising a treating composition for treating one or more shoes comprising one or more benefit agents in a package in association with instructions for use which direct a consumer to apply at least an effective amount of the one or more benefit agents to provide one or more desired benefits to the one or more shoes.

In accordance with still yet another aspect of the present invention, a product comprising a benefit agent-containing treating composition, the product further including instructions for using the treating composition to treat a shoe in need of treatment, the instructions including the step of: contacting said shoe with an effective amount of said treating composition for an effective amount of time such that said composition treats said shoe, is provided.

In accordance with still yet another aspect of the present invention, a shoe treatment composition in kit form in accordance with the present invention, comprises the following components:

a) an article of manufacture comprising a treating composition for treating one or more shoes comprising one or more benefit agents in a package in association with instructions for use which direct a consumer to apply at least an effective amount of the one or more benefit agents to provide one or more desired benefits to the one or more shoes;

b) a flexible container, preferably reusable flexible container, suitable for holding one or more of the shoes; and c) an outer package containing the components a) and b); is provided.

All percentages and proportions herein are by weight, and all references cited herein are hereby incorporated by reference, unless otherwise specifically indicated.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

Definitions

Figure 1:
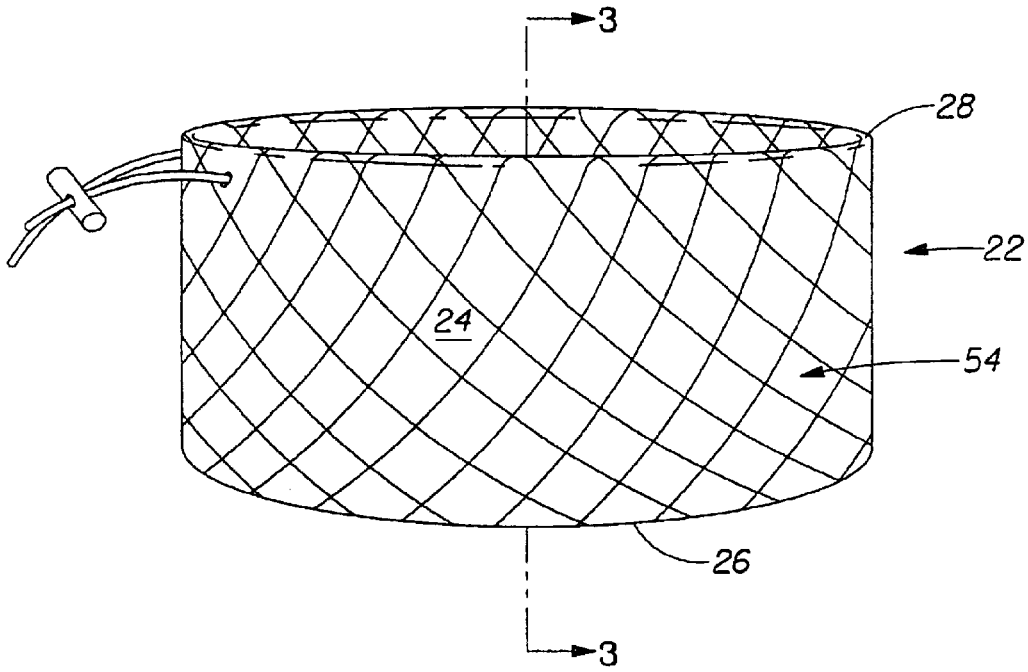
FIG. 1 is a perspective view of a shoe bag made in accordance with the present invention.

The treating compositions of the present invention comprise an "effective amount" of a benefit agent. An "effective amount" of a benefit agent is any amount capable of imparting the benefit associated with the benefit agent to an article, such as a shoe or any portion thereof, preferably any canvas, nylon, mesh, synthetic leather and/or natural leather surface thereof, more preferably any natural leather surface thereof.

"Treating composition(s)" herein is meant to encompass generally benefit agent-containing compositions, such as cleaning compositions, conditioning compositions, disinfecting compositions, and the like.

"Pre-Treat" herein is meant to encompass any application of one or more treating compositions of the present invention to one or more shoes prior to washing the one or more shoes.

"Through the Wash" herein is meant to encompass any application of one or more treating composition of the present invention to one or more shoes during washing of the one or more shoes.

"Post-Treat" herein is meant to encompass any application of one or more treating compositions of the present invention to one or more shoes after washing the one or more shoes.

"Benefit agents" herein is meant to encompass any agent that can impart a consumer recognizable and/or measurable benefit to an article, such as a shoe. Examples of such benefit agents includes, but is not limited to, cleaning agents, conditioning agents, disinfecting agents, perfumes, brighteners, release agents, especially soil release agents, enzymes, water-proofing agents, odor control agents, and the like, and mixtures thereof.

"Shoe(s)" herein is meant to encompass any and all surfaces and portions of a shoe, preferably any canvas, nylon, mesh, synthetic leather and/or natural leather surface thereof, more preferably any natural leather surface thereof.

"Washing" herein is meant any means of contacting a shoe with an aqueous medium. Examples of such washing include, but are not limited to, submerging, partially or completely, the shoe in a washtub or other receptacle, such as a sink or a pan, spraying the shoe with water from a garden hose or other means of delivering water such as a faucet, allowing rain drops to contact the shoe, submerging, partially or completely, the shoe in a body of water, such as a river, lake or pond, submerging the shoe in an aqueous wash solution contained within a conventional washing machine, preferably during the wash cycle and optionally during the rinse cycle.

Benefit Agent-Containing Treating Compositions

The treating compositions of the present invention comprise an effective amount of one or more benefit agents. Preferably, the one or more benefits agents comprises one or more conditioning agents and optionally, but preferably, one or more other benefit agents, preferably selected from the group consisting of one or more cleaning agents and/or disinfecting agents and/or odor control agents.

The treating compositions of the present invention are particularly useful in the methods of the present invention. The treating compositions of the present invention when applied to one or more shoes in need of treatment impart one or more desired benefits to the one or more shoes. Preferably, one or more of the desired benefits imparted to the one or more shoes endures washing of the one or more shoes.

The treating compositions may be used as pre-treat compositions and/or as through the wash compositions and/or as post-treat compositions.

If used as pre-treat compositions, the treating compositions are preferably formulated such that one or more benefit agents imparts one or more desired benefits to one or more shoes in need of treatment prior to and/or during washing the one or more shoes that endures the washing of the one or more shoes. It is desirable that after one or more pre-treat compositions have been applied to one or more shoes in need of treatment, the shoes are then washed.

If used as through the wash compositions, the treating compositions are preferably formulated such that one or more benefit agents imparts one or more desired benefits to one or more shoes in need of treatment during washing of the one or more shoes that endures the washing of the one or more shoes.

If used as post-treat compositions, the treating compositions are preferably formulated such that one or more benefit agents imparts one or more desired benefits to one or more shoes in need of treatment after washing the one or more shoes. It is desirable that after one or more post-treat compositions have been applied to one or more washed shoes the wearer wears the post-treated shoes for some period of time thereafter and/or until the shoes become soiled before washing the shoes. As indicated above, one or more pre-treat compositions may be applied to the shoes prior to washing the shoes.

The pre-treat and/or post-treat compositions can be formulated to be applied to "new" shoes (i.e., new and/or little worn or little soiled shoes) for preventative and/or comfort reasons. For example, a consumer may desire to treat such "new" shoes with a treating composition comprising conditioning agents and/or soil release agents and/or odor control agents prior to wearing.

It is desirable that the benefit agent(s) is present in the treating compositions of the present invention in an amount in the range of from about 0.01% to about 90% by weight of the treating composition, more preferably from about 0.1% to about 80%, even more preferably from about 0.5% to about 70% by weight of the treating composition. Although, for some embodiments of the treating compositions of the present invention, the benefit agent may be present in the treating compositions from about 90% to about 100% by weight of the treating composition. Furthermore, it is desirable that the benefit agent is present in the wash, rinse, soaking, and/or spray-treatment solution in an amount of from about 2 ppm to about 100,000 ppm, more preferably from about 10 ppm to about 25,000 ppm.

The treating compositions of the present invention can optionally include conventional benefit agents and/or detergent adjuncts, such as bleaches, bleach activators, bleach catalysts, enzymes, enzyme stabilizing systems, soil release/removal agents, suds suppressors, hydrotropes, opacifiers, antioxidants, dyes, perfumes, carriers and brighteners. Examples of such adjuncts are generally described in U.S. Pat. No. 5,576,282.

Preferably, the treating compositions are essentially free of polyphosphates, in other words, preferably the treating compositions comprise less than 5%, more preferably less than 4%, even more preferably less than 3%, still even more preferably less than 2%, yet still even more preferably less than 1%, and most preferably about 0% by weight polyphosphates.

Preferably, the treating compositions are essentially free of bleaching systems, especially types of bleaching agents and/or levels of bleaching agents, especially chlorine bleach, that would do more damage to the shoes than provide benefit to the shoes.

Preferably, the treating compositions of the present invention are essentially free of material that would soil or stain the shoes.

Preferably, the treating compositions are formulated such that the treating compositions comprise no more than 30%, more preferably no more than 20%, even more preferably no more than 10% by weight of the treating composition of chromium-binding agents that are capable of binding $Cr^{3+}$ with a log K binding constant of more than 12, more preferably more than 9, even more preferably more than 6.

Preferably, the treating compositions are formulated such that the benefit agents, especially the conditioning agents, are selected such that the damage to the natural leather-containing surfaces of the one or more shoes as a result of washing the one or more shoes in an aqueous medium containing the treating composition compared to washing the one or more shoes in an aqueous medium free of the treating composition is reduced.

Preferably, the treating compositions are formulated such that the benefit agents, especially the conditioning agents, are selected such that the ratio of the water absorption into an interior surface of the one or more shoes treated by the treating composition to the water absorption into the interior surface prior to treatment with the treating composition is greater than 0.1, preferably greater than 0.3.

Preferably, the treating compositions are formulated such that the benefit agents, especially the conditioning agents, are selected such that the ratio of the friction between a surface of the one or more shoes treated by the treating composition and a second surface to the friction between the surface prior to treatment with the treating composition and the second surface is greater than 0.7, preferably greater than 0.8, more preferably greater than 0.9.

Forms of Compositions

The treating compositions of the present invention can be in solid (powder, granules, bars, tablets), dimple tablets, liquid, paste, gel, spray, aerosol, stick or foam forms and mixtures thereof.

The granular treating compositions according to the present invention can be in "compact form", i.e. they may have a relatively higher density than conventional granular detergents, i.e. from 550 to 950 g/l; in such case, the granular treating compositions according to the present invention will contain a lower amount of "inorganic filler salt", compared to conventional granular detergents; typical filler salts are alkaline earth metal salts of sulfates and chlorides, typically sodium sulfate; "compact" detergents typically comprise not more than 10% filler salt.

The liquid and/or gel treating compositions according to the present invention can be in "concentrated form", in such case, the liquid treating compositions according to the present invention will contain a lower amount of water, compared to conventional liquid detergents. The water content of the concentrated liquid treating compositions may be less than or equal to about 50% by weight of the treating compositions.

The present invention also relates to benefit agent-containing treating compositions incorporated into a spray dispenser to create an article of manufacture that can facilitate treatment of shoes with said treating compositions containing the benefit agent and other optional ingredients at a level that is effective, yet is not discernible when dried on the shoes. The spray dispenser comprises manually activated and non-manual powered (operated) spray means and a container containing the treating composition. The articles of manufacture preferably are in association with instructions for use to ensure that the consumer applies sufficient amounts of the benefit agent(s) to provide the desired benefit(s).

Typical compositions to be dispensed from a sprayer contain a level of benefit agent of from about 0.01% to about 5%, preferably from about 0.05% to about 2%, more preferably from about 0.1% to about 1%, by weight of the usage composition.

For through the wash (wash-added and/or rinse-added) methods, the article of manufacture can simply comprise a benefit agent-containing treating composition and a suitable container.

Wash-added compositions, including liquid and granular treating compositions and wash additive compositions typically contain a level of benefit agent of from about 0.01% to about 90%, preferably from about 0.1% to about 80%, more preferably from about 0.5% to about 70% by weight of the wash added compositions.

Rinse-added compositions, including conditioning agents and other rinse additive compositions, contain a level of benefit agent of from about 0.01% to about 90%, preferably from about 0.1% to about 80%, more preferably from about 0.5% to about 70% by weight of the rinse added compositions.

Preferably the articles of manufacture are in association with instructions for how to use the composition to treat shoes correctly, to obtain the desirable shoe care results. for example, soil removal, softness, suppleness, deodorization, disinfecting properties. It is important that the instructions be as simple and clear as possible. Accordingly, the use of pictures and/or icons to assist in explaining the instructions is desirable.

A liquid or solid, preferably a liquid and/or gel, treating composition in accordance with the present invention to be used in the wash cycle comprises an effective amount of one or more benefit agents, and optionally, perfume, chlorine scavenging agents, dye transfer inhibiting agents, dye fixative agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. The composition is preferably packaged in association with instructions for use to ensure that the consumer knows what benefits can be achieved and how to achieve the best results.

A preferred treating composition for treating one or more shoes comprises an effective amount of one or more benefit agents, and optionally, perfumes, odor control agents, antimicrobial actives and/or preservatives, enzymes, and mixtures thereof. Other optional ingredients can also be added, e.g., soil release agents, antioxidants, chelating agents, e.g., aminocarboxylate chelating agents, heavy metal chelating agents, colorants, suds suppressors, and the like, and mixtures thereof.

The treating compositions herein can be made by any suitable process known in the art. Examples of such processes are described in U.S. Pat. No. 5,576,282.

The treating compositions herein will preferably be formulated such that, during use in aqueous treating operations, the wash solution will have a pH in the range of from about 3 to about 11, more preferably from about 4 to about 10 and most preferably from about 6 to about 9.

Treating compositions containing conditioning agents in the absence of cleaning agents will be formulated such that, during use in aqueous treating operations, the wash solution will preferably have a pH in the range of from about 3 to about 10, more preferably from about 3 to about 9, most preferably from about 5 to about 7.

Treating compositions containing cleaning agents in the absence of conditioning agents will preferably be formulated such that, during use in aqueous treating operations, the wash solution will preferably have a pH in the range of from about 6 to about 11, more preferably from about 7 to about 10, most preferably from about 7.5 to about 9.5.

Techniques for controlling pH at recommended usage levels include the use of buffers, alkalis, acids, etc., and are well known to those skilled in the art.

Another appropriate form in which the treating compositions of the present invention may be incorporated are tablets including dimple tablets. Such benefit agent-containing treating composition tablets comprise an effective amount of one or more benefit agents, and optionally, surfactants, calcium/magnesium removal agents, perfumes, dispersants, enzymes, heavy metal chelating agents, suds suppressors, chemical stabilizers including antioxidants, silicones, antimicrobial actives and/or preservatives, soil suspending agents, soil release agents, optical brighteners, colorants, and mixtures thereof. Again, the composition is preferably packaged in association with instructions for use to ensure that the consumer knows what benefits can be achieved. The tablets can be used in pre-wash and/or pre-treatment procedures as well as through the wash and/or rinse cycles.

Alternatively, the treating compositions of the present invention can be incorporated into a spray dispenser, or concentrated stick form that can create an article of manufacture that can facilitate the cleaning and/or shoe care or conditioning of the shoes. If the spray treatment is a "pre-treat", which is followed by a wash cycle, then the spray treatment treating compositions preferably comprise from about 0.01% to about 50% of benefit agent by weight the of total treating composition, more preferably from about 0.1% to about 30% of benefit agent by weight of the total treating composition. If the spray treatment compositions are desired to do the cleaning, as in the case of wash, then the spray treatment compositions preferably comprise from about 2 ppm to about 10000 ppm of the benefit agent by weight of the total treating composition, more preferably from about 200 ppm to about 5000 ppm of the benefit agent by weight of the total treating composition. In the latter case, a brief rinse, not a full wash cycle, is desirable after treatment. Such spray treatment compositions are typically packaged in a spray dispenser.

The spray-treatment compositions herein are typically packaged in spray dispensers. The spray dispensers can be any of the manually activated means for producing a spray of liquid droplets as is known in the art, e.g. trigger-type, pump-type, non-aerosol self-pressurized, and aerosol-type spray means. It is preferred that at least about 70%, more preferably, at least about 80%, most preferably at least about 90% of the droplets have a particle size of smaller than about 200 microns.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the treating compositions of the present invention contained in the dispenser to be dispensed in the form of a spray of very fine, or finely divided, particles or droplets. A more complete description of commercially available suitable aerosol spray dispensers appears in U.S. Pat. No. 3,436,772, Stebbins, issued Apr. 8, 1969; and U.S. Pat. No. 3,600,325, Kaufman et al., issued Aug. 17, 1971.

Preferably the spray dispenser is a self-pressurized non-aerosol container having a convoluted liner and an elastomeric sleeve. A more complete description of suitable self-pressurized spray dispensers can be found in U.S. Pat. No. 5,111,971, Winer, issued May 12, 1992; and U.S. Pat. No. 5,232,126, Winer, issued Aug. 3, 1993. Another type of suitable aerosol spray dispenser is one wherein a barrier separates the wrinkle reducing composition from the propellant (preferably compressed air or nitrogen), as is disclosed in U.S. Pat. No. 4,260,110, issued Apr. 7, 1981, incorporated herein by reference. Such a dispenser is available from EP Spray Systems, East Hanover, N.J.

More preferably, the spray dispenser is a non-aerosol, manually activated, pump-spray dispenser. A more complete disclosure of commercially available suitable dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981.

Most preferably, the spray dispenser is a manually activated trigger-spray dispenser. A more complete disclosure of commercially available suitable dispensing devices appears in U.S. Pat. No. 4,082,223, Nozawa, issued Apr. 4, 1978; U.S. Pat. No. 4,161,288, McKinney, issued Jul. 7, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind.—a distributor of Guala® sprayers; or Seaquest Dispensing, Cary, Ill.

The preferred trigger sprayers are the blue inserted Guala® sprayer, available from Berry Plastics Corp., the Calmar TS800-1A® sprayers, available from Calmar Inc., or the CSI T7500® available from Continental Sprayers Inc., because of the fine uniform spray characteristics, spray volume and pattern size. Any suitable bottle or container can be used with the trigger sprayer, the preferred bottle is a 17 fl-oz. bottle (about 500 ml) of good ergonomics similar in shape to the CINCH® glass cleaner bottle. It can be made of any materials such as high density polyethylene, polypropylene, polyvinyl chloride, polystyrene, polyethylene terephthalate, glass or any other material that forms bottles. Preferably, it is made of high density polyethylene or polyethylene terephthalate.

For smaller four fl-oz size (about 118 ml), a finger pump can be used with canister or cylindrical bottle. The preferred pump for this application is the cylindrical Euromist II® from Seaquest Dispensing.

Benefit Agents

The treating compositions of the present invention comprise an effective amount of one or more benefit agents.

Preferred Cleaning System Benefit Agents

A cleaning system useful in the treating compositions of the present invention is comprised of one or more of the following cleaning agents: dispersants and/or surfactants and/or calcium/magnesium removal agents, pH modifiers, especially alkaline pH modifiers, preferably a combination of two or more of these agents. In addition to the dispersants and/or surfactants and/or calcium/magnesium removal agents, the cleaning system may optionally comprise, and preferably does comprise one or more of the following ingredients, soil release agents, enzymes, especially proteases, suds suppressors and mixtures thereof.

The cleaning system preferably has a pH, as determined in a 10% aqueous solution of the neat cleaning system, in the range of from about 5 to about 11, more preferably from about 6 to about 10, most preferably from about 7 to about 10. If it is desired to control foot odor in the shoes, it is preferable to use alkaline pH modifiers such as water soluble buffers, alkali phosphates, carbonates, silicates, and the like to maintain the wash solution pH in the range of from about 7.5 to about 11, preferably from about 8 to about 10.

a. Calcium/Magnesium (Ca/Mg) Removal Agents—One key function well known to those of ordinary skill in the art is the use of Ca/Mg removal agents (many of which are often referred to as "builders") in aqueous cleaning systems is to bind or sequester, or otherwise remove the Ca and Mg divalent ions normally present in both soils and water. Removal of these two divalent ions by the Ca/Mg removal agents can in many instances greatly enhance the performance of cleaning and/or detergent systems. This is especially true for the removal of particulate soils such as the clay, dirt, mud, and also grass soils often encountered with shoes, especially athletic shoes.

Thus, the presence of Ca/Mg removal agents is especially useful in the cleaning system of the present invention for the removal of particulate soils such as the clay, dirt, mud, and grass soils often encountered with shoes. This is distinct from the aqueous washing of other leather garments such as leather coats for instance as they are typically not heavily soiled with dirt and mud soils and thus are less likely to benefit from the presence of Ca/Mg removal agents. Thus, the washing of leather garments other than shoes would not normally require Ca/Mg removal agents as the soils are typically not clay/dirt/mud and thus they less dependent on and often do not need Ca/Mg binding agents to achieve effective cleaning.

Some of the same Ca/Mg removal agents useful in removing the Ca/Mg divalent ions may also very effectively bind or remove transition metal ions. The specific agents binding transition metal ions are often referred to in the literature as chelants and the process of their binding transition metal ions as chelation. The chemistry of metal chelation and the use of binding constants to define the ability of chelants to bind metal ions is well known in the literature. A suitable reference is "*Ionic equilibrium: solibility and pH calculations*" by James N. Butler with a chapter by David R. Cogley, 1998, John Wiley and Sons. Values for the bindings constants of various chelants may be found in the series "*Critical Stability Constants*", edited by Robert M. Smith and Arthur E. Martell, Plenum Press, New York, London 1974, 1975, 1977, 1976, 1982 and 1989 "A closely related reference is available in a computer program from the National Institute of Standards and Technology. The program is referred to as "*NIST Critically Selected Stability Constants of Metal Complexes: Version* 5.0" and is available from:

Standard Reference Data Program

National Institute of Standards and Technology

100 Bureau Dr., Stop 2310

Gaithersburg, Md. 20899-2310

The presence of chelants is normally not a significant problem for conventional detergents as the removal of low levels of transition metal ions usually does not hurt and indeed may actually improve the observed cleaning performance.

However, for leather-containing shoes the use of transition metal ion chelating agent-containing treating compositions poses an unexpected and previously unrecognized problem for the formulation of cleaning systems for the aqueous washing of shoes. The leather portion of the shoes may be adversely affected by the transition metal ion chelating agents by removing the transition metal Chromium from the leather in the shoes. The potential loss of Chromium from leather is detailed in the literature including;

1. D. A. Brown, W. K. Glass, M. R. Jan, R. M. W. Mulders, Environmental Technology Letters, v. 7, pp. 289–298 (1986) and references cited therein.

2. R. Milacic, J. Stupar, N. Kozuh, J. Korosin, I. Glaser et al., Journal of the American Leather Chemists Association, v. 87, pp. 221–232, (1992) and references cited therein.

3. J. H. Bowes and A. S. Raistrack et al., Journal of the American Leather Chemists Association, v. 58; pp. 190–201, (1963) and references cited therein.

Chromium is the predominant tanning material used in leather for shoes and it imparts significant added strength and temperature resistance to the leather. The chemistry of leather and the use of chromium and other transition metals is described in following references: Kirk Othmer Encyclopedia of Chemical Technology, $4^{th}$ Edition, vol. 15, Chapter on Leather, Practical Leather Technology, $4^{th}$ Edition; Thomas C. Thorstensen, Krieger Publishing Company, 1993; and Physical Chemistry of Leather Making, Krystof Bienkiewicz, Robert E. Krieger Publishing, 1983.

Thus the removal of Chromium by the cleaning system is highly undesirable. Thus it is highly desirable that a cleaning system and/or method be devised that delivers an effective level of Ca/Mg removal agent to the washing of leather-containing shoes without removing significant levels of Chromium.

As a result of the complexities associated with the Ca/Mg removal agents for the cleaning system of the present invention, the selection of suitable Ca/Mg removal agents for the cleaning system is dependent upon the form of the treating composition into which the cleaning system is incorporated.

Accordingly, it is very important that the Ca/Mg removal agents used in the cleaning system of the present invention are selected such that those Ca/Mg removal agents with very high binding capabilities for Chromium are not used, while selecting out of from those Ca/Mg removal agents without excessively high Chromium binding constants those that are still effective at binding Ca and Mg divalent ions when used as described herein.

For treating compositions that employ cleaning systems that are applied directly to shoe surfaces, especially soiled exterior shoe surfaces, a high concentration of Ca/Mg removal agents with lower affinities for Ca/Mg, and preferably, lower binding constants for Chromium, can be used because the Ca/Mg removal agent will be in direct contact with the soil.

Whereas, for treating compositions that employ cleaning systems that are indirectly applied to the shoe, such as via an aqueous medium, the Ca/Mg removal agents with a higher affinity for Ca/Mg, and thus a potentially higher binding constant for Chromium, need to be used since the Ca/Mg removal agent is diffused through the aqueous medium and not directly in contact with the soiled shoe surfaces.

Accordingly, it is evident that different selection criteria may be needed to be used for the selection of Ca/Mg removal agents in the cleaning system of the present invention for dilute usage conditions vs. direct application conditions.

Alternatively, larger molecules and/or polymeric compounds can be used as Ca/Mg removal agents in the cleaning system. The larger Ca/Mg removal agent will be less able to penetrate and diffuse into dense leather materials and remove the Chromium. The larger molecule and/or polymeric Ca/Mg removal agent should have a molecular weight greater than 500, preferably greater than a 1000 and most preferably greater than 2000.

However, it is recognized that low levels of Ca/Mg removal agent with high binding constants for transition metal ions serve useful purposes (other than binding Ca and/or Mg) in detergent and other laundry products (e.g. fabric softeners can give other benefits not related to cleaning of clay/dirt/mud/grass soils. For instance it is well known that low levels of chelant are often useful for the stability of certain bleach systems. It is further taught in U.S. Pat. No. 5,686,376 that the presence of low levels of chelants can have color fidelity benefits. Therefore it is envisioned that there may be a low level of chelant that will not damage the leather and yet deliver either the bleach stability or color fidelity benefits discussed above.

Preferred Ca/Mg removal agents include, but are not limited to, Ca/Mg removal agents that provide benefits, in addition to the Ca/Mg removal (clay, mud, dirt soil removal), such as soil dispersancy and/or surfactant benefits.

Apart from the above restrictions and learnings, any conventional Ca/Mg removal agent, organic and/or inorganic, is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate Ca/Mg removal agents can also be used herein. If phosphate Ca/Mg removal agents are used, they are used at low levels, preferably less than 10% of the treating composition.

The level of Ca/Mg removal agents in the treating compositions of the present invention can vary widely depending upon the end use of the treating composition and its desired physical form. When present, the compositions will typically comprise at least about 1% Ca/Mg removal agents. Liquid formulations of the treating compositions of the present invention typically comprise from about 5% to about 60%, more typically from about 5% to about 50%, by weight, of Ca/Mg removal agent. Granular formulations of the treating compositions of the present invention typically comprise from about 10% to about 80%, more typically from about 15% to about 50% by weight, of Ca/Mg removal agent. Lower or higher levels of Ca/Mg removal agent, however, are not meant to be excluded.

Inorganic or P-containing Ca/Mg removal agents include, but are not limited to, the alkali metal, ammonium and alkanolammonium salts of polyphosphates (exemplified by the tripolyphosphates, pyrophosphates, and glassy polymeric meta-phosphates), phosphonates (see, for example, U.S. Pat. Nos. 3,159,581; 3,213,030; 3,422,021; 3,400,148 and 3,422,137), phytic acid, silicates, carbonates (including bicarbonates and sesquicarbonates), sulphates, and aluminosilicates.

However, non-phosphate Ca/Mg removal agents are required in some locales. Importantly, the compositions herein function surprisingly well even in the presence of the so-called "weak" Ca/Mg removal agents (as compared with phosphates) such as citrate, or in the so-called "underbuilt" situation that may occur with zeolite or layered silicate Ca/Mg removal agents.

Suitable silicates include the water-soluble sodium silicates with an $SiO_2$:$Na_2O$ ratio of from about 1.0 to 2.8, with ratios of from about 1.6 to 2.4 being preferred, and about 2.0 ratio being most preferred. The silicates may be in the form of either the anhydrous salt or a hydrated salt. Sodium silicate with an $SiO_2$:$Na_2O$ ratio of 2.0 is the most preferred. Silicates, when present, are preferably present in the treating compositions described herein at a level of from about 5% to about 50% by weight of the composition, more preferably from about 10% to about 40% by weight.

Examples of silicate Ca/Mg removal agents are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Clariant and formerly, Hoechst (commonly abbreviated herein as "SKS-6"). Unlike zeolite Ca/Mg removal agents, the Na SKS-6 silicate Ca/Mg removal agent does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate Ca/Mg removal agents are the alkaline earth and alkali metal carbonates as disclosed in German Patent Application No. 2,321,001 published on Nov. 15, 1973.

Aluminosilicate Ca/Mg removal agents are of great importance in most currently marketed heavy duty granular detergent compositions, and can also be a significant Ca/Mg removal agent ingredient in liquid detergent formulations. Aluminosilicate Ca/Mg removal agents have the empirical formula:

$$[M_z(AlO_2)_y].xH_2O$$

wherein z and y are integers of at least 6, the molar ratio of z to y is in the range from 1.0 to about 0.5, and x is an integer from about 15 to about 264. Preferably, the aluminosilicate Ca/Mg removal agent is an aluminosilicate zeolite having the unit cell formula:

$$Na_z[(AlO_2)_z(SiO_2)_y].xH_2O$$

wherein z and y are at least 6; the molar ratio of z to y is from 1.0 to 0.5 and x is at least 5, preferably 7.5 to 276, more preferably from 10 to 264. The aluminosilicate Ca/Mg removal agents are preferably in hydrated form and are preferably crystalline, containing from about 10% to about 28%, more preferably from about 18% to about 22% water in bound form.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Zeolite X has the formula:

$$Na_{86}[(AlO_2)_{86}(SiO_2)_{106}].276H_2O$$

Organic Ca/Mg removal agents suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate Ca/Mg removal agent can generally be added to the composition in acid form, but can also be added in the form of a neutralized salt. When utilized in salt form, alkali metals, such as sodium, potassium, and lithium, or alkanolammonium salts are preferred.

Included among the polycarboxylate Ca/Mg removal agents are a variety of categories of useful materials. One important category of polycarboxylate Ca/Mg removal agents encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" Ca/Mg removal agents of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful Ca/Mg removal agents include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts, preferably sodium and/or potassium, more preferably sodium. Soluble polymers of this type are known materials. Use of polyacrylates of this type in cleaning and/or detergent compositions has been disclosed, for example, in U.S. Pat. No. 3,308,067. A suitable commercially available polyacrylate is ACUSOL 445N from Rohm & Haas Company.

Acrylic/maleic-based copolymers may also be used as a Ca/Mg removal agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. A suitable commercially available acrylic/maleic-based copolymer is SOKOLAN CP-5 from BASF. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts, preferably sodium and/or potassium, more preferably sodium. Soluble acrylate/ maleate copolymers of this type are known materials which are described in European Patent Application No. 66 915, published Dec. 15, 1982, as well as in EP 193 360, published Sep. 3, 1986, which also describes such polymers comprising hydroxypropylacrylate. Still other useful dispersing agents include the maleic/acrylic/vinyl alcohol terpolymers. Such materials are also disclosed in EP 193 360, including, for example, the 45/45/10 terpolymer of acrylic/maleic/vinyl alcohol.

Citrate Ca/Mg removal agents, e.g., citric acid and soluble salts thereof (particularly sodium salt), are polycarboxylate Ca/Mg removal agents that are suitable for the treating compositions of the present invention due to their availability from renewable resources and their biodegradability. Citrates can also be used in granular compositions, especially in combination with zeolite and/or layered silicate Ca/Mg removal agents. Oxydisuccinates are also especially useful in such compositions and combinations.

Also suitable in the treating compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid Ca/Mg removal agents include the $C_5$–$C_{20}$ alkyl and alkenyl succinic acids and salts thereof. A particularly preferred compound of this type is dodecenylsuccinic acid. Specific examples of succinate Ca/Mg removal agents include: laurylsuccinate, myristylsuccinate, palmitylsuccinate, 2-dodecenylsuccinate (preferred), 2-pentadecenylsuccinate, and the like. Laurylsuccinates are the preferred Ca/Mg removal agents of this group, and are described in European Patent Application 86200690.5/0,200,263, published Nov. 5, 1986.

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phtalic acid derivatives disclosed in British Patent No. 1,425,343. Of the above, the preferred polycarboxylates are hydroxycarboxylates containing up to three carboxy groups per molecule, more particularly citrates.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid Ca/Mg removal agents, especially citrate and/or the succinate Ca/Mg removal agents, to provide additional Ca/Mg removal agent activity. Such use of fatty acids will generally result in a diminution of sudsing, which should be taken into account by the formulator. Additional suitable fatty acid Ca/Mg removal agents for use herein are saturated or unsaturated C10–18 fatty acids, as well as well as the corresponding soaps. Preferred saturated species have from 12 to 16 carbon atoms in the alkyl chain. A preferred unsaturated fatty acid is oleic acid In situations where phosphorus-based Ca/Mg removal agents can be used, and especially in the formulation of bars used for hand-laundering operations, the various alkali metal phosphates such as the well-known sodium tripolyphosphates, sodium pyrophosphate and sodium orthophosphate can be used. Phosphonate Ca/Mg removal agents such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Anionic surfactants as described herein can also function as Ca/Mg removal agents. Nonlimiting examples of anionic surfactants useful herein as Ca/Mg removal agents are generally disclosed in U.S. Pat. No. 4,285,841, Barrat et al, issued Aug. 25, 1981, and in U.S. Pat. No. 3,919,678, Laughlin et al, issued Dec. 30, 1975, both incorporated herein by reference.

Anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–11 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil. Especially valuable are linear straight chain alkylbenzene sulfonates in which the average number of carbon atoms in the alkyl group is from about 11 to 13, abbreviated as $C_{11}$–$C_{13}$LAS.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of a-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Examples of alkyl ester sulfonate surfactants comprise alkyl ester sulfonate surfactants of the structural formula:

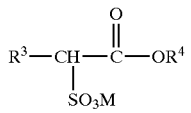

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation. Typically, alkyl chains of $C_{12}$–$C_{16}$ are preferred for lower wash temperatures (e.g. below about 50° C.) and $C_{16\text{-}18}$ alkyl chains are preferred for higher wash temperatures (e.g. above about 50° C.).

Other anionic surfactants useful for detersive purposes include salts of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

It is further contemplated that for shoes containing leather portions which are particularly sensitive to the loss of chromium from leather or shoes that are to be washed on very frequent basis, a formulation containing essentially no Ca/Mg binding agents capable of removing chromium (as defined herein) is highly desirable. To meet this need, formulations are contemplated comprising nonionic surfactants along with other suitable benefit agents and/or detergent adjuncts. While it is possible to formulate such a formula comprising surfactants, anionic surfactants are somewhat less desirable as they have potential to remove chromium and cationic surfactants are sufficiently poor at clay soil removal such that their use is highly undesirable when that soil is present in meaningful quantities.

b. Surfactants—A wide range of surfactants can be used in the treating compositions of the present invention.

Surfactants included in the fully-formulated treating compositions afforded by the present invention comprise at least 0.01%, preferably at least about 0.1%, more preferably at least about 0.5%, even more preferably at least about 1%, most preferably at least about 3% to about 80%, more preferably to about 60%, most preferably to about 50% by weight of treating composition depending upon the particular surfactants used and the desired effects to be achieved.

The surfactant can be nonionic, anionic, ampholytic, amphophilic, zwitterionic, cationic, semi-polar nonionic, and mixtures thereof, nonlimiting examples of which are disclosed in U.S. Pat. Nos. 5,707,950 and 5,576,282. A typical listing of anionic, nonionic, ampholytic and zwitterionic classes, and species of these surfactants, is given in U.S. Pat. No. 3,664,961 issued to Norris on May 23, 1972. Preferred treating compositions comprise nonionic surfactants and/or mixtures of nonionic surfactants with other surfactants, especially anionic surfactants.

Nonlimiting examples of surfactants useful herein include the conventional $C_8$–$C_{18}$ alkyl ethoxylates ("AE"), with EO about 1–22, including the so-called narrow peaked alkyl ethoxylates and $C_6$–$C_{12}$ alkyl phenol alkoxylates (especially ethoxylates and mixed ethoxy/propoxy), alkyl dialkyl amine oxide, alkanoyl glucose amide, $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

i. Nonionic Surfactant

Suitable nonionic surfactants are generally disclosed in U.S. Pat. No. 3,929,678, Laughlin et al., issued Dec. 30, 1975, and U.S. Pat. No. 4,285,841, Barrat et al, issued Aug. 25, 1981. Exemplary, non-limiting classes of useful nonionic surfactants include: $C_8$–$C_{18}$ alkyl ethoxylates ("AAE"), with EO about 1–22, including the so-called narrow peaked alkyl ethoxylates and $C_6$–$C_{12}$ alkyl phenol alkoxylates (especially ethoxylates and mixed ethoxy/ propoxy), alkyl dialkyl amine oxide, alkanoyl glucose amide, and mixtures thereof.

It is well known that the ethoxylated alcohols often form viscous phases when combined with water at certain concentrations. This will appreciated by one skilled in the art such that extremely viscous solutions can be avoided either in the making of the product or in the dissolution of the product during use of the product. This can be done through a variety of means including but not limited to the use of solvents, control of ionic strength, surfactant selection, use and selection of cosurfactants, surfactant to water ratio etc. Alternatively, one skilled in the art may use and control this property so as to give a gel or viscous liquid or paste as may be desired.

If nonionic surfactants are used, the compositions of the present invention will preferably contain from about 1% to about 80%, more preferably from about 1% to about 60%, most preferably from about 1% to about 50% by weight of nonionic surfactant.

Preferred nonionic surfactants include, but are not limited to, the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al. issued Aug. 18, 1981. Particularly preferred are ethoxylated alcohols having an average of from about 9 to abut 15 carbon atoms in the alcohol and an average degree of ethoxylation of from about 5 to about 15 moles of ethylene oxide per mole of alcohol.

Other nonionic surfactants for use herein include:

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-9 (the condensation product of $C_{12}$–$C_{13}$ linear alcohol with 9 moles of ethylene oxide); Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates." Especially preferred nonionic surfactants of this type are the $C_9$–$C_{15}$ primary alcohol ethoxylates containing 5–12 moles of ethylene oxide per mole of alcohol, particularly the $C_9$–$C_{12}$ primary alcohols containing 6–10 moles of ethylene oxide per mole of alcohol and the $C_{12}$–$C_{14}$ primary alcohols containing 6–12 moles of ethylene oxide per mole of alcohol.

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Particularly useful are condensates of ethylene oxide with a hydrophobic moiety to provide a surfactant having an average hydrophilic-lipophilic balance (HLB) in the range from 8 to 17, preferably from 8.5 to 13.5, more preferably from 8.5 to 11.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements. Examples of this type of nonionic surfactant include certain of the commercially available Tetronic® compounds, marketed by BASF.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

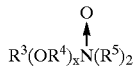

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula:

$$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position. Compounds of this type and their use in detergent are disclosed in EP-B 0 070 077, 0 075 996 and 0 094 118.

Fatty acid amide surfactants having the formula:

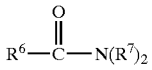

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $—(C^2H_4O)_xH$ where x varies from about 1 to about 3.

Preferred amides are $C_8$–$C_{20}$ ammonia amides, monoethanolamides, diethanolamides, and isopropanolamides.

These and other nonionic surfactants are well known in the art, being described in more detail in Kirk Othmer's Encyclopedia of Chemical Technology, 3rd Ed., Vol. 22, pp. 360–379, "Surfactants and Detersive Systems", incorporated by reference herein.

ii. Anionic Surfactant

Generally speaking, anionic surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975, both incorporated herein by reference.

Anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–11 ethoxycarboxylates), the $C_{10}$–$C_{18}$ sulfated glycerol ethers, the $C_{10}$–$C_{18}$ sulfated alkyl polyglycosides, and $C_{12}$–$C_{18}$ alpha-sulfonated fatty acid esters.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil. Especially valuable are linear straight chain alkylbenzene sulfonates in which the average number of carbon atoms in the alkyl group is from about 11 to 13, abbreviated as $C_{11}$–$C_{13}$LAS.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Examples of alkyl ester sulfonate surfactants comprise alkyl ester sulfonate surfactants of the structural formula:

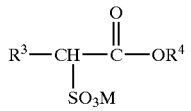

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation. Typically, alkyl chains of $C_{12}$–$C_{16}$ are preferred for lower wash temperatures (e.g. below about 50° C.) and $C_{16\text{-}18}$ alkyl chains are preferred for higher wash temperatures (e.g. above about 50° C.).

Other anionic surfactants useful for detersive purposes include salts of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred alkyl sulfate surfactants are the non-ethoxylated $C_{12\text{-}15}$ primary and secondary alkyl sulfates. Under cold water washing conditions, i.e., less than about 65° F. (18.3° C.), when alkyl sulfates are present, it is preferred that there be a mixture of such ethoxylated and non-ethoxylated alkyl sulfates.

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

When included therein, the treating compositions of the present invention typically comprise from about 1%, preferably from about 3% to about 40%, preferably about 20% by weight of such anionic surfactants.

iii. Amine Oxide Surfactants

The compositions herein also contain amine oxide surfactants of the formula:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R^1$=$C_8$–$C_{18}$, R' is H and q is 0–2, preferably 2. These amine oxides are illustrated by $C_{12\text{-}14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp.

Preferred embodiments include dodecyldimethylamine oxide dihydrate, hexadecyldimethylamine oxide dihydrate, octadecyldimethylamine oxide dihydrate, hexadecyltris (ethyleneoxy)dimethyl-amine oxide, tetradecyldimethylamine oxide dihydrate, and mixtures thereof.

Whereas in certain of the preferred embodiments R' is H, there is some latitude with respect to having R' slightly larger than H. Specifically, the invention further encompasses embodiments wherein R' is $CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide.

iv. Cosurfactants

The treating compositions of the present invention may further comprise, especially when anionic surfactants are present, a cosurfactant selected from the group of primary or tertiary amines. Suitable primary amines for use herein include amines according to the formula:

$$R_1NH_2$$

wherein $R_1$ is a $C_6$–$C_{12}$, preferably $C_6$–$C_{10}$ alkyl chain, or $R_4X(CH_2)_n$, wherein X is —O—, —C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties; or

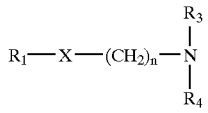

wherein $R_1$ is a $C_6$–$C_{12}$ alkyl group; n is from about 1 to 5, preferably 2 to about 4, more preferably 3. X is a bridging group which is selected from —NH—, —C(O)NH—, —C(O)O—, or —O— or X can be absent; and $R_3$ and $R_4$ are individually selected from H, $C_1$–$C_4$ alkyl, or ($CH_2$—$CH_2$—$O(R_5)$) wherein $R_5$ is H or methyl;

Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

Preferred amines include the following:

$$R_1—(CH_2)_2—NH_2 \quad (1)$$

$$R_1—O—(CH_2)_3—NH_2 \quad (2)$$

$$R_1—C(O)—NH—(CH_2)_3—N(CH_3)_2 \quad (3)$$

$$CH_2—CH(OH)—R_5 \quad (4)$$

$$R_1—N$$

$$CH_2—CH(OH)—R_5$$

wherein $R_1$ is a $C_6$–$C_{12}$ alkyl group and $R_5$ is H or $CH_3$.

In a highly preferred embodiment, the amine is described by the formula:

$$R_1—C(O)—NH—(CH_2)_3—N(CH_3)_2$$

wherein $R_1$ is $C_8$–$C_{12}$ alkyl.

Particularly preferred amines include those selected from the group consisting of octyl amine, hexyl amine, decyl amine, dodecyl amine, $C_8$–$C_{12}$ bis(hydroxyethyl)amine, $C_8$–$C_{12}$ bis(hydroxyisopropyl)amine, and $C_8$–$C_{12}$ amidopropyl dimethyl amine, and mixtures.

If utilized the detersive amines comprise from about 0.1% to about 10%, preferably from about 0.5% to about 5%, by weight of the composition.

v. Quaternary Ammonium Surfactants

Suitable quaternary ammonium surfactants include, but are not limited to, quaternary ammonium surfactants having the formula:

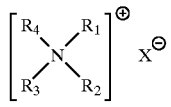

wherein $R_1$ and $R_2$ are individually selected from the group consisting of $C_1$–$C_4$ alkyl. $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6$–$C_{18}$ alkyl, and $R_4$ is selected from the group consisting of $C_1$–$C_{10}$ alkyl, $C_1$–$C_{10}$ hydroxy alkyl, benzyl, and —$(C_2H_4O)_xH$ where x has a value from 2 to 5.

Preferred quaternary ammonium surfactants are the chloride, bromide, and methylsulfate salts. Examples of preferred mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_{8-18}$ alkyl and $R_1$, $R_2$, and $R_4$ are selected from methyl and hydroxy-alkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethylmonohydroxyethyl-ammonium chloride, coconut dimethylmonohydroxyethylammonium methylsulfate, steryl dimethyl-monohydroxy-ethylammonium chloride, steryl dimethylmonohydroxy-ethylammonium methylsulfate, di-$C_{12}$–$C_{14}$ alkyl dimethyl ammonium chloride, and mixtures thereof are particularly preferred. ADOGEN 412™, a lauryl trimethyl ammonium chloride commercially available from Witco, is also preferred. Even more highly preferred are the lauryl trimethyl ammonium chloride and myristyl trimethyl ammonium chloride.

Alkoxylated quaternary ammonium (AQA) surfactants useful in the present invention are of the general formula:

I

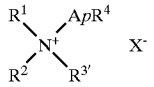

II

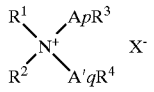

wherein $R^1$ is an alkyl or alkenyl moiety containing from about 8 to about 18 carbon atoms, preferably 10 to about 16 carbon atoms, most preferably from about 10 to about 14 carbon atoms; $R^2$ and $R^{3'}$ are each independently alkyl groups containing from one to about three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, to provide electrical neutrality; A is selected from $C_1$–$C_4$ alkoxy, especially ethoxy (i.e., —$CH_2CH_2O$—), propoxy, butoxy and mixtures thereof; and for formula I, p is from 2 to about 30, preferably 2 to about 15, most preferably 2 to about 8; and for formula II, p is from 1 to about 30, preferably 1 to about 4 and q is from 1 to about 30, preferably 1 to about 4, and most preferably both p and q are 1.

Other quaternary surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl, ring structures formed by joining the two $R^4$ groups, —$CH_2CHOHCHOHCOR^6CHOH$—$CH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

vi. Fatty Acid

Suitable fatty acids that can be incorporated into the treating compositions of the present invention in addition to surfactants, include, but are not limited to, saturated and/or unsaturated fatty acids obtained from natural sources or synthetically prepared. Examples of fatty acids include capric, lauric, myristic, palmitic, stearic, arachidic, and behenic acid. Other fatty acids include palmitoleic, oleic, linoleic, linolenic, and ricinoleic acid.

vii. Cationic/Amphoteric Surfactants

Non-quaternary, cationic surfactants can also be included in the treating compositions of the present invention. Cationic surfactants useful herein are described in U.S. Pat. No. 4,228,044, Cambre, issued Oct. 14, 1980.

Ampholytic surfactants can be incorporated into the treating compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and mixtures thereof.

viii. Polyhydroxy Fatty Acid Amide Surfactants

The treating compositions hereof may also contain polyhydroxy fatty acid amide surfactant. The polyhydroxy fatty acid amide surfactant component comprises compounds of the structural formula:

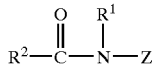

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, and alkoxylated derivatives thereof, where n is an integer from 3 to 5, inclusive, and R' is H or a cyclic or aliphatic monosaccharide. Most preferred are glycityls wherein n is 4, particularly —$CH_2$—$(CHOH)_4$—$CH_2OH$.

R can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

ix. Biodegradably Branched Surfactants

The treating compositions of the present invention may also include biodegradably branched and/or crystallinity disrupted and/or mid-chain branched surfactants or surfactant mixtures. The terms "biodegradably branched" and/or "crystallinity disrupted" and/or "mid-chain branched" (acronym "MCB" used hereinafter) indicate that such surfactants or surfactant mixtures are characterized by the presence of surfactant molecules having a moderately non-linear hydrophobe; more particularly, wherein the surfactant hydrophobe is not completely linear, on one hand, nor is it branched to an extent that would result in unacceptable biodegradation. The preferred biodegradably branched surfactants are distinct from the known commercial LAS, ABS, Exxal, Lial, etc. types, whether branched or unbranched. The biodegradably branched materials comprise particularly positioned light branching, for example from about one to about three methyl, and/or ethyl, and/or propyl or and/or butyl branches in the hydrophobe, wherein the branching is located remotely from the surfactant headgroup, preferably toward the middle of the hydrophobe. Typically from one to three such branches can be present on a single hydrophobe, preferably only one. Such biodegradably branched surfactants can have exclusively linear aliphatic hydrophobes, or the hydrophobes can include cycloaliphatic or aromatic substitution. Highly preferred are MCB analogs of common linear alkyl sulfate, linear alkyl poly(alkoxylate) and linear alkylbenzenesulfonate surfactants, said surfactant suitably being selected from mid-chain-$C_1$–$C_4$-branched $C_8$–$C_{18}$-alkyl sulfates, mid-chain-$C_1$–$C_4$-branched $C_8$–$C_{18}$-alkyl ethoxylated, propoxylated or butoxylated alcohols, mid-chain-$C_1$–$C_4$-branched $C_8$–$C_{18}$-alkyl ethoxysulfates, mid-chain-$C_1$–$C_4$-branched $C_8$–$C_{16}$-alkyl benzenesulfonates and mixtures thereof. When anionic, the surfactants can in general be in acid or salt, for example sodium, potassium, ammonium or substituted ammonium, form. The biodegradably branched surfactants offer substantial improvements in cleaning performance and/or usefulness in cold water and/or resistance to water hardness and/or economy of utilization. Such surfactants can, in general, belong to any known class of surfactants, e.g., anionic, nonionic, cationic, or zwitterionic. The biodegradably branched surfactants are synthesized through processes of Procter & Gamble, Shell, and Sasol. These surfactants are more fully disclosed in WO98/23712 A published Jun. 4, 1998; WO97/38957 A published Oct. 23, 1997; WO97/38956 A published Oct. 23, 1997; WO97/39091 A published Oct. 23, 1997; WO97/39089 A published Oct. 23, 1997; WO97/39088 A published Oct. 23, 1997; WO97/39087 A1 published Oct. 23, 1997; WO97/38972 A published Oct. 23, 1997; WO 98/23566 A Shell, published Jun. 4, 1998; technical bulletins of Sasol; and the following pending patent applications assigned to Procter & Gamble:

Preferred biodegradably branched surfactants herein in more detail include MCB surfactants as disclosed in the following references:

WO98/23712 A published Jun. 4, 1998 includes disclosure of MCB nonionic surfactants including MCB primary alkyl polyoxyalkylenes of formula (1): $CH_3CH_2(CH_2)_wC(R)H(CH_2)_xC(R^2)H(CH_2)_yC(R^2)H(CH_2)_z(EO/PO)_mOH$ (1), where the total number of carbon atoms in the branched primary alkyl moiety of this formula, including the R, $R^1$ and $R^2$ branching, but not including the carbon atoms in the EO/PO alkoxy moiety, is preferably 14–20, and wherein further for this surfactant mixture, the average total number of carbon atoms in the MCB primary alkyl hydrophobe moiety is preferably 14.5–17.5, more preferably 15–17; R, $R^1$ and $R^2$ are each independently selected from hydrogen and 1–3C alkyl, preferably methyl, provided R, $R^1$ and $R^2$ are not all hydrogen and, when z is 1, at least R or $R^1$ is not hydrogen; w is an integer of 0–13; x is an integer of 0–13; y is an integer of 0–13; z is an integer of at least 1; w+x+y+z is 8–14; and EO/PO are alkoxy moieties preferably selected from ethoxy, propoxy and mixed ethoxy/propoxy groups, where m is at least 1, preferably 3–30, more preferably 5–20, most preferably 5–15. Such MCB nonionics can alternately include butylene oxide derived moieties, and the —OH moiety can be replaced by any of the well-known end-capping moieties used for conventional nonionic surfactants.

WO97/38957 A published Oct. 23, 1997 includes disclosure of mid- to near-mid-chain branched alcohols of formulae $R—CH_2CH_2CH(Me)CH—R^1—CH_2OH$ (I) and $HOCH_2—R—CH_2—CH_2—CH(Me)—R'$ (II) comprising: (A) dimerising alpha-olefins of formula $RCH{=}CH_2$ and $R^1CH{=}CH_2$ to form olefins of formula $R(CH_2)_2—C(R^1){=}CH_2$ and $R^1(CH_2)_2—C(R){=}CH_2$; (B) (i) isomerising the olefins and then reacting them with carbon monoxide/hydrogen under Oxo conditions or (ii) directly reacting the olefins from step (A) with $CO/H_2$ under Oxo conditions. In the above formulae, R, $R^1$=3–7C linear alkyl. WO97/38957 A also discloses (i) production of MCB alkyl sulphate surfactants by sulphating (I) or (II); (ii) preparation of MCB alkylethoxy sulphates which comprises ethoxylating and then sulphating (I) or (II); (iii) preparation of MCB alkyl carboxylate surfactants which comprises oxidising (I) or (II) or their aldehyde intermediates and (iv) preparation of MCB acyl taurate, MCB acyl isethionate, MCB acyl sarcosinate or MCB acyl N-methylglucamide surfactants using the branched alkyl carboxylates as feedstock.

WO97/38956 A published Oct. 23, 1997 discloses the preparation of mid- to near mid-chain branched alpha olefins which is effected by: (a) preparing a mixture of carbon monoxide and hydrogen; (b) reacting this mixture in the presence of a catalyst under Fischer-Tropsch conditions to prepare a hydrocarbon mixture comprising the described olefins; and (c) separating the olefins from the hydrocarbon mixture. WO97/38956 A further discloses the preparation of mid- to near mid-chain branched alcohols by reacting the olefins described with $CO/H_2$ under Oxo conditions. These alcohols can be used to prepare (1) MCB sulphate surfactants by sulphating the alcohols; (2) MCB alkyl ethoxy sulphates by ethoxylating, then sulphating, the alcohols; or (3) branched alkyl carboxylate surfactants by oxidising the alcohols or their aldehyde intermediates. The branched carboxylates formed can be used as a feedstock to prepare branched acyl taurate, acyl isethionate, acyl sarcosinate or acyl N-methylglucamide surfactants, etc.

WO97/39091 A published Oct. 23, 1997 includes disclosure of a detergent surfactant composition comprising at least 0.5 (especially 5, more especially 10, most especially 20) wt % of longer alkyl chain, MCB surfactant of formula (I). A—X—B (I) wherein A is a 9–22 (especially 12–18) C MCB alkyl hydrophobe having: (i) a longest linear C chain attached to the X—B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from C 1 which is attached to the $CH_2B$ moiety, to the omega-2 carbon (the terminal C minus 2C); and (iv) the surfactant composition has an average total number of C atoms in the A—X moiety of 14.5–17.5 ( especially 15–17); and B is a hydrophilic (surfactant head-group) moiety preferably selected from sulfates, sulfonates, polyoxyalkylene (especially polyoxyethylene or polyoxypropylene), alkoxylated sulphates, polyhydroxy moieties, phosphate esters, glycerol sulphonates, polygluconates, polyphosphate esters, phosphonates, sulphosuccinates, sulphosuccinates, polyalkoxylated carboxylates, glucamides, taurinates, sarcosinates, glycinates, isethionates, mono-/di-alkanol-amides, monoalkanolamide sulphates, diglycolamide and their sulphates, glyceryl esters and their sulphates, glycerol ethers and their sulphates, polyglycerol ether and their sulphates, sorbitan esters, polyalkoxylated sorbitan esters, ammonio-alkanesulphonates, amidopropyl betaines, alkylated quat., alkylated/polyhydroxyalkylated (oxypropyl) quat., imidazolines, 2-yl succinates, sulphonated alkyl esters and sulphonated fatty acids; and X— is —$CH_2$— or —C(O)—. WO97/39091 A also discloses a laundry detergent or other cleaning composition comprising: (a) 0.001–99% of detergent surfactant (I); and (b) 1–99.999% of adjunct ingredients.

WO97/39089 A published Oct. 23, 1997 includes disclosure of liquid cleaning compositions comprising: (a) as part of surfactant system 0.1–50 (especially 1–40) wt % of a mid-chain branched surfactant of formula (I); (b) as the other part of the surfactant system 0.1–50 wt % of co-surfactant(s); (c) 1–99.7 wt % of a solvent; and (d) 0.1–75 wt % of adjunct ingredients. Formula (I) is A—$CH_2$—B wherein A=9–22 (especially 12–18) C MCB alkyl hydrophobe having: (i) a longest linear C chain attached to the X—B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from Carbon No. 1 which is attached to the $CH_2B$ moiety, to the omega-2 carbon (the terminal C minus 2C); and (iv) the surfactant composition has an average total number of C atoms in the A—X moiety of 14.5–17.5 (especially 15–17); and B is a hydrophilic moiety selected from sulphates, polyoxyalkylene (especially polyoxyethylene and polyoxypropylene) and alkoxylated sulphates.

WO97/39088 A published Oct. 23, 1997 includes disclosure of a surfactant composition comprising 0.001–100% of MCB primary alkyl alkoxylated sulphate(s) of formula (I):

$$CH_3CH_2(CH)_wCHR(CH_2)_xCHR^1(CH_2)_yCHR^2(CH_2)_zOSO_3M \quad (I)$$

wherein the total number of C atoms in compound (I) including R, $R^1$ and $R^2$, is preferably 14–20 and the total number of C atoms in the branched alkyl moieties preferably averages 14.5–17.5 (especially 15–17); R, $R^1$ and $R^2$ are selected from H and 1–3C alkyl (especially Me) provided R, $R^1$ and $R^2$ are not all H; when z=1 at least R or $R^1$ is not H; M are cations especially selected from Na, K, Ca, Mg, quaternary alkyl ammonium of formula $N^+R^3R^4R^5R^6$ (H); M is especially Na and/or K; $R^3$, $R^4$, $R^5$, $R^6$ are selected from H, 1–22C alkylene, 4–22C branched alkylene, 1–6C alkanol, 1–22C alkenylene, and/or 4–22C branched alkenylene; w, x, y=0–13; z is at least 1; w+x+y+z=8–14. WO97/39088 A also discloses (1) a surfactant composition comprising a mixture of branched primary alkyl sulphates of formula (I) as above. M is a water-soluble cation; When $R^2$ is 1–3C alkyl, the ratio of surfactants having z=1 to surfactants having z=2 or greater is preferably at least 1:1 (most especially 1:100); (2) a detergent composition comprising: (a) 0.001–99% of MCB primary alkyl alkoxylated sulphate of formula (III) and/or (IV).

$$CH_3(CH_2)_aCH(CH_3)(CH_2)_bCH_2OSO_3M \quad (III)$$

$$CH_3(CH_2)_dCH(CH_3)(CH_2)_eCH(CH_3)CH_2OSO_3M \quad (IV)$$

wherein a, b, d, and e are integers, preferably a+b=10–16, d+e=8–14 and when a+b=10, a=2–9 and b=1–8; when a+b=11, a=2–10 and b=1–9; when a+b=12, a=2–11 and b=1–10; when a+b=13, A=2–12 and b=1–11; when a+b=14, a=2–13 and b=1–12; when a+B=15, a=2–14 and b=1–13; when a+b=16, a=2–14 and b=1–14; when d+e=8, d=2–7 and e=1–6; when d+e=9, d=2–8 and e=1–7; when d+e=10, d=2–9 and e=1–8; when d+e=11, d=2–10 and e=1–9; when d+e=12, d=2–11 and e=1–10; when d+e=13, d=2–12 and e=1–11; when d+e=14, d=2–13 and e=1–12; and (b) 1–99.99 wt % of detergent adjuncts; (3) a mid-chain branched primary alkyl sulphate surfactant of formula(V):

$$CH_3CH_2(CH_2)_xCHR^1(CH_2)_yCHR^2(CH_2)_zOSO_3M \quad (V)$$

wherein x, y=0–12; z is at least 2; x+y+z=11–14; $R^1$ and $R^2$ are not both H; when one of $R^1$ or $R^2$ is H, and the other is Me, x+y+z is not 12 or 13; and when $R^1$ is H and $R^2$ is Me, x +y is not 11 when z=3 and x+y is not 9 when z=5; (4) Alkyl sulphates of formula (III) in which a and b are integers and a=b=12 or 13, a=2–11, b=1–10 and M is Na, K, and optionally substituted ammonium; (5) alkyl sulphates of formula (IV) in which d and e are integers and d=e is 10 or 11 and when d=e is 10, d=2–9 and e=1–8; when d=e=11, d=2–10 and e=1–9 and m is Na, K, optionally substituted ammonium (especially Na); (6) methyl branched primary alkyl sulphates selected from 3-, 4-, 5-, 6-, 7-, 8-, 9-, 10-, 11-, 12- or 13-methyl pentadecanol sulphate; 3-, 4-, 5-, 6-, 7-, 8-, 9-, 10-, 11-, 12-, 13-, or 14-methyl hexadecanol sulphate; 2,3-, 2,4-, 2,5-, 2,6-, 2,7-, 2,8-, 2,9-, 2,10-, 2,11-, 2,12-methyl tetradecanol sulphate; 2,3-, 2,4-, 2,5-, 2,6-, 2,7-, 2,8-, 2,9-, 2,10-, 2,11-, 2,12-, or 2,13-methyl pentadecanol sulphate and/or mixtures of these compounds.

WO97/39087 A published Oct. 23, 1997 includes disclosure of a surfactant composition comprising 0.001–100% of mid-chain branched primary alkyl alkoxylated sulphate(s) of formula (I) wherein that total number of C atoms in compound (I) including R, $R^1$ and $R^3$, but not including C atoms of EO/PO alkoxy moieties is 14–20 and the total number of C atoms in branched alkyl moieties averages 14.5–17.5 (especially 15–17); R, R1 and R2=H or 1–3C alkyl (especially Me) and R, $R^1$ and $R^2$ are not all H; when z=1 at least R or $R^1$ is not H; M=cations especially selected from Na, K, Ca, Mg, quaternary alkyl amines of formula (II) (M is especially Na and/or K) $R^3$, $R^4$, $R^5$, $R^6$=H, 1–22C alkylene, 4–22C branched alkylene, 1–6C alkanol, 1–22C alkenylene, and/or 4–22C branched alkenylene; w, x, y=0–13; z is at least 1; w+x+y+z=8–14; EO/PO are alkoxy moieties, especially ethoxy and/or propoxy; m is at least 0.01, especially 0.1–30, more especially 0.5–10, most especially 1–5. Also disclosed are: (1) a surfactant composition comprising a mixture of branched primary alkyl alkoxylated sulphates of formula (I) When $R^2$=1–3C alkyl, the ratio of surfactants having z=2 or greater to surfactant having z=1 is at least 1:1, especially 1.5:1, more especially 3:1, most especially 4:1; (2) a detergent composition comprising: (a) 0.001–99% of mid-chain branched primary alkyl alkoxylated sulphate of formula (III) and/or (IV) M is as above; a, b, d, and e are integers, a+b=10–16, d+e=8–14 and when a+b=10, a=2–9 and b=1–8; when a+b=1, a=2–10 and b=1–9; when a+b=12, a=2–11 and b=1–10; when a+b=13, a=2–12 and b=1–11; when a+b=14, a=2–13 and b=1–12; when a+b=15, a=2–14 and b=1–13; when a+b=16, a=2–14 and b=1–14; when d+e=8, d=2–7 and e=1–6; when d+e=9, d=2–8 and e=1–7; when d+e=10, d=2–9 and e=1–8; when d+e=11, d=2–10 and e=1–9; when d+e=12, d=2–11 and e=1–10; when d+e=13, d=2–12 and e=1–11; when d+e=14, d=2–13 and e=1–12; and (b) 1–99.99 wt % of detergent adjuncts; (3) a MCB primary alkyl alkoxylated sulphate surfactant of formula(V) R1, R2, M, EO/PO, m as above; x,y=0–12; z is at least 2; x+y+z=11–14; (4) a mid-chain branched alkyl alkoxylated sulphate of formula (III) in which: a=2–11; b=1–10; a+b=12 or 13; M, EO/PO and m are as above; (5) a mid-chain branched alkyl alkoxylated sulphate compound of formula (IV) in which: d+e=10 or 11; when d+e=10, d=2–9 and e=1–8 and when d+e=11, d=2–10 and e=1–9; M is as above (especially Na); EO/PO and m are as above; and (6) methyl branched primary alkyl ethoxylated sulphates selected from 3-, 4-, 5-, 6-, 7-, 8-, 9-, 10-, 11-, 12- or 13- methyl pentadecanol ethoxylated sulphate; 3-, 4-, 5-, 6-, 7-, 8-, 9-, 10-, 11-, 12-, 13-, or 14-methyl hexadecanol ethoxylated sulphate; 2,3-, 2,4-, 2,5-, 2,6-, 2,7-, 2,8-, 2,9-, 2,10-, 2,11-, 2,12-methyl tetradecanol ethoxylated sulphate; 2,3-, 2,4-, 2,5-, 2,6-, 2,7-, 2,8-, 2,9-, 2,10-, 2,11-, 2,12-, or 2,13-methyl pentadecanol ethoxylated sulphate and/or mixtures of these compounds. The compounds are ethoxylated with average degree of ethoxylation of 0.1–10.

WO97/38972 A published Oct. 23, 1997 includes disclosure of a method for manufacturing longer chain alkyl sulphate surfactant mixture compositions comprising (a) sulphating with $SO_3$, preferably in a falling film reactor, a long chain aliphatic alcohol mixture having an average carbon chain length of at least 14.5–17.5, the alcohol mixture comprising at least 10%, preferably at least 25%, more preferably at least 50% still more preferably at least 75%, most preferably at least 95% of a MCB aliphatic alcohol having formula (I); where: R,$R^1$,$R^2$=H or 1–3C alkyl, preferably methyl, provided R, $R^1$ and $R^2$ are not all H, and when z=1, at least R or $R^1$ is not H; w,x,y=integers 0–13; z=integer of at least 1; and w+x+y+z=8–14; where the total number of carbon atoms in the branched primary, alkyl moiety of formula (I), including the R, $R^1$ and $R^2$ branching, is 14–20, and where further for the alcohol mixture the average total number of carbon atoms in the branched primary alkyl moieties having formula (I) is >14.5–17.5, preferably, >15–17; and (b) neutralising the alkyl sulphate acid produced by step (a), preferably using a base selected from KOH, NaOH, ammonia, monoethanolamine, triethanolamine and mixtures of these. Also disclosed is a method for manufacturing longer chain alkyl alkoxylated sulphate surfactant mixture compositions, comprising alkoxylating the specified long chain aliphatic alcohol mixture; sulphating the resulting polyoxyalkylene alcohol with $SO_3$; and neutralising the resulting alkyl alkoxylate sulphate acid. Alternatively, the alkyl alkoxylated sulphates may be produced directly from the polyoxyalkylene alcohol by sulphating with $SO_3$ and neutralising.

WO 98/23566 A Shell, published Jun. 4, 1998 discloses branched primary alcohol compositions having 8–36 C atoms and an average number of branches per mol of 0.7–3 and comprising ethyl and methyl branches. Also disclosed are: (1) a branched primary alkoxylate composition preparable by reacting a branched primary alcohol composition as above with an oxirane compound; (2) a branched primary alcohol sulphate preparable by sulphating a primary alcohol composition as above; (3) a branched alkoxylated primary alcohol sulphate preparable by alkoxylating and sulphating a branched alcohol composition as above; (4) a branched primary alcohol carboxylate preparable by oxidising a branched primary alcohol composition as above; (5) a detergent composition comprising: (a) surfactant(s) selected from branched primary alcohol alkoxylates as in (1), branched primary alcohol sulphates as in (2), and branched alkoxylated primary alcohol sulphates as in (3); (b) a builder; and (c) optionally additive(s) selected from foam control agents, enzymes, bleaching agents, bleach activators, optical brighteners, co-builders, hydrotropes and stabilisers. The primary alcohol composition, and the sulphates, alkoxylates, alkoxy sulphates and carboxylates prepared from them exhibit good cold water detergency and biodegradability.

Biodegradably branched surfactants useful herein also include the modified alkylaromatic, especially modified alkylbenzenesulfonate surfactants described in copending commonly assigned patent applications (P&G Case Nos. 7303P, 7304P). In more detail, these surfactants include (P&G Case 6766P) alkylarylsulfonate surfactant systems comprising from about 10% to about 100% by weight of said surfactant system of two or more crystallinity-disrupted alkylarylsulfonate surfactants of formula $(B—Ar—D)_a(M^{q+})_b$ wherein D is $SO_3^-$, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C. and wherein further said alkylarylsulfonate surfactant system has at least one of the following properties: percentage biodegradation, as measured by the modified SCAS test, that exceeds tetrapropylene benzene sulfonate; and weight ratio of nonquaternary to quaternary carbon atoms in B of at least about 5:1.

Such compositions also include (P&G Case 7303P) surfactant mixtures comprising (preferably, consisting essentially of): (a) from about 60% to about 95% by weight (preferably from about 65% to about 90%, more preferably from about 70% to about 85%) of a mixture of branched alkylbenzenesulfonates having formula (I):

(I)

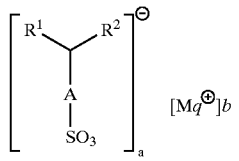

wherein L is an acyclic aliphatic moiety consisting of carbon and hydrogen and having two methyl termini, and wherein said mixture of branched alkylbenzenesulfonates contains two or more (preferably at least three, optionally more) of said compounds differing in molecular weight of the anion of said formula (I) and wherein said mixture of branched alkylbenzenesulfonates is characterized by an average carbon content of from about 10.0 to about 14.0 carbon atoms (preferably from about 11.0 to about 13.0, more preferably from about 11.5 to about 12.5), wherein said average carbon content is based on the sum of carbon atoms in $R^1$, L and $R^2$, (preferably said sum of carbon atoms in $R^1$, L and $R^2$ is from 9 to 15, more preferably, 10 to 14) and further, wherein L has no substituents other than A, $R^1$ and $R^2$; M is a cation or cation mixture (preferably selected from H, Na, K, Ca, Mg and mixtures thereof, more preferably selected from H, Na, K and mixtures thereof, more preferably still, selected from H, Na, and mixtures thereof) having a valence q (typically from 1 to 2, preferably 1); a and b are integers selected such that said compounds are electroneutral (a is typically from 1 to 2, preferably 1, b is 1); $R^1$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said branched alkylbenzenesulfonates $R^2$ is H); A is a benzene moiety (typically A is the moiety —$C_6H_4$—, with the $SO_3$ moiety of Formula (I) in para-position to the L moiety, though in some proportion, usually no more than about 5%, preferably from 0 to 5% by weight, the $SO_3$ moiety is ortho- to L); and (b) from about 5% to about 60% by weight (preferably from about 10% to about 35%, more preferably from about 15% to about 30%) of a mixture of nonbranched alkylbenzenesulfonates having formula (II):

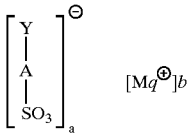

(II)

wherein a, b, M, A and q are as defined hereinbefore and Y is an unsubstituted linear aliphatic moiety consisting of carbon and hydrogen having two methyl termini, and wherein Y has an average carbon content of from about 10.0 to about 14.0 (preferably from about 11.0 to about 13.0, more preferably 11.5 to 12.5 carbon atoms); (preferably said mixture of nonbranched alkylbenzenesulfonates is further characterized by a sum of carbon atoms in Y, of from 9 to 15, more preferably 10 to 14); and wherein said composition is further characterized by a 2/3-phenyl index of from about 350 to about 10,000 (preferably from about 400 to about 1200, more preferably from about 500 to about 700) (and also preferably wherein said surfactant mixture has a 2-methyl-2-phenyl index of less than about 0.3, preferably less than about 0.2, more preferably less than about 0.1, more preferably still, from 0 to 0.05).

Also encompassed by way of mid-chain branched surfactants of the alkylbenzene-derived types are surfactant mixtures comprising the product of a process comprising the steps of: alkylating benzene with an alkylating mixture; sulfonating the product of (I); and neutralizing the product of (II); wherein said alkylating mixture comprises: (a) from about 1% to about 99.9%, by weight of branched $C_7$–$C_{20}$ monoolefins, said branched monoolefins having structures identical with those of the branched monoolefins formed by dehydrogenating branched parafins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_7$–$C_{20}$ linear aliphatic olefins; wherein said alkylating mixture contains said branched $C_7$–$C_{20}$ monoolefins having at least two different carbon numbers in said $C_7$–$C_{20}$ range, and has a mean carbon content of from about 9.5 to about 14.5 carbon atoms; and wherein said components (a) and (b) are at a weight ratio of at least about 15:85.

C. Dispersants/Anti-Redeposition Agents—One or more suitable polyalkyleneimine dispersants may be incorporated into the treating compositions of the present invention. Examples of such suitable dispersants can be found in European Patent Application Nos. 111 965, 111 984, and 112 592; U.S. Pat. Nos. 4,597,898, 4,548,744, and 5,565,145. However, any suitable clay/soil dispersent or anti-redepostion agent can be used in the treating compositions of the present invention.

In addition, polymeric dispersing agents which include polymeric polycarboxylates and polyethylene glycols, are suitable for use in the present invention. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in cleaning and/or detergent compositions has been disclosed, for example, in U.S. Pat. No. 3,308,067.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66 915, published Dec. 15, 1982, as well as in EP 193 360, published Sep. 3, 1986, which also describes such polymers comprising hydroxypropylacrylate. Still other useful dispersing agents include the maleic/acrylic/vinyl alcohol terpolymers. Such materials are also disclosed in EP 193 360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite Ca/Mg removal agents. Dispersing agents such as polyaspartate preferably have a molecular weight (avg.) of about 10,000.

The treating compositions herein may also comprise at least about 0.05%, preferably from about 0.05% to about 3%, by weight, of a water-soluble or dispersible, modified polyamine agent, said agent comprising a polyamine backbone corresponding to the formula:

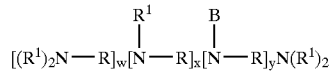

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

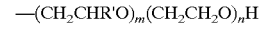

wherein $R^1$ is methyl or ethyl, m and n are preferably from about 0 to about 50, provided the average value of alkoxylation provided by m+n is at least about 0.5.

One suitable ethoxylated amine is ethoxylated tetraethylenepentamine. Other exemplary ethoxylated amines are further described in U.S. Pat. No. 4,891,160 Vander Meer, issued Jan. 2, 1990; U.S. Pat. No. 4,597,898 VanderMeer, issued Jul. 1, 1986; and U.S. Pat. No. 5,565,145 Watson et al., issued Oct. 15, 1996; all of which are included herein by reference.. Another group of preferred clay soil removal/antiredeposition agents are the cationic compounds disclosed in European Patent Application 111 965, Oh and Gosselink, published Jun. 27, 1984. Other clay soil removal/antiredeposition agents which can be used include the ethoxylated amine polymers disclosed in European Patent Application 111 984, Gosselink, published Jun. 27, 1984; the zwitterionic polymers disclosed in European Patent Application 112 592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. However, any suitable clay/soil dispersent or anti-redepostion agent can be used in the treating compositions of the present invention. These materials are well known in the art.

Another polymer dispersant form use herein includes polyethoxyated-polyamine polymers (PPP). The preferred polyethoxylated-polyamines useful herein are generally polyalkyleneamines (PAA's), polyalkyleneimines (PAI's), preferably polyethyleneamine (PEA's), polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Polyethoxylated polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951

Optionally, but preferred polyethoxyated-polyamine polymers useful for this invention are alkoxylated quaternary diamines of the general formula:

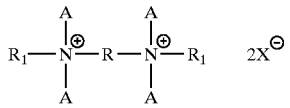

where R is selected from linear or branched $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $[(CH_2CH_2O)_qCH_2CH_2]$— and —$CH_2CH(OH)CH_2O$—$(CH_2CH_2O)_qCH_2CH(OH)CH_2]$— where q is from about 1 to about 100. Each $R_1$ is independently selected from $C_1$–$C_4$ alkyl, $C_7$–$C_{12}$ alkylaryl, or A. A is of the formula:

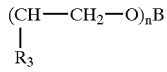

where $R_3$ is selected from H or $C_1$–$C_3$ alkyl, n is from about 5 to about 100, and B is selected from H, $C_1$–$C_4$ alkyl, acetyl, or benzoyl; X is a water soluble anion.

In preferred embodiments, R is selected from $C_4$ to $C_8$ alkylene, $R_1$ is selected from $C_1$–$C_2$ alkyl or $C_2$–$C_3$ hydroxyalkyl, and A is:

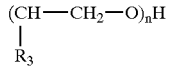

where $R_3$ is selected from H or methyl, and n is from about 10 to about 50.

In another preferred embodiment R is linear or branched $C_6$, $R_1$ is methyl, $R_3$ is H, and n is from about 20 to about 50.

Additional alkoxylated quaternary polyamine dispersants which can be used in the present invention are of the general formula:

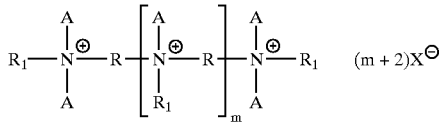

where R is selected from linear or branched $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $[(CH_2CH_2O)_qCH_2CH_2]$— and —$CH_2CH(OH)CH_2O$—$(CH_2CH_2O)_qCH_2CH(OH)CH_2]$— where q is from about 1 to about 100. If present, Each $R_1$ is independently selected from $C_1$–$C_4$ alkyl, $C_7$–$C_{12}$ alkylaryl, or A. $R_1$ may be absent on some nitrogens; however, at least three nitrogens must be quaternized.

A is of the formula:

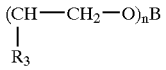

where $R_3$ is selected from H or $C_1$–$C_3$ alkyl, n is from about 5 to about 100 and B is selected from H, $C_1$–$C_4$ alkyl, acetyl, or benzoyl; m is from about 0 to about 4, and X is a water soluble anion.

In preferred embodiments, R is selected from $C_4$ to $C_8$ alkylene, $R_1$ is selected from $C_1$–$C_2$ alkyl or $C_2$–$C_3$ hydroxyalkyl, and A is:

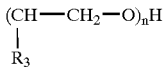

where $R_3$ is selected from H or methyl, and n is from about 10 to about 50; and m is 1.

In another preferred embodiment R is linear or branched $C_6$, $R_1$ is methyl, $R_3$ is H, and n is from about 20 to about 50, and m is 1.

The levels of these polyethoxyated-polyamine polymers used can range from about 0.1% to about 10%, typically from about 0.4% to about 5%, by weight. These polyethoxyated-polyamine polymers can be synthesized following the methods outline in U.S. Pat. No. 4,664,848, or other ways known to those skilled in the art.

The compositions of the present invention can also optionally contain water-soluble ethoxylated amines having clay soil removal and antiredeposition properties. Granular treating compositions which contain these compounds typically contain from about 0.01% to about 10.0% by weight of the water-soluble ethoxylates amines; liquid treating compositions typically contain about 0.01% to about 5%.

Preferred Form of Cleaning System

In general the most preferred form of the cleaning system of the present invention is gel and/or paste, with liquid less preferred and granules least preferred. Gels and paste can be applied directly to the shoe surface and thus give better performance. Liquid treating compositions can also be applied directly to the shoe but because of their generally lower viscosity, they often will flow off the shoe prior to placement of the shoe in the wash which may be messy and inconvenient for the user. Similarly, the liquid treating composition will likely be quickly washed off in the wash thus causing the benefits of direct addition to be diminished. Granular treating compositions are difficult to pre-treat with and as such are least preferred.

The performance and/or aesthetics of the gel, liquid and/or paste can be highly dependent on both its viscosity and its dissolution rate or profile. The liquid paste or gel should have a viscosity sufficiently high such that it is easy to apply in bulk to the shoe. If the viscosity is too low, the treatment may substantially simply drain off the shoe prior to washing. If this occurs, then the cleaning benefit from pretreatment may be substantially lost. Moreover the treatment of the outside of the shoe with a low viscosity treating solution can be messy and thus substantially inconvenient to the user.

If the viscosity is too high, the treatment may not be able to effectively interact with the soil and/or surfaces of the shoe to have the desired treatment benefit on those soils and/or surfaces. In addition, many highly viscous solutions are difficult to dissolve or disperse quickly. Poor or incomplete dissolution or dispersion is highly undesirable as the residual largely undissolved treatment is aesthetically unpleasing to the consumer and would in many case be uncomfortable to wear.

Similarly, it is desirable that the dissolution and/or dispersion properties of the composition be such that substantially all of the cleaning agents be dissolved prior to the end of the treating cycles. More preferably, it is desired that substantially all of the cleaning agents be dispersed prior to the end of the treatment in which it was added.

Gel

An example of a suitable gel for the cleaning system of the present invention comprises, by weight of the composition:

a) from about 8% to about 20% of a nonionic surfactant system such as NEODOL® 23-9 available from Shell Chemical Company; and b) from about 30% to about 50% of a sodium salt of polyacrylic acid such as Acusol 445N available from Rohm & Haas as a 45% active solution.

Another example of a suitable gel for the cleaning system of the present invention comprises, by weight of the system:

a) from about 8% to about 20% of a nonionic surfactant system such as NEODOL® 23-9 available from Shell Chemical Company; and b) from about 30% to about 50% of an acrylic acid/maleic acid copolymer available under the tradename SOKALAN® CP-5 from BASF.

A further example of a suitable gel for the cleaning system of the present invention comprises, by weight of the composition:

a) from about 15% to about 40% of an anionic surfactant system which comprises, by weight of the composition:

(i) from about 5% to about 25% of alkyl polyethoxylate sulfates wherein the alkyl group contains from about 10 to about 22 carbon atoms and the polyethoxylate chain contains from 0.5 to about 15, preferably from 0.5 to about 5, more preferably from 0.5 to about 4, ethylene oxide moieties; and (ii) from about 5% to about 20% of fatty acids; and b) one or more of the following ingredients: detersive amine, modified polyamine, polyamide-polyamine, polyethoxylated-polyamine polymers, quaternary ammonium surfactants, suitable electrolyte or acid equivalents thereof, and mixtures thereof.

Such anionic surfactant-based gel compositions herein have a viscosity at 20 $s^{-1}$ shear rate of from about 100 cp to about 4,000 cp, preferably from about 300 cp to about 3,000 cp, more preferably from about 500 cp to about 2,000 cp and are stable upon storage.

Examples of such anionic surfactant-based gel compositions herein are structured and preferably have a specific rheology. The rheology can be modeled by the following formula:

$$\eta=\eta_O+K\gamma^{(n-1)}$$

where $\eta$ is the viscosity of the liquid at a given shear rate, $\eta_O$ is the viscosity at infinite shear rate, $\gamma$ is the shear rate, n is the shear rate index, and K is the consistency index. As used herein, the term "structured" indicates a heavy duty liquid composition having a liquid crystalline lamellar phase and an infinite shear viscosity (rilo) value between 0 and about 3,000 cp (centipoise), a shear index (n) value of less than about 0.6, a consistency index value, K, of above about 1,000, and a viscosity ($\eta$) measured at 20 $s^{-1}$ of less than about 10,000 cp, preferably less than about 5,000 cp. Under low stress levels, a "zero shear" viscosity is above about 100,000 cp wherein "zero shear" is meant a shear rate of 0.001 $s^{-1}$ or less. The yield value of the compositions herein, obtained by plotting viscosity versus stress, is larger than 0.2 Pa. These rheology parameters can be measured with any commercially available rheometer, such as the Carrimed CSL 100 model.

Electrolytes—Without being limited by theory, it is believed that the presence of electrolytes can act to control the viscosity of the gel compositions. Thus, the gel nature of the compositions herein can be affected by the choice of surfactants and by the amount of electrolytes present.

The compositions herein may optionally contain from about 0% to about 10%, by weight, of solvents and hydrotropes. Without being limited by theory, it is believed that the presence of solvents and hydrotropes can affect the structured versus isotropic nature of the compositions; By "solvent" is meant the commonly used solvents in the detergent industry, including alkyl monoalcohol, di-, and tri-alcohols, ethylene glycol, propylene glycol, propanediol, ethanediol, glycerine, etc. By "hydrotrope" is meant the commonly used hydrotropes in the detergent industry, including short chain surfactants that help solubilize other surfactants. Other examples of hydrotropes include cumene, xylene, or toluene sulfonate, urea, $C_8$ or shorter chain alkyl carboxylates, and $C_8$ or shorter chain alkyl sulfate and ethoxylated sulfates.

Preferred Conditioning System Benefit Agents

The treating compositions of the present invention preferably comprise a conditioning system. The conditioning system preferably comprises one or more conditioning agents.

The conditioning system preferably has a pH, as determined in a 10% aqueous solution of the neat conditioning system, in the range of from about 2.5 to about 9, more preferably from about 3 to about 8, most preferably from about 3.5 to about 7.

The viscosity of the conditioning system is preferably from about 0.5 to about 10,000, more preferably from about 0.5 to about 1000, most preferably from about 1 to about 100 cps.

In addition to one or more conditioning agents, the conditioning system optionally, but preferably further comprises one or more of the following ingredients: perfumes; anti-microbial agents and antifungal agents that kill micro flora in the shoe such as bleaches or quaternary ammonium salts (e.g., didecyl dimethyl ammonium chloride); nonionic (preferred), anionic, cationic, ampholytic, zwitterionic surfactants and mixtures thereof; foot/shoe malodor reduction technologies such as zeolites, cyclodextrins, activated carbons and others; perfume delivery systems that delivers perfume in a sustained manner; cleaning technologies that clean the inside of shoe; organic solvents such as propylene glycol, butoxy propanol or butoxy propoxy propanol; and/or salts such as sodium sulfates.

Providing an antifungal benefit is very important in foot care. Non-limiting examples of antifungal agents include: components of benzalkonium chloride (lauryl dimethyl benzyl chloride, myristyl dimethyl benzyl chloride), N-octyl-isothiazolone, undecylenic acid alkyolamide sulfosuccinate, undecylenic acid monoethanolamide, and mixtures thereof.

Conditioning Agents—In order to achieve conditioning of shoe surfaces, especially leather-containing shoe surfaces, it is desirable to use one or more conditioning agents within the shoe treating process. The use of the conditioning agent(s) can independently occur prior to washing the shoes in an aqueous medium (pre-treatment) and/or during washing of the shoes in an aqueous medium, preferably during the wash cycle rather than the rinse cycle in automatic washing machines (automatic clothes washing machines) and/or after washing the shoes in an aqueous medium (post-treatment). Additionally, one or more conditioning agents can be applied to one or more "new" shoes in order to condition the shoes for preventative and/or comfort reasons, among others.

The conditioning agent(s) can be used independently of the other components, described herein, that may be within the treating composition of the present invention (i.e., Ca/Mg removal agents, surfactants, antibacterial agents, antifungal agents, etc.) or the conditioning agents can be combined with one or more other benefit agents described herein, such as cleaning agents and/or disinfecting agents, within a treating composition for use in the methods of the present invention. Preferably, one or more conditioning agents is present in the methods of the present invention concurrently with one or more Ca/Mg removal agents and/or surfactants.

The conditioning agents useful in the treating compositions of the present invention can be any conditioning agent that mitigates damage to the shoe surfaces, especially leather-containing shoe surfaces as a result of washing the shoes in an aqueous medium and/or restores the softness, suppleness and/or flexibility of the shoe surfaces, especially the leather-containing shoe surfaces after washing the shoes in an aqueous medium and/or mitigates damage to the shoe surfaces, especially the leather-containing shoe surfaces during washing of the shoes in an aqueous medium and/or maintains the softness, suppleness and/or flexibility of the shoe surfaces, especially the leather-containing shoe surfaces during washing of the shoes in an aqueous medium and/or improves the softness, suppleness and/or flexibility of the shoe surfaces, especially the leather-containing shoe surfaces during washing of the shoes in an aqueous medium.

Suitable conditioning agents useful in the methods and compositions of the present invention include, but are not limited to, acrylic syntans and other hydrophobically modified polymers, silicones, fluorocarbons, fatliquors, lecithin, fluoropolymers, sucrose polyesters, oils, waxes, quaternary ammonium salts and mixtures thereof. Preferably, the conditioning agents are selected from the group consisting of acrylic syntans and other hydrophobically modified polymers, silicones, fatliquors, lecithin, fluoropolymers, sucrose polyesters, oils, waxes, quaternary ammonium salts and mixtures thereof. More preferably, the conditioning agents are selected from the group consisting of acrylic syntans and other hydrophobically modified polymers, silicones and mixtures thereof. Most preferably, the conditioning agents are acrylic syntans.

Suitable hydrophobically modified polymers include, but are not limited to, partially esterified polyacrylate (acrylic syntan), glycoproteins and cellulose derivatives.

Preferred acrylic syntans have the following formula:

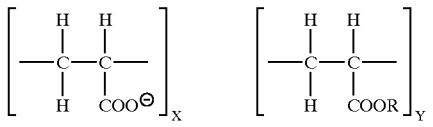

wherein R is independently $C_8$–$C_{20}$ alkyl, and X and Y are independent integers. Preferably, the X/Y ratio is from about 0.05 to about 100, more preferably from about 0.5 to about 50, most preferably from about 1 to about 20.

In addition to the above defined ratios for acrylic syntan compounds, proton NMR methodology can be used to evaluate other potential hydrophobically modified polymers. Wherein the ratio of "hydrophilic" protons (H's attached to C adjacent to O (approximately δ 3.0–4.1 ppm)) to "hydrophobic" protons (H's attached to C non-adjacent to O (approximately δ 0.5–2.0 ppm)) is from about 0.05 to about 100, more preferably from about 0.5 to about 50, most preferably from about 1 to about 20.

One of the main advantages of the acrylic syntans is that, they both soften and retan the leather. While not to be bound by the theory, we believe that the syntan polymer deposits and lubricates the leather fiber. This reduces the friction between the leather fiber and fibrills thus make the leather soft and supple. Besides softening, the polymer also stabilize the leather by fixing other tanning agents such as chromium.

Another advantage of the acrylic syntan compounds is to maintain and/or minimally disturb the water absorption properties of the leather portions of the shoes. This tends to reduce the moisture level inside the shoe and make the shoe more comfortable to wear.

Typical acrylic syntan compounds have both hydrophobic and hydrophilic characteristics. Commercially available acrylic syntans are available from Rohm & Haas Company of Philadelphia, Pa., under the tradenames LEUKOTAN® and LUBRITAN®, preferred acrylic syntans available from Rohm & Haas Company are LEUKOTAN® NS3 and LUBRITAN® AS, a highly preferred acrylic syntan available from Rohm & Haas Company is LUBRITAN® AS.

Oftentimes, the conditioning agents include organic solvents, such as butoxy propanol. For purposes of the present invention, the conditioning agents can contain organic solvents or be organic solvent-free.

Emulsifying agents can be added to stabilize the syntan dispersion solutions. Common anionic, cationic, nonionic, ampholytic and zwitterionic surfactants can all be used for this purpose.

Silicone compounds are well known for their lubrication capabilities. Either unmodified PDMS (PolyDiMethyl Siloxane) or organo-PDMS can be used for the present invention. Nonlimiting examples include GE CM2233, SM2658, or Dow Coming 51. Additionally, polyalkyleneoxide modified polydimethylsiloxane available under the tradename SILWET-7500 from Osi Specialties can also be used in the treating compositions of the present invention.

One potential limitation of the silicone compounds is that high levels of silicone also make the insole and outsole slippery. Maximum level of silicone treatment is about 3 g of the silicone active per shoe, preferably 2 g per shoe, most preferably 0.5 g per shoe.

Fatliquors are historically used in the tanning industry to soften the leather. They generally are vegetable, animal and marine fats or a blend of these. Often it is partially sulfated or sulfonated so that it can be dispersed evenly in an aqueous medium and penetrate leather effectively. Sometimes surfactants are added to emulsify the oil. Nonlimiting examples of the fatliquors are Chemol 45 and Chemol 130 by Chemtan Co.

Suitable fluorocarbon polymers include, but are not limited to, REPEARL ® F84. F89 and F3700 fluoropolymers from Mitsubishi International Corp.

Suitable quaternary ammonium compounds useful as conditioning agents include, but are not limited to, Ditallow Dimethyl Ammonium Chloride.

Commercial lecithins, or phospholipid compounds are used to soften and cure leathers. It also can be used as an emulsifying agent during the fatliquoring step to aid the penetration of fatliquor compounds. Nonlimiting examples of such materials are Centrolene A and Centrophase HR2B commercially available from Central Soya Company.

Suitable sucrose esters of fatty acids can be used as fat substitutes to lubricate the shoe surfaces, especially leather-containing shoe surfaces.

Preferred Form of Conditioning System

The conditioning system can be in the form of aerosol gas, liquid, powder, gel and/or tablet. Preferably, the conditioning system is a liquid. The conditioning system can be applied to one or more shoes either in association with the cleaner or separately by itself.

Preferred Means of Delivering Conditioning System

Contrary to regular laundry practices for most fabrics, we found the conditioning agents for shoes are best delivered in the wash cycle, not the rinse cycle. While not to be bound by the theory, it is believed that this is because the wash cycle typically provides longer agitation time which help drive the conditioning agents into the leather. In addition, since water can serve as a carrier of the conditioning agents, the conditioning agents can penetrate more effectively when the leather is still dry when exposed to the conditioning agents.

Conditioning agents can be applied either as part of the cleaner (2 in 1) or added separately. When applied separately, the conditioning agents can be added as a pre-treat composition which is applied to one or more surfaces of a shoe, either inside or outside the shoe, preferably to an inside surface of the shoe, prior to washing. Further, one or more conditioning agents may be applied to one or more surfaces of a shoe via a wash solution ("Through the Wash") containing the conditioning agents. Further yet, one or more conditioning agents may be applied to one or more surfaces of a shoe after washing the shoe (post-treat).

Preferred 2-In-1 System Benefit Agents

It is highly desirable that cleaning and conditioning of the shoes both occur during the treatment of the shoes. It is envisioned that this may be done through a variety of means within the scope of this patent.

If treatment of the shoes consists of several aqueous washing steps (that is the water from a first treating cycle is removed after the first treatment and is then followed by additional treating and/or rinsing steps, it has been surprisingly found that the best conditioning of the shoes occurs if the conditioning agent or treatment is added during that first cycle as opposed to the second or later cycles. Moreover, the best conditioning occurs if the one or more conditioning agents are added directly into the interior of the shoe.

Similarly, better cleaning of the outside of the shoe is achieved when one or more cleaning agents are applied directly to the outside of the shoe. While the one or more cleaning agents may be added to either the first cycle or subsequent cycles, it generally preferred that the cleaning agents be applied or used during the first cycle. This allows for better rinsing of the components of the treatment which often is desirable for the user of the product.

Therefore a preferred embodiment of this invention is separately or jointly adding one or more conditioning agents and one or more cleaning agents during the first cycle. An even more preferred embodiment for the addition of both the conditioning agents and the cleaning agents is the direct application of either the one or more conditioning agents to the inside of the shoe and/or direct application of the one or more cleaning agents to the outside of the shoe. A most preferred embodiment is the direct application of the one or more conditioning agents to the inside of the shoe and the direct application of the one or more cleaning agents to the outside of the shoe.

Alternatively, the object of achieving both a conditioning benefit and a cleaning benefit may be achieved by formulation of a single product, a "2-in-1" product or "2-in-1" treating system containing both conditioning agents and cleaning agents that are present in the treating system such that both cleaning and conditioning benefits are satisfactorily achieved. A preferred embodiment of the combination conditioning and cleaning agents is the addition in the first cycle of the wash process. A more preferred embodiment is the direct application of the cleaning and conditioning agents to the shoe wherein the addition occurs either on the inside or on the outside of the shoe or most preferably on both the inside and the outside of the shoe.

Preferably, the pH of the 2-in-1 system, as determined in a 10% aqueous solution of the neat 2-in-1 system, is in the range of from about 3 to about 10, more preferably from about 6 to about 9, most preferably from about 7 to about 9.

Preferred Form of 2-In-1 System

In general the most preferred form of the 2-in-1 system of the present invention is gel and/or paste, with liquid less preferred and granules least preferred. Gels and paste can be applied directly to the shoe surface(s) and thus give better performance. Liquid treating compositions can also be applied directly to the shoe but because of their lower viscosity, they often will flow off the shoe prior to placement of the shoe in the wash which may be messy and inconvenient for the user. Similarly, the liquid treating compositions will be quickly washed off in the wash thus causing the benefits of direct addition to be diminished. Granular treating compositions are difficult to pre-treat with and as such are least preferred.

The performance of the gel, liquid and/or paste can be highly dependent on both its viscosity and its dissolution rate or profile. The liquid paste or gel should have a viscosity sufficiently high such that it is easy to apply in bulk to the shoe. If the viscosity is too low, the treatment may substantially simply drain off the shoe prior to washing. If this occurs, then the benefits from pretreatment may be substantially lost. Moreover the treatment of the outside of the shoe with a low viscosity treating solution can be messy and thus substantially inconvenient to the user.

It is desirable that one skilled in the art will formulate the 2-in-1 system such that the viscosity of the 2-in-1 system will provide optimal cleaning to the exterior surfaces of the shoe without significantly inhibiting conditioning of the interior surfaces of the shoe, and optimal conditioning to the insides of the shoe without significantly inhibiting cleaning of the exterior surfaces of the shoe. More desirably, the 2-in-1 system will be formulated such that optimal cleaning and conditioning benefits achievable from the system are achieved.

If the viscosity is too high, the treatment may not be able to penetrate the fabric and/or leather portions of the shoe quickly enough to have the desired treatment benefit on those surfaces. In addition, many highly viscous solutions are difficult to dissolve or disperse quickly. Poor or incomplete dissolution or dispersion is highly undesirable as the residual largely undissolved treatment is aesthetically unpleasing to the consumer and would in many case be uncomfortable to wear.

Similarly, it is desirable that the dissolution and/or dispersion properties of the 2-in-1 system be such that substantially all of the cleaning agents within the 2-in-1 system are dissolved prior to the end of the treating cycles. More preferably, it is desired that substantially all of the cleaning agents be dispersed prior to the end of the treating cycle in which it was added.

Gel

An example of a suitable gel for the 2-in-1 system of the present invention comprises, by weight of the system:

a) from about 8% to about 20% of a nonionic surfactant system such as NEODOL® 23-9 available from Shell Chemical Company or an anionic surfactant system such as NEODOX® 25-6 available from HicksonDan Chem. and mixtures thereof;

b) from about 30% to about 50% of a sodium salt of polyacrylic acid such as Acusol 445N (available from Rohm & Haas as a 45% active solution); and c) from about 1% to about 50% of a conditioning agent such as (LUBRITAN® AS (available from Rohm & Haas).

Another example of a suitable gel for the 2-in-1 system of the present invention comprises, by weight of the system:

a) from about 8% to about 20% of a nonionic surfactant system such as NEODOL® 23-9 available from Shell Chemical Company or an anionic surfactant system such as NEODOX® 25-6 available from HicksonDan Chem, and mixtures thereof;

b) from about 30% to about 50% of an acrylic acid/maleic acid copolymer available under the tradename SOKALAN® CP-5 from BASF; and c) from about 1% to about 50% of a conditioning agent such as (LUBRITAN® AS (available from Rohm & Haas).

A further example of a suitable gel for the 2-in-1 system of the present invention comprises, by weight of the composition:

a) from about 15% to about 40% of an anionic surfactant system which comprises, by weight of the composition:
   (i) from about 5% to about 25% of alkyl polyethoxylate sulfates wherein the alkyl group contains from about 10 to about 22 carbon atoms and the polyethoxylate chain contains from 0.5 to about 15, preferably from 0.5 to about 5, more preferably from 0.5 to about 4, ethylene oxide moieties; and
   (ii) from about 5% to about 20% of fatty acids;

b) one or more of the following ingredients: detersive amine, modified polyamine, polyamide-polyamine, polyethoxylated-polyamine polymers, quaternary ammonium surfactants, suitable electrolyte or acid equivalents thereof, and mixtures thereof; and c) from about 1% to about 50% of a conditioning agent such as (LUBRITAN® AS (available from Rohm & Haas).

Preferred Disinfecting System Benefit Agents

The treating compositions of the present invention may and preferably do comprise a disinfecting system. The disinfecting system preferably comprises one or more disinfecting agents.

The importance of microbial growth in shoes and its relationship to the health of the foot is well known as evidenced by the large number of commercially available products (both OTC and Rx) used to treat infections, reduce foot and shoe odor and indeed to disinfect shoes. However, no matter how effective, the washing of the shoe is, it is unlikely to remove all of the microbial population from the shoe.

Therefore it is highly desirable that the treating composition not only cleans and/or conditions the shoe but also sanitizes and/or disinfects it. The terms "sanitize" or "disinfect" are commonly used to describe the degree to which a composition kills or otherwise eliminates microbes. Usually, the term disinfect is taken to mean the total or near total elimination of the microbes being measured. The term "sanitize" is usually taken to mean a lesser degree of elimination than the term "disinfect" is taken to mean. The degree to which the elimination occurs can usually be controlled through selection and level of active(s) used by one skilled in the art.

The desired disinfection or sanitization may be achieved in several ways within the context of this invention.

The treating compositions of the present invention may be formulated with one or more disinfecting agents. The concentration of disinfecting agents in the treating compositions of the present invention may be chosen at a level such that disinfection is obtained via direct application of the treating compositions to the shoe. Similarly a higher level of disinfecting agents may be used so as to provide a sufficient amount of disinfecting agents upon dilution of the treating composition in a wash solution used to wash the shoes.

Similarly, in treating systems that comprise cleaning compositions and conditioning compositions which are physically and chemically separate, both compositions may have disinfecting agents which can be applied either by direct application or through the wash solution or both. This approach has the advantage of sanitizing a greater proportion of the shoe (if the cleaning composition is added to the outside and the conditioning composition is added to the inside). Similarly, if through the wash disinfection (dilute disinfection) is desired, then the level of disinfecting agents present in each composition is reduced if disinfecting agents are added to both products. Reducing the required level of disinfecting agents in either composition is a useful formulation approach.

Suitable disinfecting agents may be chosen from a broad range of known disinfecting agents. The technical field of disinfection and sanitization is reviewed and discussed in depth in *Principles and Practice of Disinfection, Preservation and Sterilization, Third Edition*, 1999, Edited by A. D. Russell, W. B. Hugo, and G. A. J. Ayliffe, published by Blackwell Science Ltd. The field is similarly discussed and reviewed in "*Disinfection, sterilization, and preservation, Fourth Edition.* ", 1991, Edited by Seymour S. Block, published by Lea and Febiger.

Appropriate disinfecting agents may be selected from either or both of the above references which are incorporated herein by reference. Possible disinfecting agents could include but would not be limited to surface active agents (such as quaternary ammonium antimicrobial compounds, anionic surfactants, nonionic surfactants, amphoteric surfactants, and betaines), halogen bleaches such as hypochlorite, hypobromite, and the like, although not preferred for use in the treating compositions of the present invention; peroxygen bleaches such as hydrogen peroxide and peracids and their salts (as described herein); antimicrobial amphoteric compounds; organic and inorganic acids along with their esters and salts; aromatic diamidines; biguanides, such as chlorhexidene and related compounds; aldehydes; alcohols and phenols; Nitrogen containing compounds described in Block or references cited therein; the polymeric disinfectants such as polyhexamethylene biguanide hydrochloride also described in Block and the references contained therein; chelating agents, such as EDTA; perfumes and essential oils; etc.

Particularly preferred disinfecting agents include, but are not limited to, organic acids, preferably fatty acids, more preferably $C_8$–$C_{10}$ fatty acids (i.e., octanoic acid, nonanoic acid, and/or decanoic acid), preferably $C_9$ and/or $C_{10}$ fatty acids. Such organic acids, when present, are preferably present in the treating compositions, such as in a standalone disinfecting system or the cleaning and/or conditioning system, especially in the conditioning system of the present invention at levels of 1% by weight or greater, more preferably 2% by weight or greater. Nonanoic acid is commercially available from Celanese, Aldrich and/or Fluka. Decanoic acid is commercially available from Aldrich and/or Fluka. It is preferred that the neat pH of fatty acid disinfecting agents be less than about 5.5, more preferably less than about 5, and most preferably less than about 4.5.

Nonlimiting examples of quaternary compounds useful as disinfecting agents in the treating compositions of the present invention include (1) benzalkonium chlorides and/or substituted benzalkonium chlorides such as commercially available BARQUAT® (available from Lonza), MAQUAT® (available from Mason), VARIWUAT® (available from Witco/Sherex), and HYAMINE® (available from Lonza); (2) dialkyl quaternary such as BARDAC® products from Lonza; (3) N-(3-chloroallyl) hexaminium chlorides such as DOWICIDE® and DOWICIL® available from Dow; (4) benzethonium chloride such as HYAMINE® 1622 from Rohm and Haas; (5) methylbenzethonium chloride represented by HYAMINE® 10× supplied by Rohm and Haas; (6) cetylpyridinium chloride such as CEPACOL chloride available from Merrell Labs.

A suitable commercially available disinfecting agent is N,N-didecyl-N,N-dimethylammonium chloride available from Lonza under the tradename BARDAC® 2250.

Photodisinfectants, examples of which are described in U.S. Pat. No. 5,679,661, may also be used as disinfecting agents in the treating compositions of the present invention.

The compounds can be selected so as to provide both an antibacterial benefit against such common microbes as Gram negative bacteria, Gram Positive bacteria, fungi, viruses, and other microbes.

Other Preferred Benefit Agents

Release (Soil Release) Agents—The treating compositions according to the present invention, especially those that are applied to the exterior and/or interior surfaces of the shoes, may comprise one or more release agents, especially soil release agents or as they are oftentimes referred to in the art "waterproofing agents".

If waterproofing agents are used in the treating compositions of the present invention, it is preferable that such treating compositions be applied to the exterior surfaces of the shoes rather than the interior surfaces of the shoes so as to not significantly inhibit the desired water absorption properties of the interior surfaces of the shoes while protecting the exterior surfaces of the shoes.

If utilized, soil release agents will generally comprise from about 0.01%, preferably from about 0.1%, more preferably from about 0.2% to about 10%, preferably to about 5%, more preferably to about 3% by weight, of the composition. However, the treating compositions of the present invention, in certain embodiments, such as post-treat compositions, can comprise concentrated levels of release agents, such as in the amount of from about 50% to about 100%, more preferably from about 80% to about 95% , even more preferably from about 90% to about 95% by weight of the composition.

Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

Additionally, further examples of suitable soil release agents and their application are discussed in detail in the following references:

"Powdered Detergents", edited by Michael S. Showell, Chapter 7 by Eugene P. Gosselink entitled "Soil Release Agents in Powdered Detergents", 1998, Marcel Dekker (New York) and references therein.

Kirk Othmer Encyclopedia of Chemical Technology, 4$^{th}$ Edition, vol. 21, Chapter on Release Agents, page 207 and references cited therein.

Kirk Othmer Encyclopedia of Chemical Technology, 4$^{th}$ Edition, vol. 25, Chapter on waterproofing and water/oil repellency, page 595 and references cited therein.

Encyclopedia of polymer science and engineering, Mark, H. F.; Kroschwitz, Jacqueline I., 2nd ed. New York: Wiley, 1985 and references cited therein.

One release agent suitable for use in the post-treat treating compositions of the present invention, include, but are not limited to, Glyceryl tristearate, Oxystearin, Castor oil, salts of an oxyacid of phosphorous, White mineral oil, Petrolatum, Hydrogenated sperm oil, Mineral oil, Mannitol, Calcium stearate, Magnesium carbonate, Magnesium oxide, Magnesium stearate, Mono- and diglycerides, Monosodium phosphate derivatives of mono- and diglycerides, Sorbitol, and Carnauba wax. More preferably, the release agent is White mineral oil. White mineral oil is commercially available from J. T. Baker.

Another example of a suitable release agent is phospholipids, such as lecithin. The term lecithin can be used to describe both the pure phosphatidyl choline and mixtures of the phosphatidyl choline with other phospholipids, triglycerides, etc. However, aqueous dispersions of lecithin preferably have a buffer to maintain a near neutral pH. This reduces the extent or likelihood of hydrolysis of the lecithins which could result in a loss of efficacy. Compositions with lecithin that are exposed to air preferably contain an antioxidant to reduce the potential degradation of the lecithin. Aqueous dispersions of lecithin will require the presence of an antimicrobial preservative.

Some preferred release agents especially suitable for use in the post-treat treating compositions are the water soluble modified celluloses including, but not limited to: carboxymethylcellulose, hydroxypropylcellulose, methylcellulose, and like compounds.

Protease Enzymes

The treating compositions according to the present invention may comprise at least 0.001% by weight, of a protease enzyme. However, an effective amount of protease enzyme is sufficient for use in the treating compositions described herein. The term "an effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the treating composition. Stated otherwise, the compositions herein will typically comprise from 0.001% to 5%, preferably 0.01% to 1% by weight of a commercial enzyme preparation. The protease enzymes of the present invention are usually present in such commercial preparations at levels sufficient to provide from 0.005 to 0.1 Anson units (AU) of activity per gram of composition.

Preferred treating compositions of the present invention comprise modified protease enzymes derived from *Bacillus amyloliquefaciens, Bacillus lentus, Bacillus licheniformis, Bacillus alcalophilus* and mixtures thereof, more preferably from *Bacillus amyloliquefaciens, Bacillus lentus* and mixtures thereof. For the purposes of the present invention, protease enzymes derived from *B. amyloliquefaciens* are further referred to as "subtilisin BPN'" also referred to as "Protease A" and protease enzymes derived from *B. Lentus* are further referred to as "subtilisin 309". For the purposes of the present invention, the numbering of *Bacillus amyloliquefaciens* subtilisin, as described in the U.S. Pat. No. 5,679,630 to A. Baeck, et al, entitled "Protease-Containing Cleaning Compositions", serves as the amino acid sequence numbering system for both subtilisin BPN' and subtilisin 309.

Nonlimiting examples of suitable protease enzymes and/or variants thereof that can be used in the treating compositions of the present invention include the following: Protease A (EP 130,756 A); Protease B (EP 303,761 A and EP 130,756 A); Protease C (WO 91/06637); Protease D (WO 95/10615 and U.S. Pat. No. 5,679,630). A particularly preferred variant of Protease D is the variant in which the aspartic acid replaced asparagine at position 76, alanine replaced serine at position 103 and isoleucine replaced valine at position 104.

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Publication Nos. WO 99/20727, WO 99/20726. WO 99/20770 and WO 99/20769 to The Procter & Gamble Company and Genencor International, Inc., and PCT Publication No. WO 99/20723 to The Procter & Gamble Company.

The most preferred protease variants of this type include substitution sets 101/103/104/159/232/236/245/248/252, most preferably 101G/103A/104I/159D/232V/236H/245R/248D/252K. A highly preferred protease variant of this type is the variant in which the serine is replaced by glycine at position 101, the serine is replaced by alanine at position 103, the valine is replaced by isoleucine at position 104, the glycine is replaced by aspartic acid at position 159, the alanine is replaced by valine at position 232, the glutamine is replaced by histidine at position 236, the glutamine is replaced by arginine at position 245, the asparagine is replaced by aspartic acid at position 248 and the asparagine is replaced by lysine at position 252.

Other suitable protease enzymes and/or variants thereof are described in WO 95/29979, WO 95/30010 and WO 95/30011, all of which were published Nov. 9, 1995, all of which are incorporated herein by reference.

Additional suitable protease enzymes and/or variants include those described in EP 251 446 and WO 91/06637; protease BLAP® described in WO91/02792 and their variants described in WO 95/23221; high pH proteases from Bacillus sp. NCIMB 40338 described in WO 93/18140; WO 92/03529; WO 95/07791; WO 94/25583 and EP 516 200.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

In addition to the above-described protease enzymes, other optional enzymes suitable for use in the treating compositions of the present invention are further described herein below.

Enzyme Stabilizers—Enzymes for use in the treating compositions of the present invention can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

Odor Control Agents—The treating compositions of the present invention may contain conventional odor control agents and/or technologies such as zeolites, cylcodextrins (examples of which are described in U.S. Pat. No. 5,939,060), amines, polyamines. imines, especially polyethyleneimines and other imine-containing polymers (examples of which are described in U.S. Pat. Nos. 5,565,145 and 4,597,898, and PCT Patent Publication WO 98/12296 and PCT International Patent Application Nos. PCT/US99/20812 and PCT/US99/20624 both filed on Sep. 9, 1999), and/or activated carbons whose purpose is to mitigate foot/shoe malodor as a result of a consumer wearing the shoes.

Additional nonlimiting examples of odor controlling agents are described in U.S. Pat. No. 4,589,994 and include phenolic compounds that are effective at substantially reduce or eliminate odor causing bacteria, such as phenol, m-cresol, o-cresol, p-cresol, o-phenyl-phenol, 4-chloro-m-cresol, chloroxylenol, 6-n-amyl-m-cresol, resorcinol, resorcinol monoacetate, p-tert-butyl-phenol and o-benzyl-p-chlorophenol. The biologically-active water soluble salts of these compounds may also be employed, e.g., alkali metal salts.

Other examples of odor control agents and/or technologies include those described in Kirk Othmer Encyclopedia of Chemical Technology, Second Edition, Volume 14, pages 170–178); PPM (1990), 21(11), 2–21; Recents Prog. Genie Prodedes (1996), 10(47) pp. 153–159; Odor VOC Control Handbook (1998), 8.2–8.24 and 8.92–8.101; Chem. Chron, Genike Ekdose (1999), 61(1), 14–18; Chem. Ind. (London) (1974), (21), 853–856; Akushu no Kenkyu (1976), 5(24), 34–37; Kemikaru Enjiniyaringu (1978), 23(12), 1052–1058; Biodegradation (1998), 9(34), 273–284; Proc., Annu. Meet.—Air Waste Management Association (1998), 91st RP95B02/1-RP95B02/6; Proc., Annu. Meet.—Air Waste Management Association (1997), 90th FA15901/1-FA15901/14; Proc.—WEFTEC '96, Annual Conference Expo., 69th (1996), 6 306–316; Proc. Annu. Conf.—West. Can. Water Wastewater Assoc. (1995), 47th Paper No. 5, 10 pp.; Proc.—Annu. Purdue Air Quality Conference, 12th (1973), Meeting Date 1973, 238–261; and references cited therein.

Additional examples of odor control agents and/or technologies include those described in U.S. Pat. Nos. 4,322,308, 5,932,495, 5,916,448, 5,869,027, 5,866,112, 5,833,972, 5,413,827, 3,860,520 and 5,197,208.

Further examples of odor control agents useful in the treating compositions of the present invention include, but are not limited to, highly alkaline water preferably having a pH of 9 or more, more preferably 10 or more, most preferably 10.5 or more; bicarbonate and other basic buffers.

Perfume

The treating compositions of the present invention can comprise perfume to provide a "scent signal" in the form of a pleasant odor which provides a freshness impression to the treated shoes. The scent signal can be designed to provide a fleeting perfume scent. When perfume is added as a fleeting scent signal, it is added only at very low levels, e.g. from about 0.001% to about 0.5%, preferably from about 0.01% to about 0.3%, by weight of the treating composition.

Perfume can also be added as a more intense odor in product and on shoes. When stronger levels of perfume are preferred, relatively higher levels of perfume can be added, e.g., from about 0.1% to about 3%, preferably from about 0.2% to about 2%, and more preferably from about 0.3% to about 1%, by weight of the treating composition. Any type of perfume can be incorporated into the composition of the present invention. Nonlimiting examples of such perfume ingredients include aromatic and aliphatic esters, aliphatic and aromatic alcohols, aliphatic ketones, aromatic ketones, aliphatic lactones, aliphatic aldehydes, aromatic aldehydes, condensation products of aldehydes and amines, saturated alcohols, saturated esters, saturated aromatic ketones, saturated lactones, saturated nitrites, saturated ethers, saturated acetals, saturated phenols, saturated hydrocarbons, aromatic nitromusks and mixtures thereof, as more fully described in U.S. Pat. No. 5,939,060 and Canadian Patent No. 1,325,601. Other perfume ingredients are described in U.S. Pat. Nos. 5,744,435 and 5,721,202.

Terpene oils can also be included into the treating compositions of the present invention as perfume ingredients. Nonlimiting examples of suitable terpene oils are described in U.S. Pat. No. 4,598,994 and include anise, cinnamon, clove, coriander, eucalyptus, fennel, lavender, lemon, orange, orange flower, perppermint, pine, spearmint and compound bouquets thereof.

It is preferable that at least about 25%, preferably at least about 40%, more preferably at least about 60%, and even more preferably at least about 75%, by weight of the perfume is composed of substantive perfume ingredients. These substantive perfume ingredients are characterized by their boiling points (B.P.) and their ClogP value. The substantive perfume ingredients of this invention have a B.P, measured at the normal, standard pressure of 760 mm Hg, of about 240° C. or higher, preferably of about 250° C. or higher, and a ClogP of about 2.7 or higher, preferably of about 2.9 or higher, and more preferably of about 3.0 or higher.

The boiling points of many perfume ingredients are given in, e.g., "Perfume and Flavor Chemicals (Aroma Chemicals)," Steffen Arctander, published by the author, 1969, incorporated herein by reference. Other boiling point values can be obtained from different chemistry handbooks and data bases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30–36. The boiling point values can also be estimated via a computer program that is described in "Development of a Quantitative Structure—Property Relationship Model for Estimating Normal Boiling Points of Small Multifunctional Organic Molecules", David T. Stanton, Journal of Chemical Information and Computer Sciences, Vol. 40, No. 1, 2000, pp. 81–90. The properties of substantive and non-substantive perfume ingredients are disclosed with more details in U.S. Pat. No. 5,500,138, issued Mar. 19, 1996 to Bacon and Trinh, incorporated herein by reference.

Thus, when a perfume composition which is composed of substantive perfume ingredients having a B. P. of about 250° C. or higher, and a ClogP of about 3.0 or higher, they are very effectively deposited on shoes, and remain substantive on shoes after the washing, rinsing and drying steps.

Non-limitting examples of the preferred substantive perfume ingredients of the present invention include: allyl cyclohexane propionate, ambrettolide, amyl benzoate, amyl cinnamate, amyl cinnamic aldehyde, amyl cinnamic aldehyde dimethyl acetal, iso-amyl salicylate, aurantiol (trade name for hydroxycitronellal-methyl anthranilate), benzophenone, benzyl salicylate, iso-butyl quinoline, beta-caryophyllene, cadinene, cedrol, cedryl acetate, cedryl formate, cinnamyl cinnamate, cyclohexyl salicylate, cyclamen aldehyde, dihydro isojasmonate, diphenyl methane, diphenyl oxide, dodecalactone, iso E super (trade name for 1-(1,2,3,4,5,6,7,8-octahydro-2,3,8,8-tetramethyl-2-naphthalenyl)-ethanone), ethylene brassylate, ethyl methyl phenyl glycidate, ethyl undecylenate, iso-eugenol, exaltolide (trade name for 15-hydroxypentadecanoic acid, lactone), galaxolide (trade name for 1,3,4,6,7,8-hexahydro-4,6,6,7,8,8-hexamethylcyclopenta-gamma-2-benzopyran), geranyl anthranilate, hexadecanolide, hexenyl salicylate, hexyl cinnamic aldehyde, hexyl salicylate, lilial (trade name for para-tertiary-butyl-alpha-methyl hydrocinnamic aldehyde), linalyl benzoate, 2-methoxy naphthalene, methyl cinnamate, methyl dihydrojasmonate, beta-methyl naphthyl ketone, musk indanone, musk ketone, musk tibetine, myristicin, delta-nonalactone, oxahexadecanolide-10, oxahexadecanolide-11, patchouli alcohol, phantolide (trade name for 5-acetyl-1,1,2,3,3,6-hexamethylindan), phenyl ethyl benzoate, phenylethylphenylacetate, phenyl heptanol, phenyl hexanol, alpha-santalol, thibetolide (trade name for 15-hydroxypentadecanoic acid, lactone), delta-undecalactone, gamma-undecalactone, vetiveryl acetate, yara-yara, and mixtures thereof. Other subtanstive perfume ingredients useful in the present invention include methyl-N-methyl anthranilate, benzyl butyrate, benzyl iso valerate, citronellyl Isobutyrate, citronellyl propionate, delta-nonalactone, dimethyl benzyl carbinyl acetate, dodecanal, geranyl acetate, geranyl isobutyrate, gamma-ionone, para-isopropyl phenylacetaldehyde, cis-jasmone, methyl eugenol, tonalid, and mixtures thereof.

The preferred perfume compositions used in the present invention contain at least 4 different substantive perfume ingredients, preferably at least 5 substantive perfume ingredients, more preferably at least 6 different substantive perfume ingredients, and even more preferably at least 7 different substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. These materials are not counted in the formulation of the substantive perfume compositions of the present invention.

Sustained Perfume Release Agents

Pro-Fragrances, Pro-Perfumes, and Pro-Accords

The compositions of the present invention may also comprise a fragrance delivery system comprising one or more pro-fragrances, pro-perfumes, pro-accords, and mixtures thereof hereinafter known collectively as "pro-fragrances". The pro-fragrances of the present invention can exhibit varying release rates depending upon the pro-fragrance chosen. In addition, the pro-fragrances of the present invention can be admixed with the fragrance raw materials which are released therefrom to present the user with an initial fragrance, scent, accord, or bouquet.

The pro-fragrances of the present invention can be suitably admixed with any carrier provided the carrier does not catalyze or in other way promote the pre-mature release form the pro-fragrance of the fragrance raw materials.

The following are non-limiting classes of pro-fragrances according to the present invention.

Esters and polyesters—The esters and polyester pro-fragrances of the present invention are capable of releasing one or more fragrance raw material alcohols. Preferred are esters having the formula:

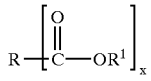

wherein R is substituted or unsubstituted $C_1$–$C_{30}$ alkylene, $C_2$–$C_{30}$ alkenylene, $C_6$–$C_{30}$ arylene, and mixtures thereof; —$OR^1$ is derived from a fragrance raw material alcohol having the formula $HOR^1$, or alternatively, in the case wherein the index x is greater than 1, $R^1$ is hydrogen thereby rendering at least one moiety a carboxylic acid, —$CO_2H$ unit, rather than an ester unit; the index x is 1 or greater. Non-limiting examples of preferred polyester pro-fragrances include digeranyl succinate, dicitronellyl succinate, digeranyl adipate, dicitronellyl adipate, and the like.

Beta-Ketoesters—The β-ketoesters of the present invention are capable of releasing one or more fragrance raw materials. Preferred β-ketoesters according to the present invention have the formula:

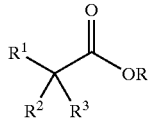

wherein —OR derives from a fragrance raw material alcohol; $R^1$, $R^2$, and $R^3$ are each independently hydrogen, $C_1$–$C_{30}$ alkyl, $C_2$–$C_{30}$ alkenyl, $C_1$–$C_{30}$ cycloalkyl, $C_2$–$C_{30}$ alkynyl, $C_6$–$C_{30}$ aryl, $C_7$–$C_{30}$ alkylenearyl, $C_3$–$C_{30}$ alkyleneoxyalkyl, and mixtures thereof, provided at least one $R^1$, $R^2$, or $R^3$ is a unit having the formula:

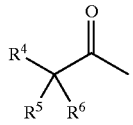

wherein $R^4$, $R^5$, and $R^6$ are each independently hydrogen, $C_1$–$C_{30}$ alkyl, $C_2$–$C_{30}$ alkenyl, $C_1$–$C_{30}$ cycloalkyl, $C_1$–$C_{30}$ alkoxy, $C_6$–$C_{30}$ aryl, $C_7$–$C_{30}$ alkylenearyl, $C_3$–$C_{30}$ alkyleneoxyalkyl, and mixtures thereof, or $R^4$, $R^5$, and $R^6$ can be taken together to form a $C_3$–$C_8$ aromatic or non-aromatic, heterocyclic or non-heterocyclic ring.

Non-limiting examples of β-ketoesters according to the present invention include 2,6-dimethyl-7-octen-2-yl 3-(4-methoxyphenyl)-3-oxo-propionate; 3,7-dimethyl-1,6-octadien-3-yl 3-(nonanyl)-3-oxo-propionate; 9-decen-1-yl 3-(β-naphthyl)-3-oxo-propionate; (α,α-4-trimethyl-3-cyclohexenyl)methyl 3-(β-naphthyl)-3-oxo-propionate; 3,7-dimethyl-1,6-octadien-3-yl 3-(4-methoxyphenyl)-3-oxo-propionate; 2,6-dimethyl-7-octen-2-yl 3-(β-naphthyl)-3-oxo-propionate; 2,6-dimethyl-7-octen-2-yl 3-(4-nitrophenyl)-3-oxo-propionate; 2,6-dimethyl-7-octen-2-yl 3-(4-methoxyphenyl)-3-oxo-propionate; 3,7-dimethyl-1,6-octadien-3-yl 3-(α-naphthyl)-3-oxo-propionate; cis 3-hexen-1-yl 3-(β-naphthyl)-3-oxo-propionate; 2,6-dimethyl-7-octen-2-yl 3-(nonanyl)-3-oxo-propionate; 2,6-dimethyl-7-octen-2-yl 3-oxo-butyrate; 3,7-dimethyl-1,6-octadien-3-yl 3-oxo-butyrate; 2,6-dimethyl-7-octen-2-yl 3-(β-naphthyl)-3-oxo-2-methylpropionate; 3,7-dimethyl-1,6-octadien-3-yl 3-(β-naphthyl)-3-oxo-2-methylpropionate; 3,7-dimethyl-1,6-octadien-3-yl 3-(β-naphthyl)-3-oxo-2-methylpropionate; 3,7-dimethyl-2,6-octadienyl 3-(β-naphthyl)-3-oxo-propionate; 3,7-dimethyl-2,6-octadienyl 3-heptyl-3-oxo-propionate.

Acetals and Ketals—Another class of compound useful as pro-accords according to the present invention are acetals and ketals having the formula:

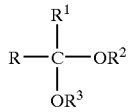

wherein hydrolysis of the acetal or ketal releases one equivalent of aldehyde or ketone and two equivalents of alcohol according to the following scheme:

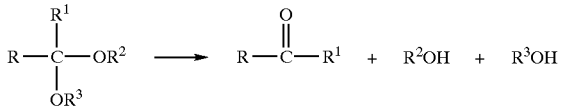

wherein R is $C_1$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, preferably the moieties which substitute the aryl units are alkyl moieties, and mixtures thereof. $R^1$ is hydrogen, R, or in the case wherein the pro-accord is a ketal, R and $R^1$ can be taken together to form a ring. $R^2$ and $R^3$ are independently selected from the group consisting of $C_5$–$C_{20}$ linear, branched, or substituted alkyl; $C_4$–$C_{20}$ linear, branched, or substituted alkenyl; $C_5$–$C_{20}$ substituted or unsubstituted cyclic alkyl; $C_5$–$C_{20}$ substituted or unsubstituted aryl, $C_2$–$C_{40}$ substituted or unsubstituted alkyleneoxy; $C_3$–$C_{40}$ substituted or unsubstituted alkyleneoxyalkyl; $C_6$–$C_{40}$ substituted or unsubstituted alkylenearyl; $C_6$–$C_{32}$ substituted or unsubstituted aryloxy; $C_6$–$C_{40}$ substituted or unsubstituted alkyleneoxyaryl; $C_6$–$C_{40}$ oxyalkylenearyl; and mixtures thereof.

Non-limiting examples of aldehydes which are releasable by the acetals of the present invention include 4-(4-hydroxy-4-methylpentyl)-3-cyclohexene-1-carboxaldehyde (lyral), phenylacetaldehyde, methylnonyl acetaldehyde, 2-phenylpropan-1-al (hydrotropaldehyde), 3-phenylprop-2-en-1-al (cinnamaldehyde), 3-phenyl-2-pentylprop-2-en-1-al (a-amylcinnamaldehyde), 3-phenyl-2-hexylprop-2-enal (a-hexylcinnamaldehyde), 3-(4-isopropylphenyl)-2-methylpropan-1-al (cyclamen aldehyde), 3-(4-ethylphenyl)-2,2dimethylpropan-1-al (floralozone), 3-(4-tert-butylphenyl)-2-methylpropanal, 3-(3,4-methylenedioxyphenyl)-2-methylpropan-1-al (helional), 3-(4-ethylphenyl)-2,2-dimethylpropanal, 3-(3-isopropylphenyl)butan-1-al (florhydral), 2,6-dimethylhep-5-en-1-al (melonal), n-decanal, n-undecanal, n-dodecanal, 3,7-dimethyl-2,6-octadien-1-al (citral), 4-methoxybenzaldehyde (anisaldehyde), 3-methoxy-4-hydroxybenzaldehyde (vanillin), 3-ethoxy-4-hydroxybenzaldehyde (ethyl vanillin), 3,4-methylenedioxybenzaldehyde (heliotropin), 3,4-dimethoxybenzaldehyde.

Non-limiting examples of ketones which are releasable by the ketals of the present invention include α-damascone, β-damascone, δ-damascone, β-damascenone, muscone, 6,7-dihydro-1,1,2,3,3-pentamethyl-4(5H)-indanone (cashmeran), cis-jasmone, dihydrojasmone, α-ionone, β-ionone, dihydro-β-ionone, γ-methyl ionone, α-iso-methyl ionone, 4-(3,4-methylenedioxyphenyl)butan-2-one, 4-(4-hydroxyphenyl)butan-2-one, methyl β-naphthyl ketone, methyl cedryl ketone, 6-acetyl-1,1,2,4,4,7-hexamethyltetralin (tonalid), l-carvone, 5-cyclohexadecen-1-one, acetophenone, decatone, 2-[2-(4-methyl-3-cyclohexenyl-1-yl)propyl]cyclopentan-2-one, 2-sec-butylcyclohexanone, β-dihydro ionone, allyl ionone, α-irone, α-cetone, α-irisone, acetanisole, geranyl acetone, 1-(2-methyl-5-isopropyl-2-cyclohexenyl)-1-propanone, acetyl diisoamylene, methyl cyclocitrone, 4-t-pentyl cyclohexanone, p-t-butylcyclohexanone, o-t-butylcyclohexanone, ethyl amyl ketone, ethyl pentyl ketone, menthone, methyl-7,3-dihydro-2H-1,5-benzodioxepine-3-one, fenchone.

Orthoesters—Another class of compound useful as pro-accords according to the present invention are orthoesters having the formula:

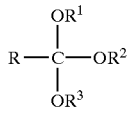

wherein hydrolysis of the orthoester releases one equivalent of an ester and two equivalents of alcohol according to the following scheme:

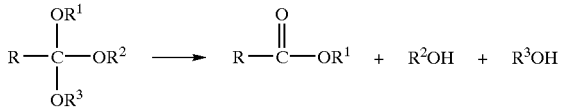

wherein R is hydrogen, $C_1$–$C_{20}$ alkyl, $C_4$–$C_{20}$ cycloalkyl, $C_6$–$C_{20}$ alkenyl, $C_6$–$C_{20}$ aryl, and mixtures thereof; $R^1$, $R^2$ and $R^3$ are each independently selected from the group consisting of $C_5$–$C_{20}$ linear, branched, or substituted alkyl; $C_4$–$C_{20}$ linear, branched, or substituted alkenyl; $C_5$–$C_{20}$ substituted or unsubstituted cyclic alkyl; $C_5$–$C_{20}$ substituted or unsubstituted aryl, $C_2$–$C_{40}$ substituted or unsubstituted alkyleneoxy; $C_3$–$C_{40}$ substituted or unsubstituted alkyleneoxyalkyl; $C_6$–$C_{40}$ substituted or unsubstituted alkylenearyl; $C_6$–$C_{32}$ substituted or unsubstituted aryloxy; $C_6$–$C_{40}$ substituted or unsubstituted alkyleneoxyaryl; $C_6$–$C_{40}$ oxyalkylenearyl; and mixtures thereof.

Non-limiting examples of orthoester pro-fragrances include tris-geranyl orthoformate, tris(cis-3-hexen-1-yl) orthoformate, tris(phenylethyl)orthoformate, bis(citronellyl) ethyl orthoacetate, tris(citronellyl)orthoformate, tris(cis-6-nonenyl) orthoformate, tris(phenoxyethyl)orthoformate, tris (geranyl, neryl)orthoformate (70:30 geranyl:neryl), tris(9-decenyl)orthoformate, tris(3-methyl-5-phenylpentanyl) orthofornate, tris(6-methylheptan-2-yl)orthoformate, tris([4-(2,2,6-trimethyl-2-cyclohexen-1-yl)-3-buten-2-yl] orthoformate, tris[3-methyl-5-(2,2,3-trimethyl-3-cyclopenten-1-yl)-4-penten-2-yl]orthoformate, trismenthyl orthoformate, tris(4-isopropylcyclohexylethyl-2-yl) orthoformate, tris-(6,8-dimethylnonan-2-yl)orthoformate, tris-phenylethyl orthoacetate, tris(cis-3-hexen-1-yl) orthoacetate, tris(cis-6-nonenyl)orthoacetate, tris-citronellyl orthoacetate, bis(geranyl)benzyl orthoacetate, tris(geranyl) orthoacetate, tris(4-isopropylcyclohexylmethyl) orthoacetate, tris(benzyl)orthoacetate, tris(2,6-dimethyl-5-heptenyl)orthoacetate, bis(cis-3-hexen-1-yl)amyl orthoacetate, and neryl citronellyl ethyl orthobutyrate.

Pro-fragrances are suitably described in the following: U.S. Pat. No. 5,378,468 Suffis et al., issued Jan. 3, 1995; U.S. Pat. No. 5,626,852 Suffis et al., issued May 6, 1997; U.S. Pat. No. 5,710,122 Sivik et al., issued Jan. 20, 1998; U.S. Pat. No. 5,716,918 Sivik et al., issued Feb. 10, 1998; U.S. Pat. No. 5,721,202 Waite et al., issued Feb. 24, 1998; U.S. Pat. No. 5,744,435 Hartman et al., issued Apr. 25, 1998; U.S. Pat. No. 5,756,827 Sivik, issued May 26, 1998; U.S. Pat. No. 5,830,835 Severns et al., issued Nov. 3, 1998; U.S. Pat. No. 5,919,752 Morelli et al., issued Jul. 6, 1999 all of which are incorporated herein by reference.

Protected Zeolites—Examples of suitable protected zeolite perfume compositions are described in U.S. Pat. No. 5,648,328, U.S. Pat. No. 4,539,135, Ramachandran et al, issued Sep. 3, 1985, discloses particulate laundry compounds comprising a clay or zeolite material carrying perfume. U.S. Pat. No. 4,713,193, Tai, issued Dec. 15, 1987, discloses a free-flowing particulate detergent additive comprising a liquid or oily adjunct with a zeolite material. Japanese Patent HEI 4 [1992]-218583, Nishishiro, published Aug. 10, 1992, discloses controlled-release materials including perfumes plus zeolites. U.S. Pat. No. 4,304,675, Corey et al, issued Dec. 8, 1981, teaches a method and composition comprising zeolites for deodorizing articles. East German Patent Publication No. 248,508, published Aug. 12, 1987; East German Patent Publication No. 137,599, published Sep. 12, 1979; European Patent Publication No. 535,942, published Apr. 7, 1993, and Publication No. 536,942, published Apr. 14, 1993, by Unilever PLC; U.S. Pat. No. 5,336,665, issued Aug. 9, 1994 to Garner-Gray et al.; and WO 94/28107, published Dec. 8, 1994.

Cyclodextrins—Examples of suitable cyclodextrin compositions useful as perfume agents are described in U.S. Pat. Nos. 5,595,093, 5,942,217, 5,234,610, 5,102,564 and 5,094,761.

Encapsulated Perfumes—Examples of encapsulated perfumes are described in U.S. Pat. Nos. 5,648,328, 5,154,842, 5,066,419, 4,145,184. Encapsulated perfume particles may comprise perfume dispersed within certain water-insoluble nonpolymeric carrier materials and encapsulated in a protective shell by coating with a friable coating material. The coated particles allow for preservation and protection of perfumes which are susceptible to degradation or loss in storage and in cleaning compositions. In use, the surface coating fractures and the underlying carrier/perfume particles efficiently deliver a large variety of perfume types to fabrics or other surfaces.

Film-Forming Polymers—The treating compositions of the present invention may contain one or more film forming polymers. Preferred film-forming polymers include, but are not limited to, ethylcellulose, hydroxypropylcellulose, methylhydroxypropylcellulose, methyl ethyl cellulose, polyvinyl pyrrolidone, polyvinyl alcohol, copolymer condensates of ethylene oxide and propylene oxide, and polyethylene glycol. Other suitable film forming polymers are Gums, such as Agar, Guar gum, Gum arabic, Gum arabic uses, Gum ghatti, Gum karaya, Hydroxypropyl guar gum, and Xanthan gum; Alginates, such as, Calcium alginate, Calcium-sodium alginate; Protein Film forming polymers, such as Pectin albumen, poly amino acids (e.g., poly lysine), gelatin; and Waxes, such as Carnuba wax. Exemplary of the film-forming agents of the invention are the following non-toxic, food grade, commercially available, film-forming agents: Natrosol® (nonionic water-soluble hydroxyethylcellulose from Aqualon, Wilmington, Del.); Methocel® (methyl hydroxypropylcellulose made from cellulose and propylene oxide and available from Dow Chemical); Bermocoll E® (non-ionic, water soluble ethyl hydroxyethylcellulose from Akzo Nobel. The preferred film forming agents are Hydroxypropylcellulose Type LFF from Hercules Klucel, Methocel® E50 LV, Methocel® K100, Methocel® F50, Natrosol® 250KR, Bermocoll E® 351 FQ, Bermocoll E® 411 FQ, and Bermocoll E® 320 FQ.

When one or more release agents, especially mineral oil, are present in the treating composition, preferably one or more film-forming polymers are also present. The preferred ratio of release agent to film-forming polymer is in the range of from about 1:1 to about 20:1.

Conventional Benefit Agents/Adjuncts

Chelating Agents—The compositions of the present invention herein may also optionally contain a chelating agent which serves to chelate metal ions and metal impurities which would otherwise tend to deactivate the bleaching agent(s). Useful chelating agents can include amino carboxylates, phosphonates, amino phosphonates, polyfunctionally-substituted aromatic chelating agents and mixtures thereof. Further examples of suitable chelating agents and levels of use are described in U.S. Pat. Nos. 5,705,464, 5,710,115, 5,728,671 and 5,576,282.

The compositions herein may also contain water-soluble methyl glycine diacetic acid (MGDA) salts (or acid form) as a chelant or co-builder useful with, for example, insoluble builders such as zeolites, layered silicates and the like.

A suitable chelant for inclusion in the treating compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include disodium EDDS and tetrasodium EDDS. Examples of such preferred magnesium salts of EDDS include MgEDDS and dimagnesium EDDS.

If utilized, these chelating agents will generally comprise from about 0.1% to about 15%, more preferably from about 0.1% to about 3.0% by weight of the treating compositions herein.

Spreading Agents—Any agent that, especially when the treating composition is in the form of a gel or other viscous form, enhances product performance while providing desirable ease of use. In other words, any product that aids in providing a gel composition or other viscous composition of the present invention to have a rheology such that the composition is viscous enough to avoid dripping when it is applied to the shoe, while at the same time has a low yield point such that the composition is easy for the consumer to pour or otherwise apply the composition to the shoe.

The spreading agent, when present in the treating compositions of the present invention, improves the spreading and quality of the coverage of a high viscosity liquid or gel treating composition during direct application of onto a substrate, such as surfaces of the shoe. The spreading agent is capable of lowering the coefficient of friction and increases the shear index of the treating composition to provide easier spreading by increasing the Newtonian characteristics of the treating composition while maintaining stability with respect to solid suspension, if any, and phase homogeneity. The spreading agent can also allow the use of other adjuncts or additives that would otherwise increase the apparent viscosity of the treating composition and negatively affect the spreading properties. Further, the spreading agent can allow the direct application of cleaning and coniditioning adjuncts or additive in a sufficiently thin layer as to maximize surface cleaning and/or conditioning benefits. Further yet, when the spreading agent is present in combination with a thixotropic thickening agent, such as TRIHYDROXYSTEARIN (THIXCIN®), the spreading agent is capable of fine tuning the desired treating composition viscosity while maintaining excellent spreading characteristics.

The presence of spreading agents allows the formulation of low to medium viscosity (1,000–7,000 cps) gels that are phase stable and that can sustain/suspend a medium to high level of solids (30%). Formulations with these spreading agents are more stable to low temperatures and to freeze thaw tests (i.e. cycles tests between 0° F. to 30° F.).

The spreading agents also can provide processing benefits by allowing the formation of complex gel structures with a simple mixing process. Medium to low viscosity gel treating compositions can be processed in readily available equipment (e.g., mixers). Compared to other known processes that require heat exchangers and high shear mixers to form such gels.

Nonlimiting examples of suitable spreading agents for use in the treating compositions of the present invention include solvatropes and co-solvatropes. Solvatropes act as a coupling between the nonionic or cationic surfactant and water phases that typically avoid to coexist or tend to gel. With the addition of the solvatropes a single phase is delivered that is bicontinuous in nature. This phase incorporates a domain containing the surfactant and solvatrope and a domain containing the water. These two domains are completely intertwined like the air pockets and membrane of a sponge. The intertwined structure allows for a formulation with lower viscosity that at the same time is stable (similar to the correlation of better packing higher bulk density in solids) and due to the reduction of repulsion between the two phase domains easier spreading behavior is achieved. The solvatropes may have the following characteristics; 1) ClogP between 0.1–0.6 (ClogP is the partitioning coefficient of a material between water and octanol), 2) some 0.7 degree of polarity (no center of symmetry).

Nonlimiting examples of suitable solvatropes for use in the treating compositions of the present invention include 2,2,4-trimethyl-1,3-pentanediol (TMPD), 1,2-hexanediol, 2-ethyl-1,3-hexanediol (EHD).

Nonlimiting examples of suitable co-solvatropes for use in the treating compositions of the present invention include 1,4-cyclohexane dimethanol (CHDM), alcohol ethoxylate ($C_9$–$C_{11}$ EO5), and other nonionic surfactants and materials.

Without wishing to be bound by theory, it is believed that the spreading agents, probably due to their double OH functionality combined with a medium length carbon chainlength, modify the particle to particle interactions, but differently from the behavior of a typical solvent these spreading agents modify without completely eliminating them. This results in a lower viscosity product that due to the presence of some particle to particle intermolecular forces still maintain similar stability behavior as the thicker formulation.

Brighteners—Any optical brighteners or other brightening or whitening agents known in the art can be incorporated at levels typically from about 0.05% to about 1.2%, by weight, into the treating compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zabradnik, Published by John Wiley & Sons, New York (1982).

Specific examples of optical brighteners which are useful in the present compositions are those identified in U.S. Pat. No. 4,790,856, issued to Wixon on Dec. 13, 1988 and U.S. Pat. No. 3,646,015, issued Feb. 29, 1972 to Hamilton.

Preferred brighteners also exist. It has been found that conventional laundry brighteners such as stilbene and distyrylbiphenyl derivatives have an affinity predominantly for cellulosic materials. However, a typical athletic shoe is comprised of non-cellulosic materials: a leather body, ethyl vinyl acetate midsoles, and optionally mesh components (usually comprised of polyester or nylon). Often this leaves over 90% of a typical athletic shoe that is not receptive to being brightened by conventional brighteners.

Preferably, a brightener is chosen that has an affinity for acetate fabric. Without wishing to be bound to any particular theory, it is believed that brighteners which have an affinity for acetate fabric will also exhibit an affinity for the ethyl vinyl acetate midsoles of athletic shoes. It is also believed that brighteners with an affinity for wool and silk will also have an affinity for other polyamides such as leather or nylon.

A useful brightener candidate is one which will deposit on and adhere to shoe components such as leather, the midsole, mesh components, laces, and the like. A convenient way to screen successful brightener candidates is by means of brightener depletion from solution.

Brightener depletion from solution is easily determined by one skilled in basic analytical chemistry using UV/visible spectroscopy. All that is required is to contact the shoe components with a dilute solution containing the brightener, and then measure the loss of a known concentration of brightener from a dilute solution by various shoe components. The shoe components can be any of the ones described above, i.e., leather, midsole, etc. Dilution levels should be commensurate with the expected concentration of brightener in the wash water during cleaning. Specifically, when measuring brightener depletion from solution for the purpose of the appended claims, the initial brightener concentration should be between $4\times10^{-2}$ ppm and 37 ppm of the cleaning composition. Preferably, the brightener solutions used herein will deposit on leather and/or the insoles of shoes via solution depletion of 2% or more, and more preferably 1% or more depletion from solution, without visible brightener staining.

Brighteners having these properties include a wide variety of coumarin derivative brighteners and certain oxazole and benzoxazolyl derivative brighteners. Suitable coumarin brighteners include: OPTIBLANC® LSN brightener available from 3V, Inc. of Weekhawken, N.J., USA; INTRAWITE WGS brightener available from Crompton & Knowles Colors, Inc. of Charlotte, N.C., USA; and TINOPAL SWN brightener availabl By incorporating a non-conventional brightener into the cleaning composition, deposition on the midsoles and leather portions of athletic shoes is achieved.

In addition to being used in the method, kit, etc. for treating shoes described herein, the brighteners described herein can also be applied to athletic shoes, and other types of shoes contemplated herein, independently of any washing, cleaning, or conditioning process, such as before or during the manufacture of the shoes prior to distribution to a purchaser.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The treating compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for cleaning and/or detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al. and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid treating compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycoupolypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

Surfactant-based suds suppresors include, but are not limited to, low foaming nonionic surfactants. Examples of suitable low foaming nonionic surfactants (LFNIs) which are described in U.S. Pat. Nos. 5,705,464 and 5,710,115. LFNI may be present in amounts from 0.01% to about 10% by weight, preferably from about 0.1% to about 10%. and most preferably from about 0.25% to about 4%. They also encompass non-silicone, nonphosphate polymeric materials further illustrated hereinafter.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers as described in U.S. Pat. Nos. 5,705,464 and 5,710,115.

LFNIs which may also be used include those POLY-TERGENT® SLF-18 nonionic surfactants from Olin Corp., and any biodegradable LFNI having the melting point properties discussed hereinabove.

For any treating compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing treating for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the treating composition. Preferably, from about 0.5% to about 3% of fatty monocarboxylate suds suppressor is utilized. Silicone suds suppressors are typically utilized in amounts up to about 2.0%, by weight, of the treating composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

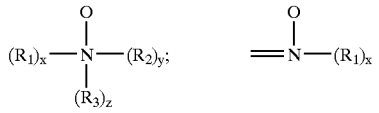

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the treating compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the cleaning and/or detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1. The treating compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

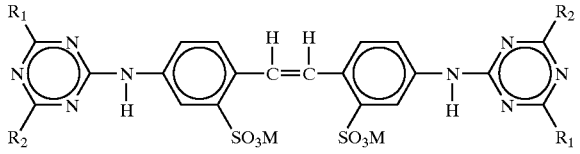

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the treating compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species described in this section provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two treating composition components when used alone. The extent to which brighteners deposit on the surfaces of articles in the wash solution can be defined by a parameter called the "exhaustion coefficient". The exhaustion coefficient is in general as the ratio of a) the brightener material deposited on the surfaces of the articles to b) the initial brightener concentration in the wash liquor. Brighteners with relatively high exhaustion coefficients are the most suitable for inhibiting dye transfer in the context of the present invention.

Preservatives—Examples of preservatives useful in the treating compositions of this invention include glutaraldehyde, formaldehyde, 2-bromo-2-nitro-propane-1, 3-diol sold by Inolex Chemicals, located in Philadelphia, Pa., under trade name BRONOPOL®, and a mixture of 5-chloro-2-methyl-4-isothiazoline-3-one and 2-methyl-4-isothiazoline-3-one sold by Rohm and Haas Company under the trade name KATHON® CG/ICP. Typical levels of bacteriocides used in the present compositions are from about 1 to about 1,000 ppm by weight of the composition.

Bleaching System—The treating compositions of the present invention may optionally comprise a bleaching system.

The use of a bleaching component is envisaged as an optional ingredient. If a bleaching component is used, it can provide sanitization and/or disinfection benefits in addition to other benefits, and thus the bleaching systems described herein may also be considered to fall under the section hereof dealing with disinfecting system benefit agents. However, the use of certain bleaches in shoe cleaning compositions can present previously unforeseen and unrecognized problems.

The use of sodium hypochlorite and related bleaches is well known in the formulation of laundry detergents or as separate products to be used in the laundering process. Sodium hypochlorite when formulated properly in laundry detergents, can provide sanitization and/or disinfection and stain removal among other useful proerties. Problems for the use of sodium hypochlorite is laundry are also well known and include color or fabric damage. However, these problem are not sufficient to prevent its widespread use in laundry detergents. Moreover, because of the limited nature of these problems, the users of the bleach can choose which items to expose to bleach.

However, we have unexpectedly found that the use of chlorine bleach in a shoe cleaning composition is highly undesirable. One key problem associated with using chlorine bleach (hypochlorite) in the treating compositions and methods of the present invention is that washing leather in the presence of chlorine bleach causes a loss in the leather strength. In addition, leather washed in the presence of chlorine bleach becomes stiff and brittle compared to washing the leather in the absence of chlorine bleach. The loss of strength and the increased stiffness and brttleness of the leather will likely cause the leather to break or crack more-quicklly during wear thus lowering the useful life of the shoe.

Another problem with using chlorine bleach in treat the shoes is the discoloration of many of the colored surfaces on the shoe. In particular, many cloth or stitched portions of the are susceptible to color damage from the hypochlorite. Similarly, the use of chlorine bleach often causes a yellow or yellow brown discoloration of the tongue of the shoe. While not wishing to be bound by the theory, we believe that the discoloration due to the chemical action of hypochlorite ions on the polyisocyanurate foams usually or often found in the tongues of these shoes. Similar effects could be seen on portions of the shoe also containing the polyisocyanurate foam.

Thus a preferred embodiment is a formulation with essentially no hypoclorite and similar bleaches. Other bleaches may have similar properties and should be avoided.

Still other bleaches may be suitably formulated into the composition providing they do no show the deleterious properties shown by hypochlorite or if the deleterious properties do occur, they occur at a sufficiently slow rate that the useful life of the shoe is not materially changed.

Bleaching Agents—Bleaching agents are described in detail in the herein incorporated Kirk Othmer's Encyclopedia of Chemical Technology, 4th Ed (1992, John Wiley & Sons), Vol. 4, pp. 271–300 "Bleaching Agents (Survey)", and pp. 301–311 "Bleaching Agents (Pulp and Paper) and include the various forms of sodium perborate and sodium percarbonate, including various coated and modified forms.

A bleaching system for example can comprise hydrogen peroxide systems. The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

(a) Bleach Activators—Preferably, the peroxygen bleach component in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention is preferably at least about 1:1, and preferably ranges from about 20:1 to 1:1, more preferably from about 10:1 to about 1:1, and most preferably from about 3:1 to 1:1.

Quaternary substituted bleach activators may also be included. The present treating compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. No. 5,698,504, U.S. Pat. No. 5,695,679, and U.S. Pat. No. 5,686,014 each of which are cited herein above. Preferred examples of such bleach activators include: (6-octanamnidocaproyl) oxybenzenesulfonate, (6-nonanamidocaproyl) oxybenzenesulfonate, (6-decanamidocaproyl) oxybenzenesulfonate and mixtures thereof.

Other useful activators, disclosed in U.S. Pat. No. 5,698,504, U.S. Pat. No. 5,695,679, U.S. Pat. No. 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)=N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. No. 5,698,504, U.S. Pat. No. 5,695,679 and U.S. Pat. No. 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

(b) Metal-containing Bleach Catalysts—The present invention compositions and methods may utilize metal-containing bleach catalysts that are effective for use in bleaching compositions examples of which are described in U.S. Pat. No. 5,720,897. Preferred are manganese and cobalt-containing bleach catalysts. Such catalysts are disclosed in U.S. Pat. No. 4,430,243 Bragg, issued Feb. 2, 1982.

Manganese Metal Complexes—If desired, the compositions herein can be catalyzed by means of a manganese compound. Such compounds and levels of use are well known in the art and include, for example, the manganese-based catalysts disclosed in U.S. Pat. Nos. 5,576,282; 5,246,621; 5,244,594; 5,194,416; and 5,114,606; and European Pat. App. Pub. Nos. 549,271 A1, 549,272 A1, 544,440 A2, and 544,490 A1; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2(u\text{-}O)_1(u\text{-}OAc)_2(1,4,7\text{-trimethyl-}1,4,7\text{-triazacyclononane})_2(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1(u\text{-}OAc)_{2\text{-}}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes—Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistry*, 56, 22–25 (1952).

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the laundry or laundry uses, and non-limitingly illustrated by any of the following:

Dichloro-5,12-dimethyl-1,5,8,12-tetraazabicyclo[6.6.2] hexadecane Manganese(II)

Diaquo-5,12-dimethyl-1,5,8,12-tetraazabicyclo[6.6.2] hexadecaneManganese(II) Hexafluorophosphate Aquo-hydroxy-5,12-dimethyl-1,5,8,12-tetraazabicyclo [6.6.2]hexadecaneManganese(III) Hexafluorophosphate Diaquo-5,12-dimethyl-1,5,8,12-tetraazabicyclo[6.6.2] hexadecaneManganese(II) Tetrafluoroborate Dichloro-5,12-dimethyl-1,5,8,12-tetraazabicyclo[6.6.2] hexadecaneManganese(III) Hexafluorophosphate Dichloro-5,12-di-n-butyl-1,5,8,12-tetraaza bicyclo[6.6.2] hexadecaneManganese(II)

Dichloro-5,12-dibenzyl-1,5,8,12-tetraazabicyclo[6.6.2] hexadecaneManganese(II)

Dichloro-5-n-butyl-12-methyl-1,5,8,12-tetraaza-bicyclo [6.6.2]hexadecaneManganese(II)

Dichloro-5-n-octyl-12-methyl-1,5,8,12-tetraaza-bicyclo [6.6.2]hexadecaneManganese(II)

Dichloro-5-n-butyl-12-methyl-1,5,8,12-tetraaza-bicyclo [6.6.2]hexadecaneManganese(II).

As a practical matter, and not by way of limitation, the compositions and treating processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(c) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

(d) Preformed Peracids—Also suitable as bleaching agents are preformed peracids, such as phthalimido-peroxycaproic acid ("PAP"), nononoylamide of either peroxysuccinic acid ("NAPSA") or peroxyadipic acid ("NAPAA"), N,N'-terephthaloyl-di(6-aminoperoxycaproic acid) ("TPCAP"), N-lauroyl-6-aminoperoxycaproic acid ("LAPCA"), N-decanoyl-aminoperoxycaproic acid ("DAPCA"), N-nonanoyl-6-aminoperoxycaproic acid ("NAPCA") and 6-decylamino-6-oxoperoxycaproic acid ("DAPAA"). Described in more detail in U.S. Pat. Nos. 5,487,818, 5,310,934, 5,246,620,.5,279,757, 5,132,431, 4,634,551 and 5,770,551.

(e) Photobleaches—Suitable photobleaches for use in the treating compositions of the present invention include, but are not limited to, the photobleaches described in U.S. Pat. Nos. 4,217,105 and 5,916,481.

Enzymes—In addition to one or more proteases which are preferably included in the treating compositions of the present invention, one or more additional enzymes other than proteases may be included in the treating compositions. With respect to the enzymes in the particulate solid of the present invention, any suitable enzyme can be used. The preferred enzymes for use in the particulate solids of the present invention are selected from proteases, amylases, cellulases and mixtures thereof. Nonlimiting examples of other suitable enzymes include the following the enzymes described in U.S. Pat. Nos. 5,705,464, 5,710,115, 5,576,282, 5,728,671 and 5,707,950, and PCT Publication Nos. WO 99/20727, WO 99/20726, WO 99/20770 and WO 99/20769 to The Procter & Gamble Company and Genencor International, Inc., and PCT Publication No. WO 99/20723 to The Procter & Gamble Company.

Additional Examples of suitable enzymes include, but are not limited to, hemicellulases, peroxidases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases. hyaluronidase, chondroitinase, laccase, mannanases, more preferably plant cell wall degrading enzymes and non-cell wall-degrading enzymes (WO 98/39403 A) and can, more specifically, include pectinase (WO 98/06808 A, JP10088472 A, JP10088485 A); pectolyase (WO98/06805 A1); pectin lyases free from other pectic enzymes (WO9806807 A1); chondriotinase (EP 747,469 A); xylanase (EP 709,452 A, WO 98/39404 A, WO98/39402 A) including those derived from microtetraspora flexuosa (U.S. Pat. No. 5,683,911); isopeptidase (WO 98/16604 A); keratinase (EP 747,470 A, WO 98/40473 A); lipase (GB 2,297,979 A; WO 96/16153 A; WO 96/12004 A; EP 698,659 A; WO 96/16154 A; specific examples of lipases include M1 LIPASE® and LIPOMAX® both available from Gist-Brocades and LIPOLASE® and LIPOLASE ULTRA® both available from Novo Nordisk AS); cellulase or endoglucanase (GB 2,294,269 A; WO 96/27649 A; GB 2,303,147 A; WO98/03640 A; see also neutral or alkaline cellulases derived from chrysosporium lucknowense strain VKM F-3500D as disclosed in WO9815633 A; specific examples of cellulases include CAREZYME® and CELLUZYME® both available from Novo Nordisk AS)); polygalacturonase (WO 98/06809 A); mycodextranase (WO 98/13457 A); thermitase (WO 96/28558 A); cholesterol esterase (WO 98 28394 A); or any combination thereof; and known amylases (specific examples of amylases include PURAFECT OX AM® available from Genencor International and TERMAMYL®, BAN® ,FUNGAMYL® and DURAMYL® all available from Novo Nordisk A/S); oxidoreductases; oxidases or combination systems including same (DE19523389 A1); mutant blue copper oxidases (WO9709431 A1), peroxidases (see for example U.S. Pat. No. 5,605,832, WO97/31090 A1), mannanases (WO9711164 A1); xyloglucanases (WO 94/14953); laccases, see WO9838287 A1 or WO9838286 A1 or for example, those laccase variants having amino acid changes in myceliophthora or scytalidium laccase(s) as described in WO9827197 A1 or mediated laccase systems as described in DE19612193 A1), or those derived from coprinus strains (see, for example WO9810060 A1 or WO9827198 A1), phenol oxidase or polyphenol oxidase (JP10174583 A) or mediated phenol oxidase systems (WO9711217 A); enhanced phenol oxidase systems (WO 9725468 A WO9725469 A); phenol oxidases fused to an amino acid sequence having a cellulose binding domain (WO9740127 A1, WO9740229 A1) or other phenol oxidases (WO9708325 A, WO9728257 A1) or superoxide dismutases. Oxidoreductases and/or their associated antibodies can be used, for example with $H_2O_2$, as taught in WO 98/07816 A. Depending on the type of treating composition, other redox-active enzymes can be used, even, for example, catalases (see, for example JP09316490 A).

A range of enzyme materials are also disclosed in WO 9307263 and WO 9307260 to Genencor International, WO 8908694, and U.S. Pat. No. 3,553,139, Jan. 5, 1971 to McCarty materials particularly useful for liquid detergent formulations, and their incorporation into such formulations, are disclosed in U.S. Pat. No. 4,261,868.

Organic Solvents—The treating compositions of the present invention may contain conventional organic solvents such as propylene glycol, butoxy propanol, and/or butoxy propoxy propanol. Without being bound by theory, it is believed that one of the functions of these organic solvents is to enhance the antimicrobial and/or softening efficacy of the treating compositions.

pH and Buffering Variation—Many of the treating compositions described herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

Other Materials—Detersive ingredients or adjuncts optionally included in the instant compositions can include one or more materials for assisting or enhancing the performance of the treating compositions, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as color speckles, anti-corrosion agents, dyes, fillers, germicides, alkalinity sources, hydrotropes, anti-oxidants, perfumes, solubilizing agents, carriers, processing aids, pigments, and pH control agents as described in U.S. Pat. Nos. 5,705,464, 5,710,115, 5,698,504, 5,695,679, 5,686,014 and 5,646,101.

Methods for Treating Shoes

The treating compositions of the present invention are particularly suitable for use in the methods of the present invention; namely, methods for treating shoes in need of treatment.

A preferred method for treating shoes in need of treatment comprises contacting the shoes with one or more treating compositions of the present invention and subsequently washing said shoes in an aqueous medium. Preferably, the temperature of the aqueous wash medium used to wash the shoes is no more than 180° F. (82° C.), more preferably no more than 150° F. (66° C.), most preferably no more than 110° F. (43° C.). Typically, the temperature of the aqueous wash medium is in the range of from about 40° F. (5° C.) to about 175° F. (80° C.), more typically from about 50° F. (10° C.) to about 140° F. (60° C.), most typically from about 60° F. (15° C.) to about 100° F. (40° C.). Chromium can be extracted from leather to a greater extent at higher temperatures and/or damage to shoes increases as temperature of wash solutions increase.

Without being bound by theory, higher temperatures enhance cleaning performance, however, those same high temperatures may cause excessive damage to the shoes thus one skilled in the art can choose a temperature or temperature range such that cleaning performance is optimized without excessive damage to the shoes.

Preferably, the wash solution comprising the treating composition(s) of the present invention has a pH in the range of from about about 3 to about 11, more preferably from about 4 to about 10 and most preferably from about 6 to about 9.

In situations where the wash solution comprises one or more shoes treated with conditioning agents in the absence of cleaning agents, the pH is preferably in the range of from about 3 to about 10, more preferably from about 3 to about 9, most preferably from about 5 to about 7.

In situations where the wash solution comprises one or more shoes treated with cleaning agents in the absence of conditioning agents, the pH is preferably in the range of from about 6 to about 11, more preferably from about 7 to about 10, most preferably from about 7.5 to about 9.5.

In situations where the wash solution comprises one or more shoes treated with cleaning agents and conditioning agents, the pH is preferably in the range of from about 4 to about 11, more preferably from about 5 to about 10, most preferably from about 7 to about 9.5.

Techniques for controlling pH at recommended usage levels include the use of buffers, alkalis, acids, etc., and are well known to those skilled in the art.

Without being bound by theory, higher pHs enhance cleaning performance, however, those same high pHs may cause excessive damage to the shoes thus one skilled in the art can choose a pH or pH range such that cleaning performance is optimized without excessive damage to the shoes.

In addition to the treating compositions of the present invention, the methods of the present invention preferably include articles of manufacture and/or devices that further enhance the benefits imparted by the treating compositions and/or facilitate treatment of the shoes. Such devices include, but are not limited to, a bag into which one or more shoes, preferably one shoe, is placed prior to contacting the shoe with an aqueous medium, and/or an applicator useful directly applying the treating compositions of the present invention to the shoes.

The treating composition may be applied directly to the exterior surfaces of the shoes, the interior surfaces of the shoes and/or both, preferably by using an applicator as defined in more detail hereinbelow. Rubbing of the treating composition onto the surfaces of the shoe may expedite treatment of the surfaces of the shoe and is thus preferred.

The shoes may be and preferably are placed in a containment bag, preferably one shoe per bag. The bag containing the shoe is then preferably placed into an aqueous medium. Proper selection of a containment bag can impact both the paint stability and/or cleaning effectiveness of the treating compositions of the present invention when used in the methods described herein.

One or more treating compositions of the present invention may be applied to the shoes prior to washing the shoes. Additionally, one or more treating compositions of the present invention may be applied to the aqueous medium used to wash the shoes. Also, one or more treating compositions of the present invention may be contained within the containment bag, if used, either releasably fixed to the interior walls of the bag or delivered into the interior of the bag before or after placing the shoe in the bag. Further, one or more treating compositions of the present invention may be applied to the shoes prior to placing the shoes in a bag. The steps of the methods of treating the shoes depends upon the aqueous medium and benefit desired to be achieved by treating the shoes.

Alternatively, a treating composition comprising one or more cleaning agents may be applied to one or more shoes prior to placing the shoe in an aqueous medium, either inside a bag or absent a bag, preferably inside a bag. Next, a treating composition comprising one or more conditioning agents may be applied to the aqueous medium such that the conditioning agents diffuse onto and inside the shoe during the time the shoe is present in the aqueous medium.

In one preferred embodiment, a cleaning composition in the form of a gel is applied to the outside of the shoes with a brush. The person applying the cleaning composition may hold the shoe from the inside when applying the cleaning composition. The shoe is then placed partially in a bag (i.e., so that bag does not fully enclose the shoe and a conditioning composition can be applied to the inside of the shoe). In this embodiment, the conditioning composition in the form of a liquid is applied to the inside of the shoe. The conditioning composition is preferably distributed inside the shoe as evenly as possible, such as by holding onto the shoe with the surrounding bag, and gently rocking the shoe from the toe to the heel of the shoe. The bag is then preferably closed around the shoe, and the shoe is placed into a washing machine and washed as described herein. In lieu of using other shoes to provide ballast, it is also possible to provide some other suitable articles to provide ballast, such as towels, and the like. In less preferred embodiments, the bag can be eliminated from the process, and some other article or articles such as towels could be provided to at least partially protect the shoes.

Agitation of the aqueous medium containing the shoe to be treated facilitates and expedites the treatment by permitting the treating compositions to diffuse onto and inside the shoe.

Articles of Manufacture

In accordance with the present invention, preferred articles of manufacture include treating compositions herein that are suitable for use in the methods described herein, in a package that can provide direct application of the treating compositions to one or more shoes. Preferably, the treating compositions are packaged in a pliable container fitted with an applicator cap. Suitable containers include those that permit application directly onto soiled fabric by squeezing and/or pouring and/or spraying the treating compositions through the applicator cap.

Another suitable article of manufacture for use with the treating compositions and methods of the present invention includes a flexible container, preferably a bag. Preferably, the one or more shoes to be treated with the treating compositions are placed within the flexible container with one or more treating compositions. The treating composition (s) can be present on the one or more shoes prior to placing the shoe(s) in the flexible container. The treating composition(s) can be added to the flexible container prior to or after placing the one or more shoes into the flexible container. The flexible container can be impregnated with the treating composition(s) and/or present on the interior surfaces of the flexible container such that when the flexible container containing the one or more shoes to be treated is used in accordance with the methods of the present invention, the treating composition(s) are mobilized such that the one or more shoes is contacted and/or treated with the treating composition(s).

APPLICATOR—Suitable applicators for use with the treating compositions of the present invention include any package that can provide direct application of the treating compositions onto shoe surfaces. Preferably, the treating compositions are packaged in a pliable container fitted with an applicator cap. Suitable containers include those that permit application directly onto shoe surfaces by squeezing or pouring the treating compositions through the applicator cap. Such containers include those described in U.S. Pat. No. 4,107,067. Appropriate applicator caps include, but are not limited to, fountain type nozzles, brush applicators, roller ball applicators, and flip-top caps. The containers useful for the methods described herein preferably contain from about 4 ounces to about 32 ounces, more preferably from about 4 ounces to about 24 ounces of the treating compositions of the present invention.

Useful applicators for use with the treating compositions, methods and articles of the present invention include applicators that are effective at applying the treating compositions of the present invention to the surfaces of a shoe without damaging the shoe surfaces. For example, useful brush applicators include brush applicators that are stiff enough to effectively disperse the treating composition onto the surfaces of a shoe without damaging the shoe surfaces, such as painted shoe surfaces. Examples of such suitable brush applicators are plastic brush applicators used for cleaning vegetables, etc.

Other useful applicators for the present invention are described in WO 97/49614, GB 2180445, WO 85/05344, CH 602 193, DE 2428780, EP 875 465, WO 95/15710, WO 95/01121, GB 2187945, EP 380 182, EP 374 339, GB 2219769, WO 87/06112, FR 2688397 and U.S. Pat. Nos. 4,053,242, 5,568,990, 5,324,127, 5,020,930 and 5,418,996.

FLEXIBLE CONTAINER—Suitable flexible containers for use herein can be provided in any number of configurations, and is conveniently in the form of a flexible pouch or "bag", which has sufficient volume to contain the one or more shoes to be treated. The flexible container can be of any convenient size, and should be sufficiently large to allow movement of the container and shoe(s) contained therein, such as during agitation by hand and/or by a mechanical agitator in a conventional automatic washing machine, but should not be so large as to interfere with the operation of the mechanical agitator.

Suitable containers may be manufactured from any economical material, such as polyester, polypropylene, and the like, with the proviso that it must not tear during agitation, either by hand or by a mechanical agitator.

It is preferred that the flexible container be provided with a sealing means which is sufficiently stable to remain closed during the treating process. Simple tie strings or wires, various snap closures such as ZIP LOCK® closures, and VELCRO®-type closures, contact adhesives, adhesive tape, zipper-type closures and the like, suffice.

In accordance with another aspect of the present invention, preferred embodiments of the shoe bags will now be described with reference to the Figures, wherein like numerals indicate the same elements throughout the views and wherein reference numerals having the same last two digits (e.g., 20 and 120) connote similar elements. A shoe, in particular an athletic shoe, which is exposed to the wash cycle of a washing machine, especially the agitation and spin portions of the wash cycle, can suffer undesirable damage in the form of surface abrasions (from the agitator, washer tub, other articles, etc.), fiber pilling, and the formation of fibrils or slender fibers in and around the sockliner and shoe laces. Such damage is often visually unacceptable to consumers and can shorten the wearable life of a shoe. Therefore, it would be highly desirable to provide flexible containers which facilitate shoe cleaning in conventional washing machines while preventing the above-described damage and while still maintaining the integrity and effectiveness of the previously described shoe cleaning and conditioning processes. The exemplary shoe bags described hereafter are particularly useful in preventing the previously described shoe damage during the wash cycle without impeding the cleaning process, even for heavily soiled shoes.

Figure 2:
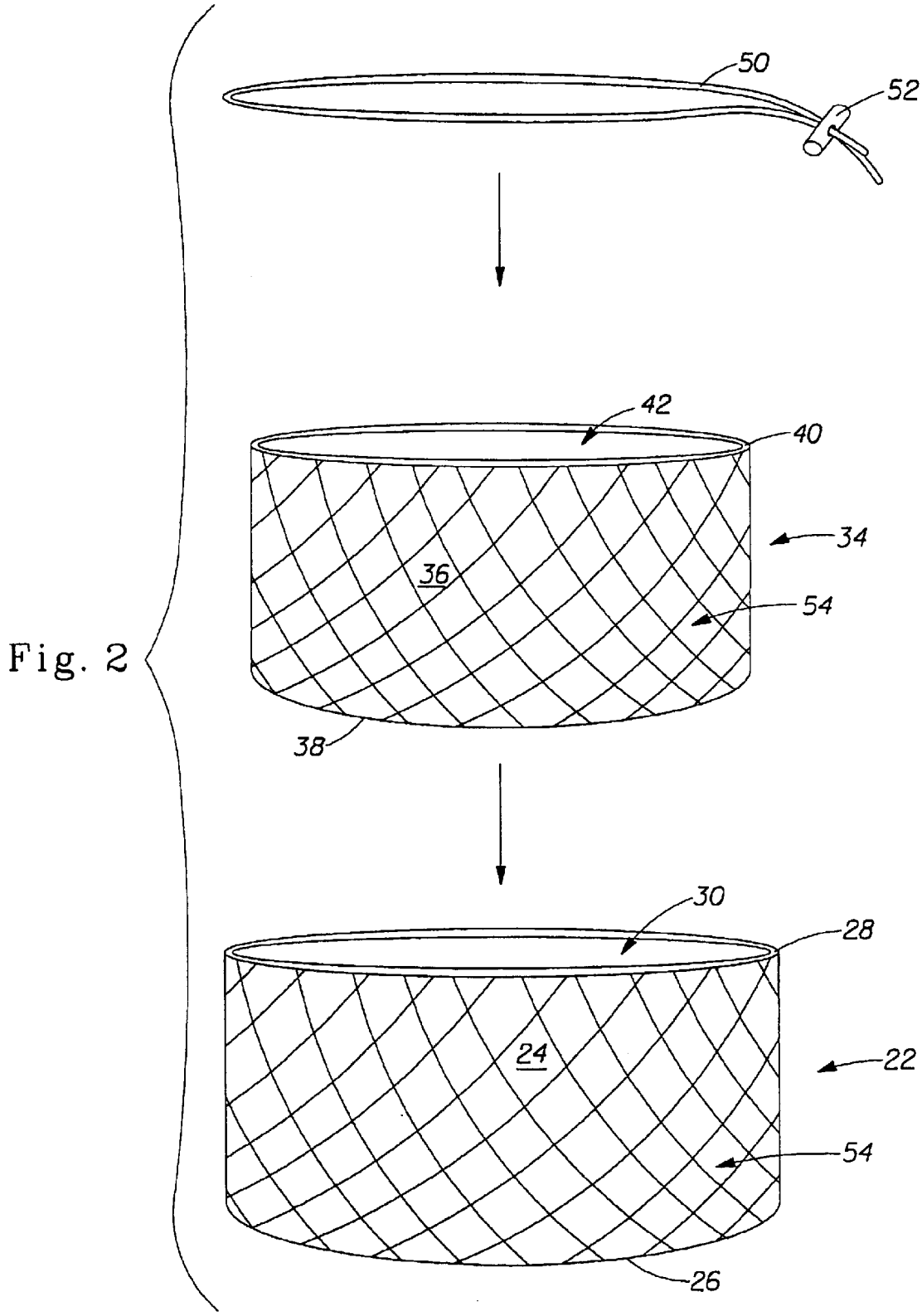
FIG. 2 is an exploded view of the shoe bag of FIG. 1, wherein some of the features of the bag closure have been removed for clarity.
Figure 3:
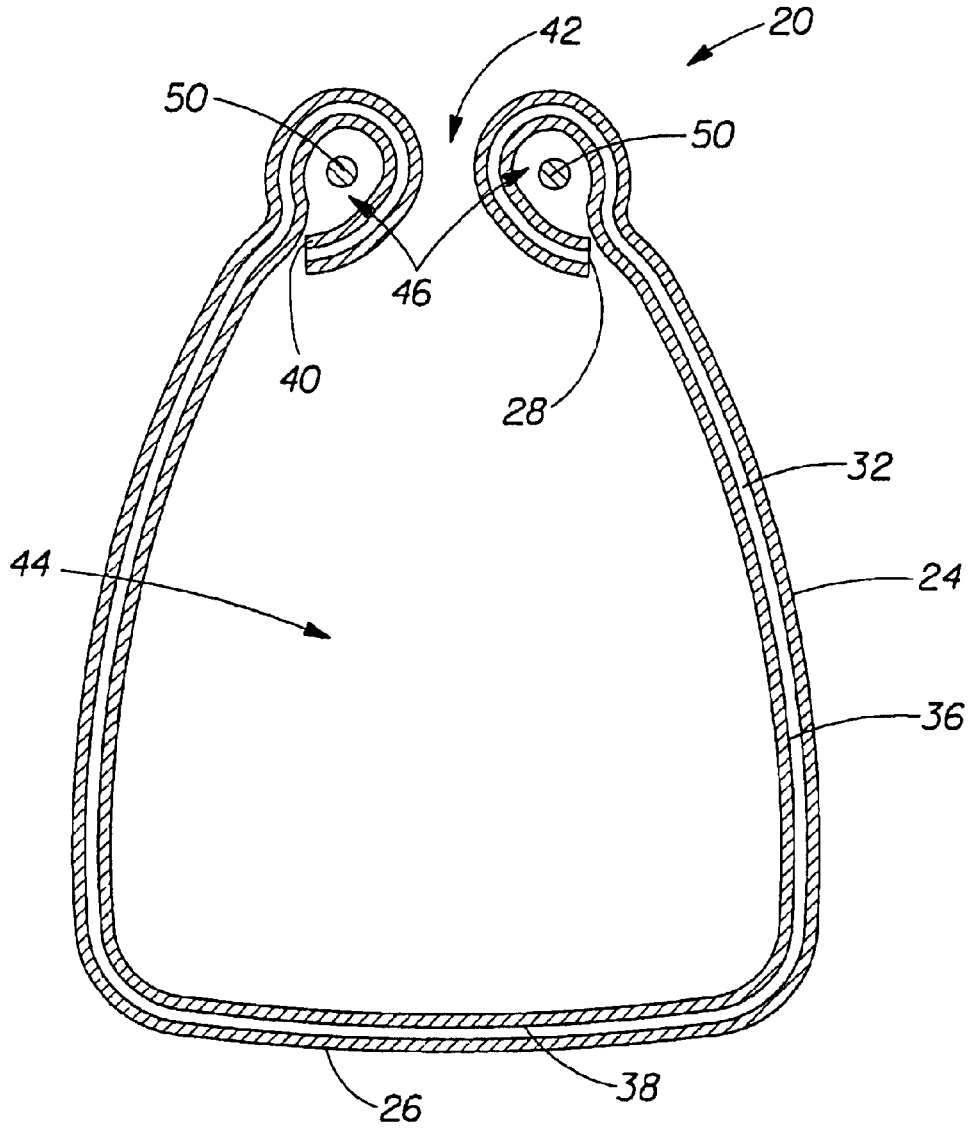
FIG. 3 is a cross-sectional side view of the shoe bag of FIG. 1, taken along line 3—3 thereof.
Figure 4:
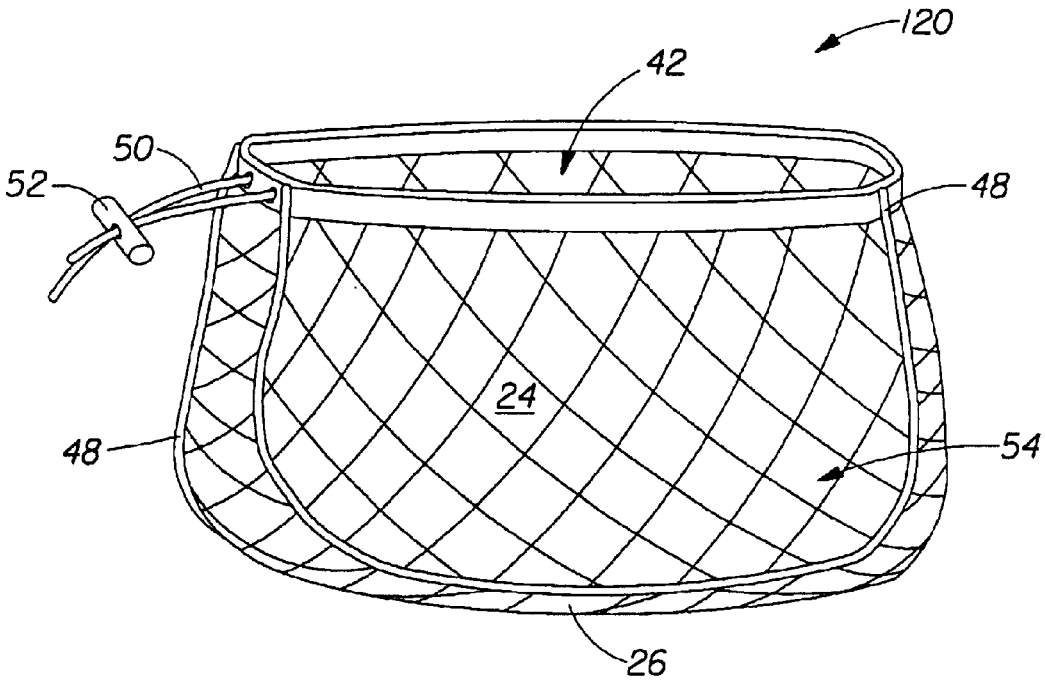
FIG. 4 is a perspective view of another shoe bag made in accordance with the present invention, wherein the inner and outer enclosures are interconnected by seams.

Referring to FIGS. 1, 2, and 3, a shoe bag 20 for use in the previously described washing and laundering methods is illustrated. The shoe bag 20 comprises a first or outer enclosure 22 having a side wall 24 and a bottom wall 26 interconnected with and encircled by the side wall 24. The top edge 28 of the side wall 24 of the outer enclosure 22 defines an opening 30 and the side wall 24, bottom wall 26, and opening 30 define a compartment 32 for receiving a second or inner enclosure 34. The inner enclosure 34 has a side wall 36 and a bottom wall 38 interconnected with the side wall 36. The top edge 40 of the side wall 36 defines an opening 42 and the side wall 36, bottom wall 38, and opening 42 define a compartment 44 for receiving a shoe. As best seen in FIG. 3, the inner enclosure 34 is disposed substantially within the compartment 32 of the outer enclosure 22 such that the side walls 24 and 36 are substantially coextensive with each other as are the bottom walls 26 and 38. The top edges 28 and 40 of the outer and inner enclosures 22 and 34 are together folded over and attached to, such as by stitching, the compartment 44 of the inner enclosure 34 to form a channel 46. While the inner enclosure 34 and the outer enclosure 22 of the shoe bag 20 are illustrated herein as interconnected at only the openings 30 and 42, it will be appreciated that additional interconnections, such as seams or stitching, can be provided between the various walls of the enclosures so long as substantial portions of the side walls are not interconnected and are allowed to slip relative to one another. For example, seams 48 interconnecting the side walls of the outer and inner enclosures 22 and 34 might be placed at the corners of the edges of the side walls, as shown in FIG. 4 with respect to the shoe bag 120, so long as sufficient relative movement between the side walls 24 and 36 of the outer and inner enclosures 22 and 34 is provided. In order to minimize shoe abrasion, the stitching for the seams 48 is disposed outside of the compartment 44 such that there are no raised surfaces within the compartment 44.

In order to aid the slip between the walls of the enclosures and to limit the slip between the walls 36 and/or 38 of the inner enclosure 34 and a shoe disposed therein, it is preferred that the coefficient of friction between the walls of the inner and outer enclosures is at least about 10% less than the coefficient of friction between the shoe and the wall 36 and/or 38 of the inner enclosure 34, when measured under similar test conditions. More preferably, the coefficient of friction between the walls of the inner and outer enclosures is between about 30% and about 70% less than the coefficient of friction between the shoe and the walls 36 and/or 38 of the inner enclosure 34. This lower coefficient of friction can be achieved by application of a low coefficient of friction coating, such as TEFLON™ or silicone, to the surfaces of the walls 24 and 36 of the inner and outer enclosures which are in contact. Alternatively, the wall 24 of the outer enclosure 22 can be made from a material which reduces the coefficient of friction between the walls of the inner and outer enclosures. While not intending to be bound by any theory, it believed that the relative slip between the walls of the inner and outer enclosures reduces shoe abrasion by absorbing and/or dissipating the abrasive forces generated by the washing machine.

The channel 46 encircles the openings 30 and 42 of the outer and inner enclosures 22 and 34 and preferably has a cord 50 moveably disposed therein. The cord 50 in combination with a slide lock 52 form a closure system which is used to close the openings 30 and 42 of the shoe bag 20 during use by reducing the circumferences of the openings 30 and 42 so that a shoe disposed within the shoe bag 20 cannot be removed therefrom by the forces exerted upon the shoe during washing. The slide lock 52 can be a spring-biased slide lock, or other locks as known in the art. In addition, the cord 50 can be elastic or non-elastic and may include an outer sheath (e.g., a rubberized coating or mesh) which further cooperates with the slide lock to maintain closure of the opening 42 during use. Suitable cords are available from Perfectex Plus, Inc. of Huntington Beach, Calif. The shoe bag 20 is preferably sized to accommodate single shoes of varying sizes, and, more preferably, the shoe bag 20 has a length between about 8 cm and about 51 cm and a height between about 5 cm and about 31 cm. The shoe bag 20 has a width between about 5 cm and about 20 cm. The volume of the compartment 44, which is for a single shoe bag, of the inner enclosure 34 of the shoe bag 20 is at least about $2\times10^{-5}$ $m^3$, and the volume of the compartment 44 is preferably between about $2\times10^{-5}$ $m^3$ and about $31\times10^{-3}$ $m^3$. More preferably, the volume of the compartment 44 is between about $5\times10^{-4}$ $m^3$ and about $5\times10^{-3}$ $m^3$. While the shape of the shoe bag 20 shown in FIGS. 1 and 2 is preferred, it will be appreciated that other shapes can be provided. For example, the shoe bag 20 can be provided in the shape of other polyhedrons, cylinders, etc.

The walls of the inner and outer enclosures 34 and 22 of the shoe bag 20 are preferably formed from a mesh material having a plurality of apertures 54. The apertures 54 are sized to allow sufficient wash water to flow there through, even when contaminated with particulates and substances which are commonly encountered when wearing and washing shoes, such as dirt, grass, small rocks and pebbles, and the like. For example, grass and other foliage (which can be several centimeters or more in length or width) and dirt, soil, clay, and the like (which can form into clump which are several centimeters or more across) may need to flushed or removed from a shoe bag during the wash cycle. The percent ratio of the total surface area of a wall of either the inner or outer enclosures 34 and 22 to the total open area of the apertures 54 disposed within that wall is at least about 30%, preferably between about 50% and about 90%, and more preferably between about 60% and about 80%. As used herein, the phrase "open area" refers to the maximum area of a structure or aperture. For example, if an aperture has a perimeter of fixed length but the perimeter can change shape due to its flexibility such that the open area of the aperture is also variable, then the open area of that aperture would be the maximum open area which the perimeter would allow. As used herein, the phrase "total open area" is intended to refer to the summation of the individual open areas of each of the apertures 56. The total open area of a wall of the bag 20 is at least about 10 $cm^2$, and preferably the total open area of a wall is preferably between about 10 $cm^2$ and about 800 $cm^2$. More preferably, the total open area of a wall is between about 100 $cm^2$ and about 500 $cm^2$, and, most preferably the total open area of a wall is between about 200 $cm^2$ and about 400 $cm^2$. The average open area of each aperture 54 is at least about 0.08 $cm^2$, and less than or equal to about 5 $cm^2$ and preferably the average open area of each aperture 54 is between about 0.2 $cm^2$ and about 3 $cm^2$ so that shoe contaminants can be effectively removed from the shoe bag 20 by the wash water. As used herein, the term "average open area" is intended to refer to the sum of the open areas of all apertures of a subject wall of the bag 20 divided by the total number of apertures. More preferably, the average open area of each aperture 56 is between about 0.7 $cm^2$ and about 2 $cm^2$. Although the apertures 54 are illustrated for convenience as rectangular in shape, other apertures shapes can be provided as desired. Further the size of the apertures can vary within a single enclosure or between the enclosures.

In addition to sufficient open area for removal of the previously described shoe contaminants during the wash cycle, the mesh walls should also have sufficient strength to withstand the forces imparted by a water-soaked shoe during the wash process. For instance, leather athletic shoes can weigh 600 gms or more when soaked with water such that significant loading can be imparted to a shoe bag in its three axes during wash and spin cycles. Mesh walls having a dry tensile strength of at least about 800 gms/$cm^2$ and, more preferably, between about 800 gms/$cm^2$ and about 3500 gms/$cm^2$, when measured according to the Tappi 494 om-88 method, in combination with sufficient aperture open area provides a shoe bag which can withstand the rigors of washing shoes while allowing adequate removal of the shoe contaminants.

Figure 5:
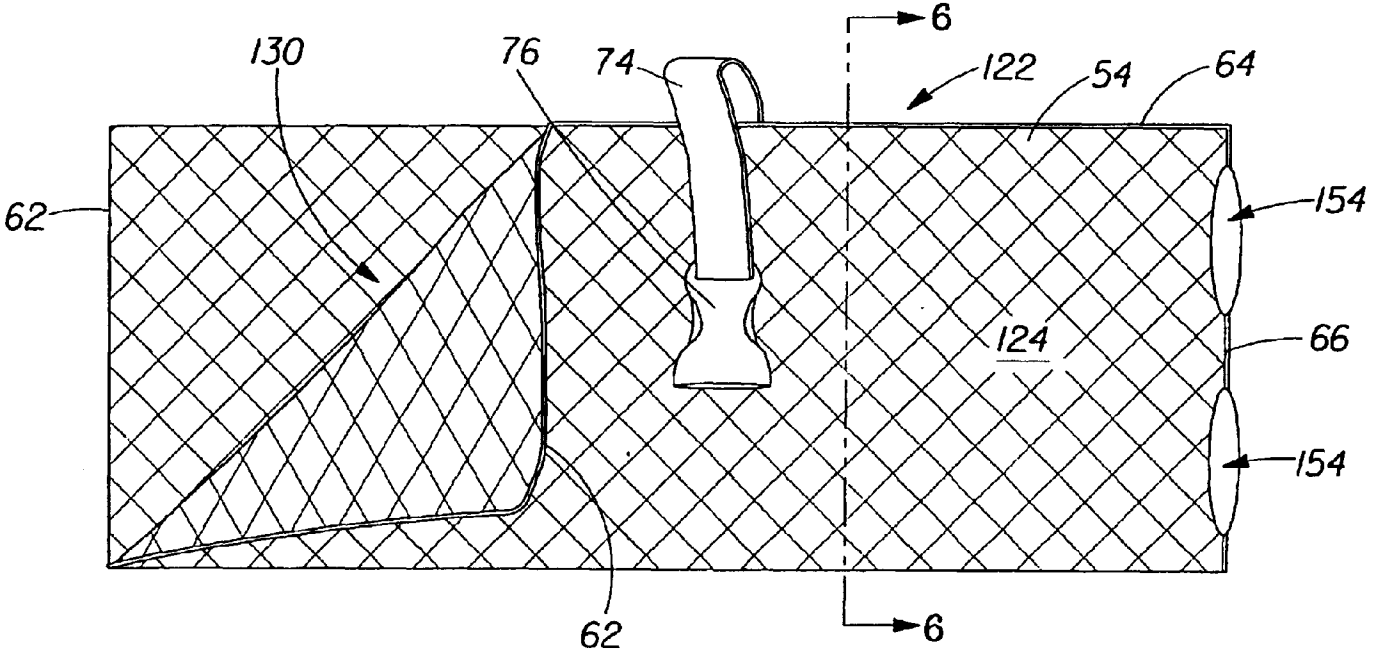
FIG. 5 is a perspective view of yet another shoe bag made in accordance with the present invention, wherein the shoe bag has two spaced apart apertures.
Figure 6:
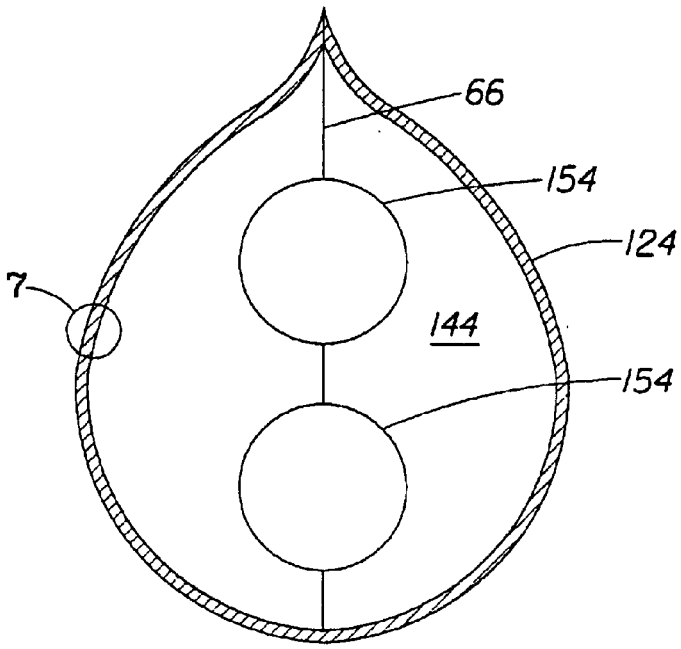
FIG. 6 is a cross-sectional side view of the shoe bag of FIG. 5, taken along line 6—6 thereof.
Figure 7:
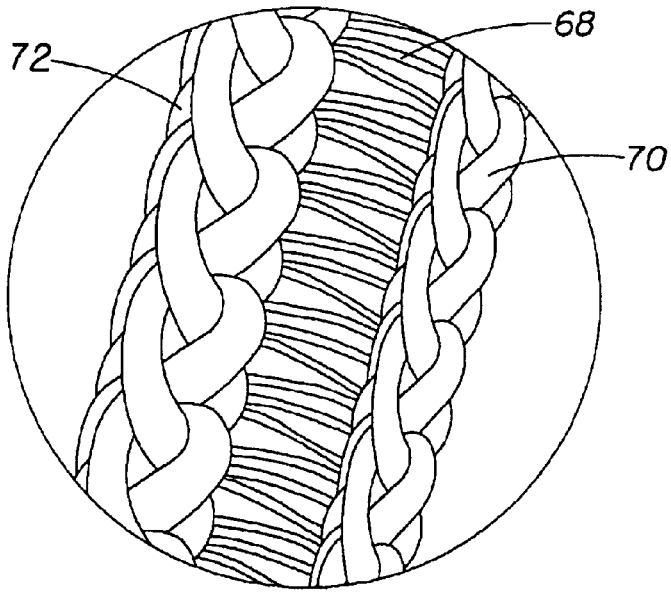
FIG. 7 is an enlarged cross-sectional side view of the shoe bag of FIG. 6, taken about circle 7 thereof.

Referring to FIGS. 5 and 6, another shoe bag made in accordance with the present invention is illustrated. The shoe bag 220 is formed from a single enclosure 122 having an opening 130 for receiving a shoe, wherein the opening 130 is defined by two moveable flaps 62. The shoe bag 220 preferably comprises a side wall 124, the top longitudinal and rear transverse edges of which are joined by seams 64 and 66, respectively, to create a compartment 144 for storing a shoe. The side wall 124 is preferably formed from a layered material, comprising a core 68 between a first layer 70 and a second layer 72, the core 68 preferably being polyester and the first and second layers 70 and 72 being nylon, as shown in FIG. 7. One such material is manufactured by Apex Mills, Inc. of Inwood, N.Y. under KOOL-TEX No. 27. Other materials suitable for forming the layers of the side wall 124 include polyethylene, polyester, nylon, polypropylene, cotton, and combinations thereof. The side wall 124 can also be formed from non-layered materials so long as the material provides suitable protection for the shoe from abrasion.

Two spaced apart apertures 154 distal from the opening 130 are formed by gaps in the transverse seam 66. The apertures 154 are disposed adjacent the ends of the transverse seam 66. The apertures 154 provide an outlet for the wash water such that shoe contaminants can be removed from the interior of the shoe bag 120. The apertures 154 each have an open area of at least about 2 $cm^2$ and preferably the open area of each aperture 154 is between about 5 $cm^2$ and about 26 $cm^2$. More preferably, the apertures 154 each have an open area of between about 10 $cm^2$ and about 20 $cm^2$. Most preferably, the apertures 154 each have an open area between about 13 $cm^2$ and about 17 $cm^2$. While the perimeter of each aperture 154, which is formed from the flexible material of side wall 124 of the bag 220, is fixed in length, the shape of the apertures can change during use due to the flexibility of the side wall 124. As such, the open areas of the apertures may vary as the aperture changes shape. When the apertures are in a shape providing a maximum open area, the length of the open area of each aperture 154 is at least about 20% of the length of the seam 66 and preferably is between about 20% and about 35% of the length of the seam 66. More preferably, the length of the open area of each aperture 154 is between about 25% and about 30% of the length of seam 66. Although the apertures 154 are illustrated as substantially transverse to the longitudinal axis of the shoe bag 220 for cleaning effectiveness (e.g., removal of shoe contaminants) and to minimize the likelihood of shoe abrasion, the apertures 154 can be placed at other locations about the shoe bag 220. Further, the number of apertures can be increased or decreased so long as their size allows removal of shoe contaminants by the wash water.

The shoe bag 120 includes a strap 74 which is attached adjacent to the opening 130 at the longitudinal seam 64. At an end of the strap 74 is a first fastening device 76 which is fixably and permanently attached to the strap 74 so that its position on the strap does not change. A second fastening device 78 having a plurality of flexible fingers which can releaseably engage the first fastening device 76 is attached to the strap 74 by passing the strap 74 through the second fastening device 78 in such a way that changing its position on the strap 74, the length of the strap 74 can be increased or decreased. The fastening devices used herein are reusable mechanical fasteners. Any reusable mechanical fastener or fastening means can be used. Non-limiting examples include: fasteners wherein said first and second fastening devices, together, comprise a hook and loop (VELCRO®D-type) fastener; hook fasteners such as described in U.S. Pat. No. 5,058,247 to Thomas & Blaney issued Oct. 22, 1991; fasteners wherein said first and second fastening devices, together, comprise a hook and string type fastener; fasteners wherein said first and second fastening devices, together, comprise a toggle-type fastener; fasteners wherein said first and second fastening devices, together, form a snap-type fastener; as well as hook and eye fasteners, zipper-type fasteners, releasable buckle type fasteners as used in U.S. Pat. No. 5,330,141, to Kim, issued Jul. 19, 1994, and the like, so long as the fasteners do not abrade or contact the shoe. After inserting a shoe in the shoe bag 220, the length of the strap 74 is adjusted so that when the first and second fastening devices 76 and 78 are engaged, the strap closes the opening 130 to secure the shoe within the compartment 144.

Figure 8:
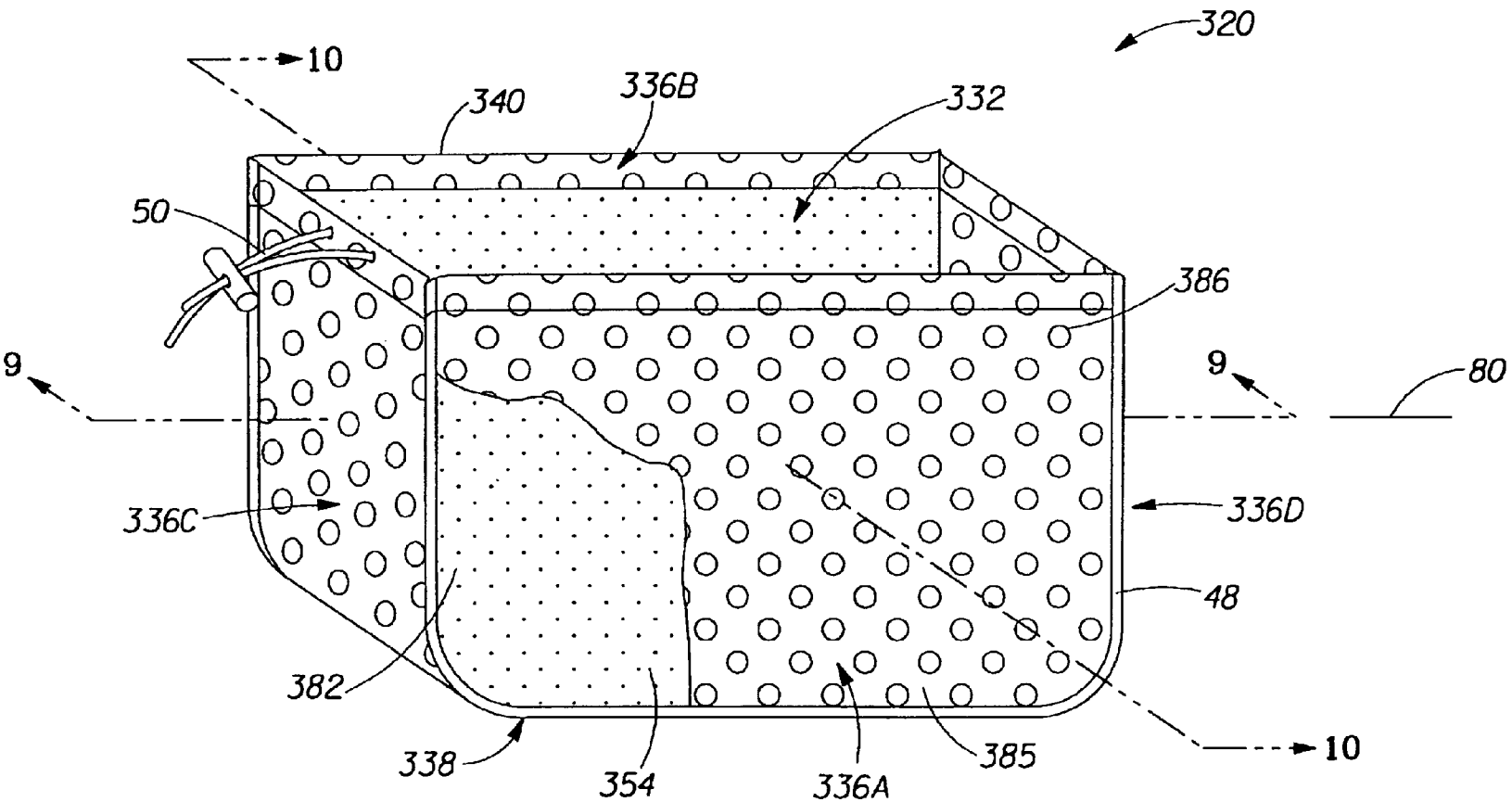
FIG. 8 is a perspective view of still another shoe bag made in accordance with the present invention, wherein the longitudinal side walls comprise two panels and the transverse side walls comprise a single panel and wherein a portion of one of the longitudinal side walls has been removed to expose the other panel.
Figure 9:
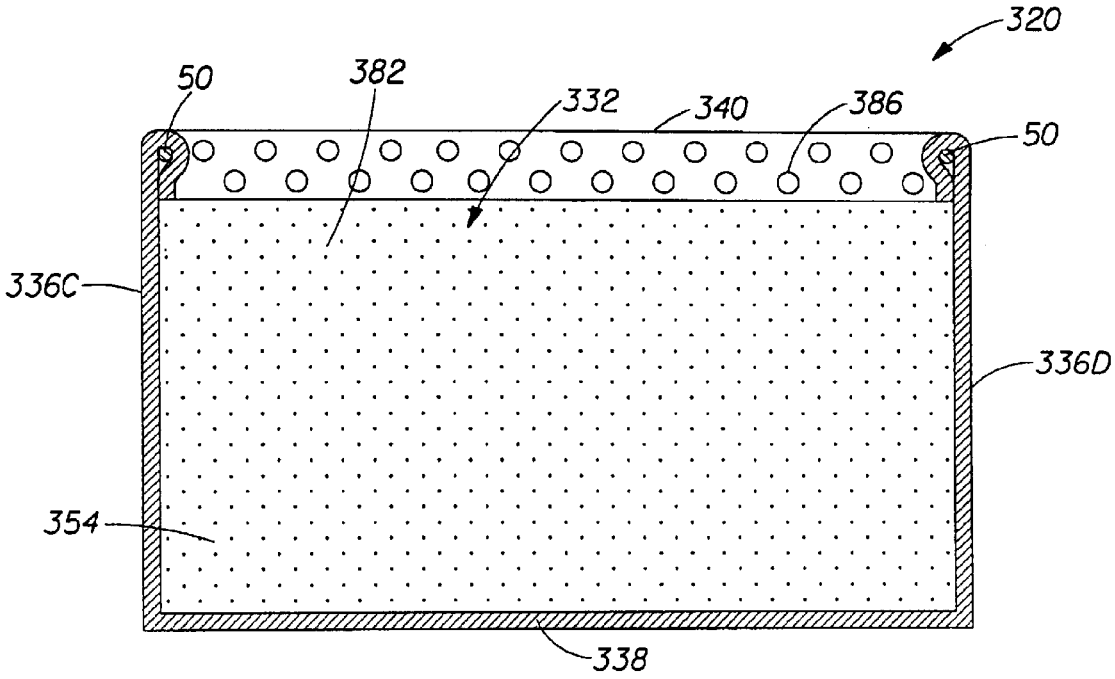
FIG. 9 is a cross-sectional side view of the shoe bag of FIG. 9, taken along line 10—10 thereof.
Figure 10:
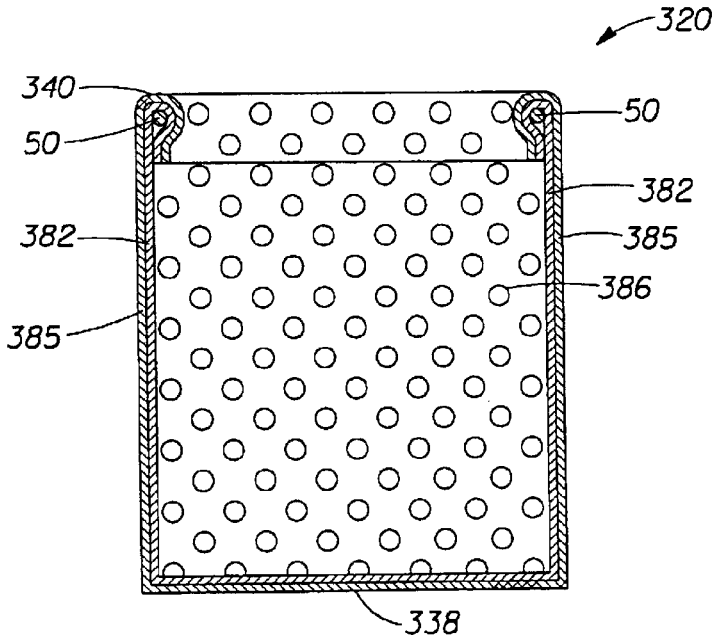
FIG. 10 is a cross-sectional side view of the shoe bag of FIG. 9, taken along line 11—11 thereof.

Referring to FIGS. 8 to 10, still another preferred shoe bag 320 made in accordance with the present invention will now be described. The shoe bag 320 preferably has a generally a parallelpiped shape and a length between about 8 cm and about 51 cm, a height between about 5 cm and about 31 cm, and a width of between about 5 cm and about 20 cm. The shoe bag 320 comprises longitudinal side walls 336A and 336B whose longest dimension extends along the longitudinal axis 80 of the shoe bag 320 and transverse side walls 336C and 336D which are disposed transverse to the longitudinal axis 80 of the shoe bag 320. The side walls are interconnected with a bottom wall 338, preferably by stitching or seams 48, to form a compartment 332 having an opening opposite the bottom wall 338 through which a shoe can be inserted during use. The opening is defined by the top edges 340 of each of the side walls. The longitudinal side walls 336A and 336B are formed from a first panel 382 of a first apertured or mesh material while the transverse side walls 336C and 336D and the bottom wall 338 are formed from a single panel of a second apertured or mesh material which is distinct from the first mesh material. More preferably, the longitudinal side walls 336A and 336B further include a second panel 385 disposed adjacent the first panel 382 and which is also formed from the same second mesh material as the transverse side walls 336C and 336D. Thus, the first panel 382 forms the interior surface (i.e., the surface adjacent the compartment 332) of the longitudinal side walls while the second panel 385 forms the exterior surface of the longitudinal side walls. While for sake of clarity the second panel 385 will be discussed herein as formed from the same material (i.e., the second mesh material) which also forms the transverse side walls 336C and 336D, it is contemplated that that the second panel 385 can be formed from other materials, such as the first mesh material or some other woven or non-woven fabric. In addition, the longitudinal side walls 336A and 336B can be provided with more than two panels, if desired, or the transverse side walls 336C and 336D and/or the bottom wall 338 can be formed from a plurality of panels while the longitudinal side walls 336A and 336B are formed from a single panel. Further, while each of the panels of the side walls is described herein as comprising a single uniform or homogenous fabric, it is contemplated that one or more of the panels might be formed from a plurality of fabrics. For example, the first panel 382 might be formed from both the first and second mesh materials or the first panel 382 might be formed from the first mesh material and another material. The opening can be closed during use by one of the closing structures previously described (e.g., cord 50 and slide lock 52). For multi panel side walls, the panels are preferably attached to each other about the periphery of the panels (e.g., at the seams or stitching 48) so that the panels are separated by a gap there between thereby allowing the panels to move relative to each other, as previously discussed with respect to the shoe bag 20.

Figure 11:
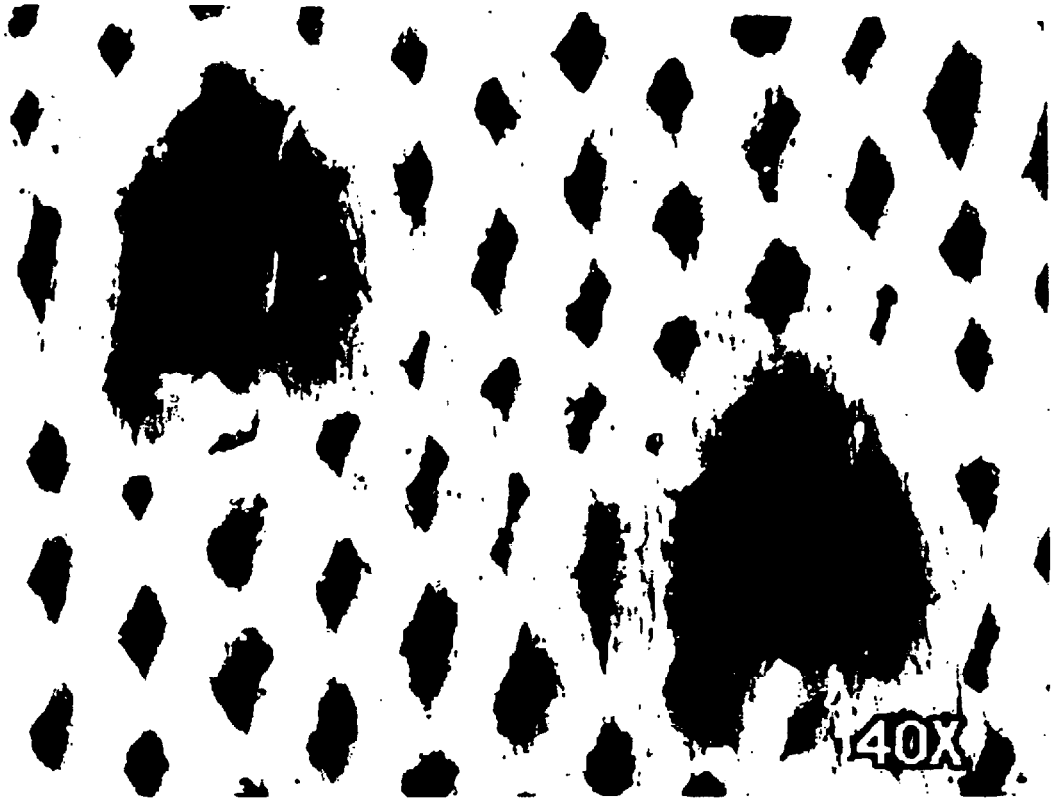
FIG. 11 is a 40× photomicrograph of a first mesh material suitable for use with the present invention, wherein the first or inner panel of the shoe bag of FIG. 8 is formed from this material.

Preferably, the first mesh material of the first panels 382 of the longitudinal side walls has a plurality of apertures 354 which are smaller in size than the apertures 386 of the second mesh material of the transverse side walls 336C and 336D and the bottom wall 338. The apertures of both the first and second mesh materials can be provided in either a random or repeating pattern as desired and in a variety of shapes, although generally circular apertures are illustrated and discussed herein for simplicity. While both the apertures 354 and 386 allow wash water to flow through the side walls and bottom wall during use for satisfactory wetting and cleaning of the shoe, contaminants (e.g., dirt and grass) are preferably flushed out of the compartment 332 through the larger apertures 386 of the second mesh material of the transverse side walls and the bottom wall. In addition, the yarns of the first mesh material of the first panel 382 of the longitudinal side walls are selected to minimize abrasion, pilling and other undesirable damage of the shoe's side walls, seams, laces, etc. during the machine wash process. The smaller aperture size and smooth, non-abrasive hand of the first material is believed to contribute to such a minimization of undesirable shoe damage. With reference to FIG. 11, the first mesh material is preferably provided in the form of a fabric having apertures 354 whose average open area is less than about 5 $mm^2$, and more preferably, whose apertures have an average open area between about 0.5 $mm^2$ and about 5 $mm^2$ and most preferably between about 0.6 $mm^2$ and about 2 $mm^2$, wherein the aperture density is at least about 0.05 apertures per $mm^2$ of panel surface area. Most preferably, the aperture density is between about 0.1 and about 0.4 apertures per $mm^2$ of panel surface area. Generally, each of the first panels of the (at longitudinal side walls have a total open area between about 10 $cm^2$ and about 800 $cm^2$, depending upon the overall dimensions of the shoe bag, and preferably each of the first panels of the longitudinal side walls has a total open area of at least about 50 $cm^2$. More preferably, each of the first panels of the longitudinal side walls has a total open area between about 50 $cm^2$ and about 400 $cm^2$ and most preferably between about 75 $cm^2$ and about 150 $cm^2$. Thus, the percent ratio of the total surface area of each of the first panels of the longitudinal side walls 336A and 336B to the total open area of each of the first panels (i.e., (total open area)/(total surface area)) of the longitudinal side walls 336A and 336B is between about 5% and about 50% and, more preferably, is between about 10% and about 25%, and most preferably is about 15%.

Figure 12:
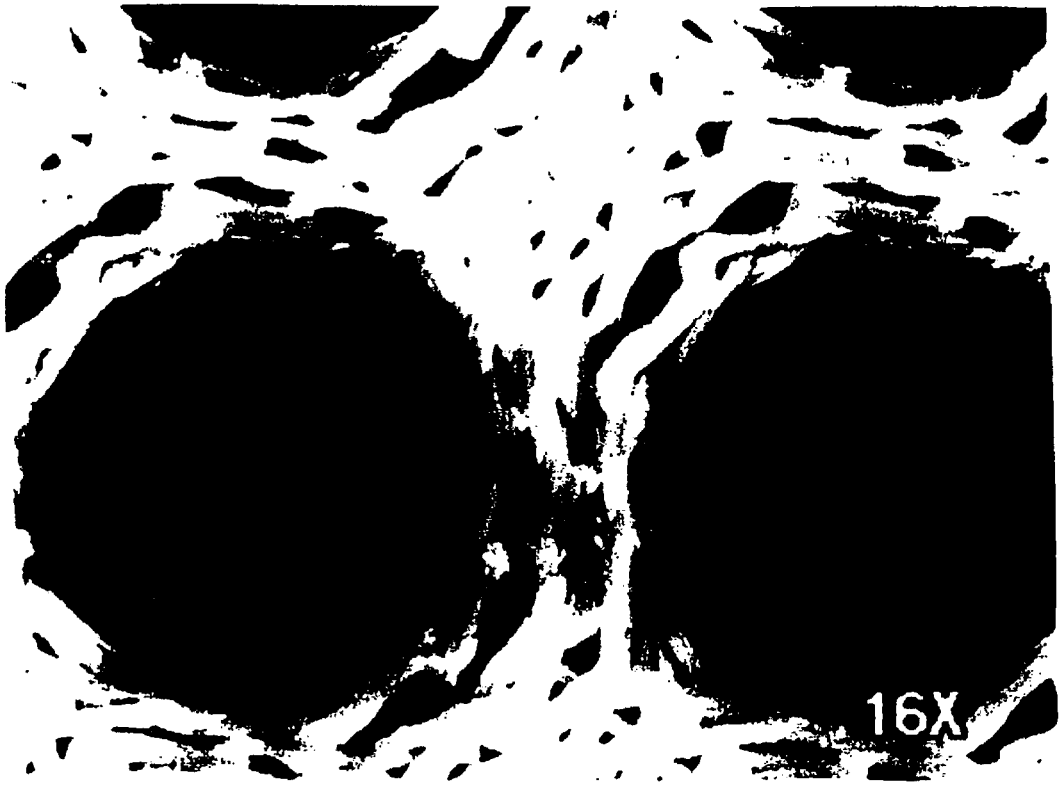
FIG. 12 is a 16× photomicrograph of a second mesh material suitable for use with the present invention, wherein the second or outer panel of the shoe bag of FIG. 8 is formed from this material.

In the event that the first mesh material is woven, the yarns used to form the first mesh material can comprise either microdenier or non-microdenier filaments. For microdenier filaments, the first yam is preferably a two ply, seventy denier yarn having about one hundred microdenier filaments per ply (i.e., a 2/70/100 yarn), wherein the filaments are formed from polyester while the second yarn is preferably a single ply, forty denier yarn having about twenty filaments per ply (i.e., a 1/40/20 yarn) and wherein the filaments are formed from polyester. Other micro denier yarns having similar constructions can be substituted. The microdenier first mesh material can be formed from the yarns using a circular knit (i.e., a weft-knitted fabric produced in tubular form) or other woven processes and patterns known in the art. For non-microdenier filaments, the first yarn of the first mesh material is preferably a single ply, one hundred and fifty denier yarn having about sixty-eight non-microdenier filaments per ply (i.e., a 1/150/68 yarn), wherein the filaments are formed from polyester or other material which does not substantially adsorb dyes during a wash cycle while the second yarn is the same as previously described. Other non-micro denier yarns having similar constructions can be substituted. The first mesh material has a weight, per ASTM 3776–96, of at least about 60 gms/$m^2$ and preferably between about 60 gms/$m^2$ and about 210 gms/$m^2$ and more preferably between about 100 gms/$m^2$ and about 150 gms/$m^2$. While not intending to be bound by any theory, selection of the appropriate weight is believed to With reference to FIG. 12, the second mesh material, which is used to form the transverse side walls 336C and 336D, the bottom wall 338 as well as the second panel 385 of the longitudinal side walls 336A and 336B, is preferably provided in the form of a fabric having apertures 386 whose average open area is between about 5 $mm^2$ and about 75 $mm^2$ and, more preferably, whose average open area is between about 5 $mm^2$ and 15 $mm^2$, wherein the aperture density is at least about 0.01 apertures per $mm^2$ of wall surface area. Most preferably, the aperture density is between about 0.02 $mm^2$ and about 0.04 $mm^2$ of wall surface area. Generally, the combination of the transverse side walls and the bottom wall have a total open area of between about 10 $cm^2$ and about 800 $cm^2$, depending upon the overall dimensions of the shoe bag, in order to adequately flush contaminants from the compartment 332 of the shoe bag 320. Preferably, the combination of the transverse side walls and the bottom wall have a total open area of between about 100 $cm^2$ and about 400 $cm^2$, and, more preferably, the combination of the transverse side walls and the bottom wall have a total open area of between about 225 $cm^2$ and about 275 $cm^2$. Thus, the percent ratio of the total surface area of each of the panels of the transverse side walls 336C and 336D to the total open area of each of the panels of the transverse side walls 336C and 336D is between about 20% and about 70% and more preferably between about 30% and about 40% and most preferably about 35%.

In the event that the second mesh material is woven, the yarns used to form the second mesh material can comprise either microdenier or non-microdenier filaments. The first and/or second yarns used to form the second mesh material are preferably single ply, one hundred fifty denier yarns having about thirty-four filaments per ply (i.e., a 1/150/34 yarn), wherein the filaments are formed from polyester or other material which does not substantially adsorb dyes during a wash cycle. The second mesh material can be formed from the yarns using any woven process (e.g., knitting) or pattern known in the art. The second mesh material has a weight, per ASTM 3776-96, of at least about 100 gms/$m^2$ and preferably between about 100 gms/$m^2$ and about 350 gms/$m^2$ and more preferably between about 125 gms/$m^2$ and about 200 gms/$m^2$.

Test Methods

The following procedures are useful for determination of parameters used to evaluate the shoe bags of the present invention. In particular, these procedures are used to characterize the effect of aperture size and wall static coefficients of friction on the performance of a shoe bag. Specific units may be suggested in connection with measurement and/or calculation of parameters described in the procedures. These units are provided for exemplary purposes only. Other units consistent with the intent and purpose of the procedures can be used.

Figure 13:
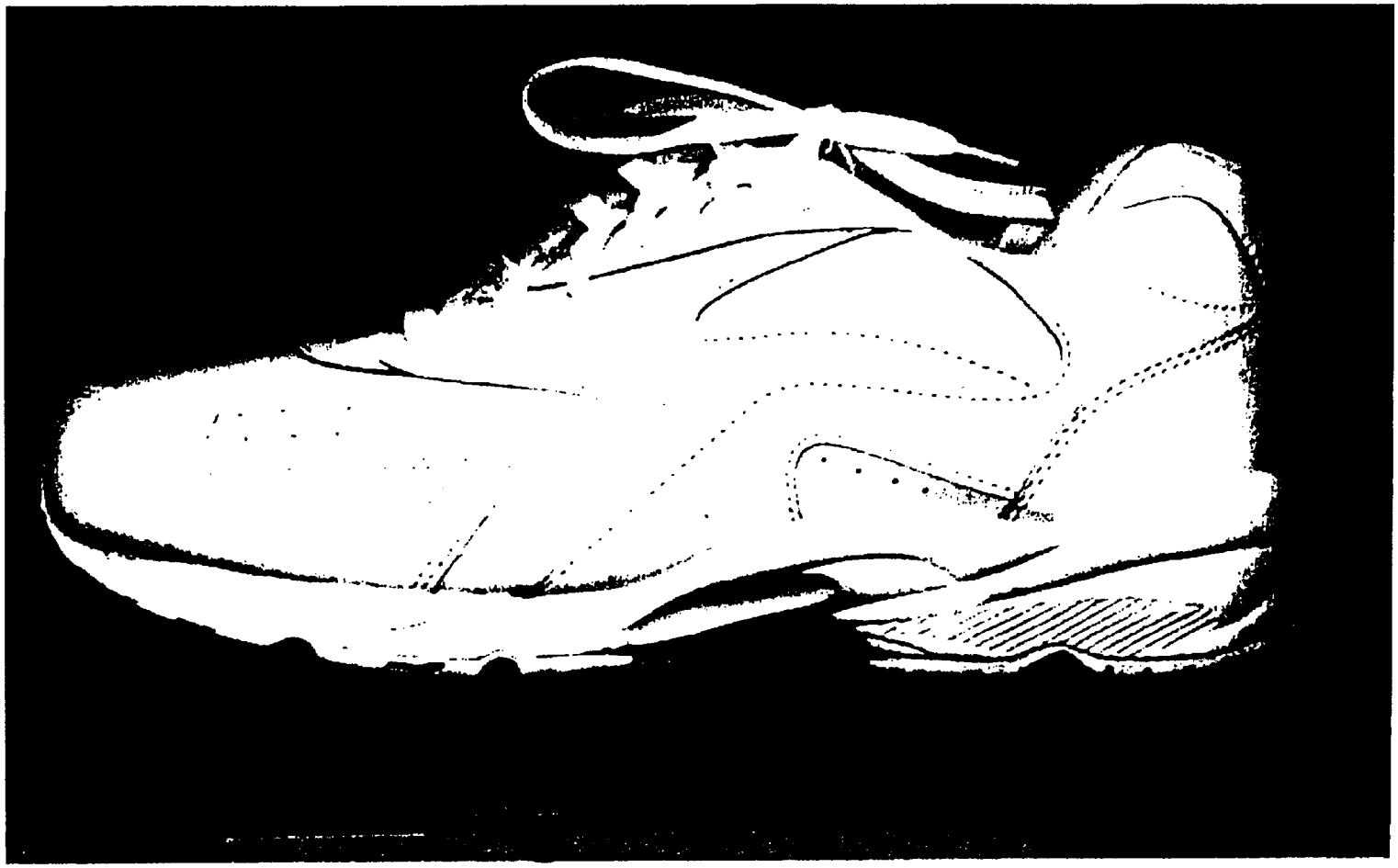
FIG. 13 is a photograph of the lateral side of a left men's athletic shoe, which is suitable for use with the test methods described herein.
Figure 14:
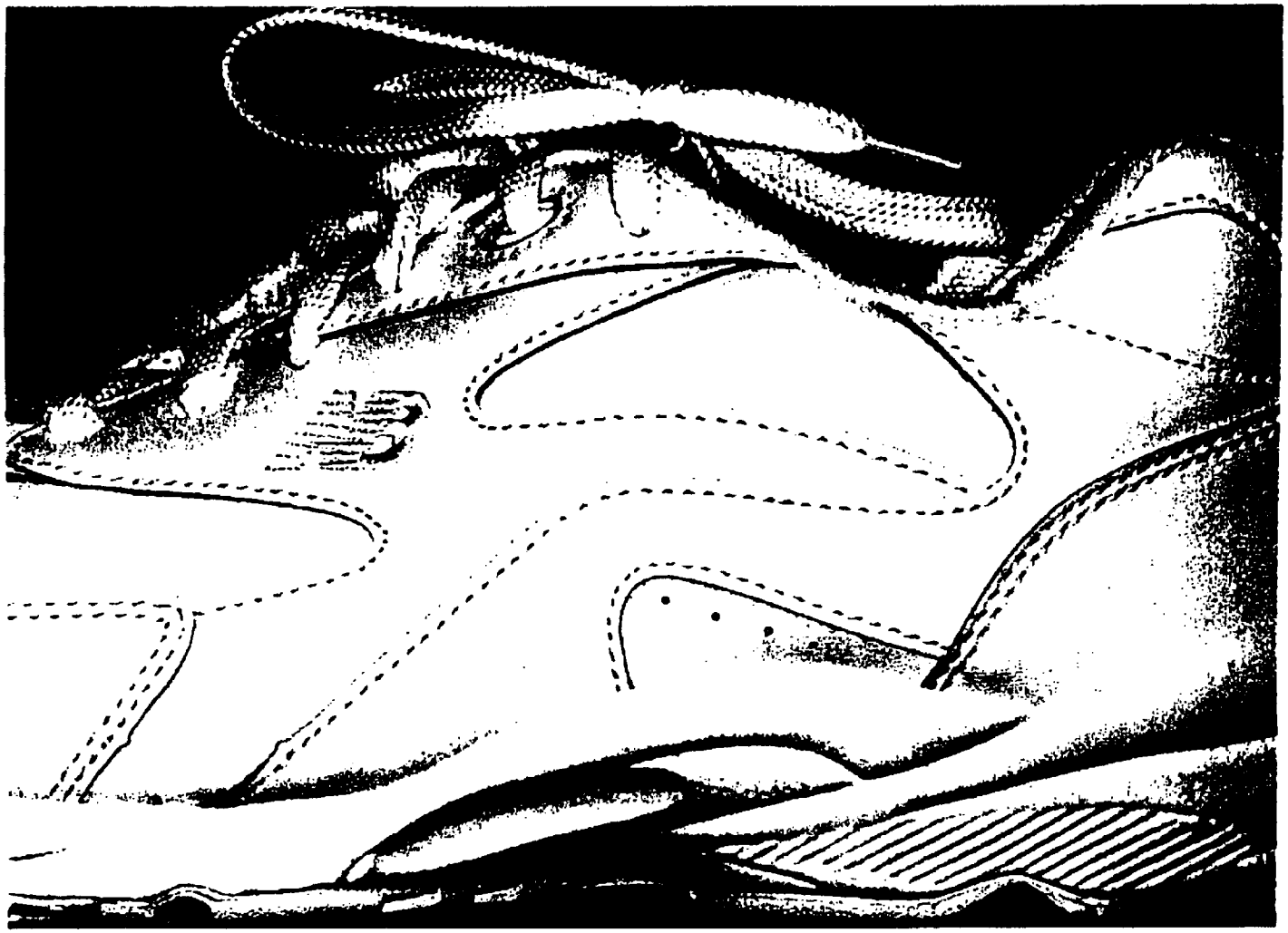
FIG. 14 is an enlarged photograph of the men's athletic of FIG. 13, illustrating a seam wherein the seam stitching is offset from the edge of the seam.
Figure 15:
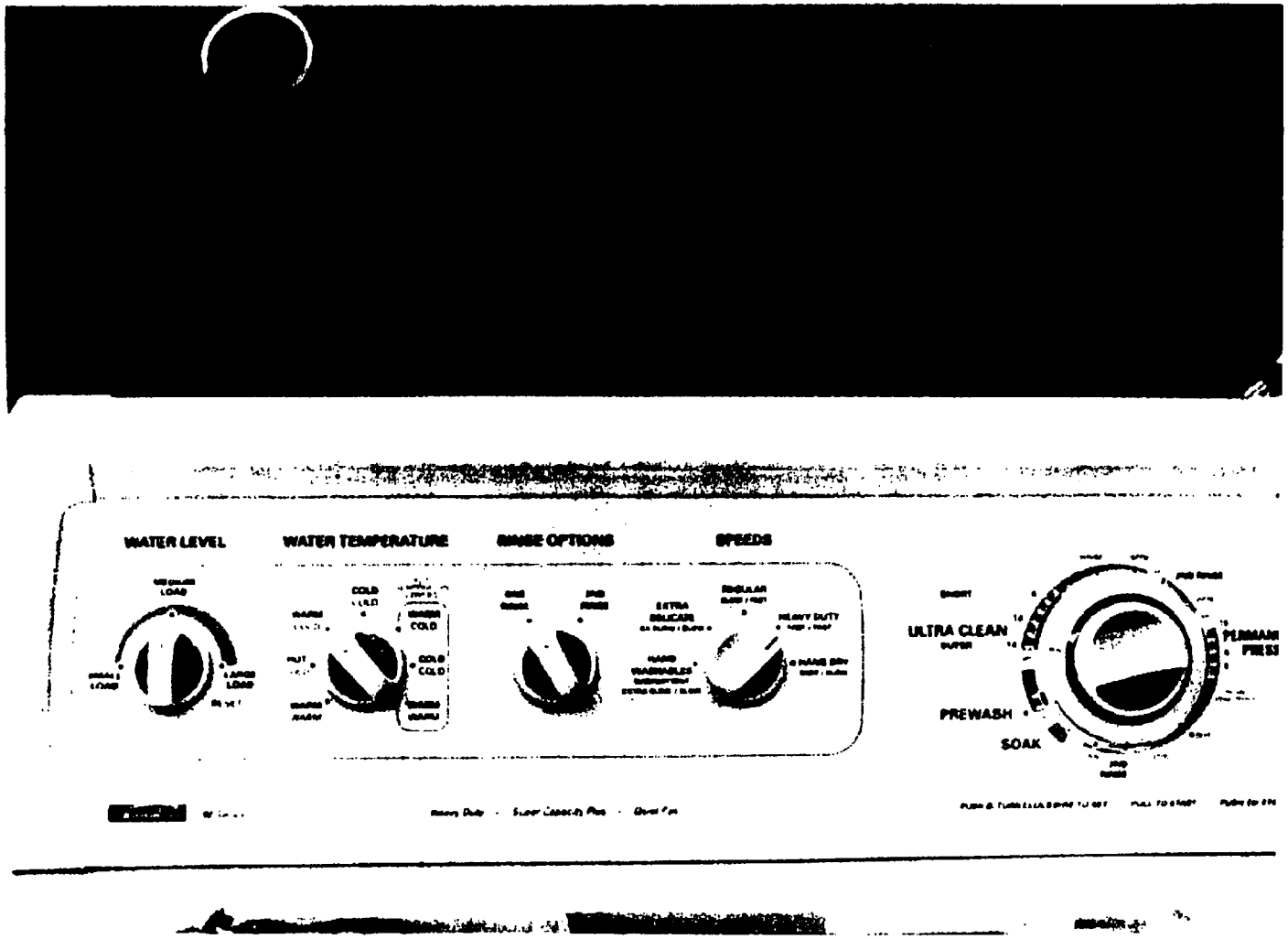
FIG. 15 is a photograph of the upper portion of a washing machine which is suitable for use with the test methods described herein.

The following procedures are applied to a men's shoe Model CMW435W manufactured by the New Balance Company of Boston, Mass. An example of this shoe is illustrated in FIG. 13. The shoe weighs approximately 382 gms when dry and is a US men's size 10.5, width 4E (hereinafter the "sample shoe"). The sample shoe has a white leather and synthetic painted upper and a synthetic sole. The shoe has at least one seam extending across at least a portion of the side wall of the sample shoe, wherein the seam stitching is offset from the edge of the seam, as best seen in FIG. 14. The sample shoe has a sockliner disposed about its interior heel opening. Shoes will be referred to herein as either right (i.e., for the right foot) or left (i.e., for the left foot) and medial wall of the shoe (i.e., adjacent the medial portion of the foot) or the lateral wall of the shoe (i.e., adjacent the lateral portion of the foot). The following procedures are also applied using a top load Kenmore Super Capacity Plus Automatic washing machine Model No. Series 90 manufactured by the Sears Roebuck and Company of Illinois (hereinafter the "test washing machine"). An example of the test washing machine is illustrated in FIG. 15. While these procedures are applied herein using the above-described sample shoe and test washing machine, these procedures can be applied using sample shoes and washing machines which are similar to those described herein. For example, a similar shoe is any shoe having similar weight and size and which has at least one side seam, a sockliner, and a painted leather and/or synthetic upper. A similar washing machine is any washing machine which is a top load washing machine having similar wash volume, agitation, and spin characteristics as those described hereafter.

Wash Cycles

A first sample shoe, which has not been previously washed, is placed in the test washer along with three ballast shoes. The ballast shoes are preferably any shoe having a similar weight and size to the first sample shoe. Most preferably, the ballast shoe is the same shoe type as the first sample shoe. The sample shoe and the ballast shoes are preferably spaced equidistant from one another in the tub of the test washing machine such that one of the ballast shoes is disposed beneath the washing tub water discharge. The test washing machine is set for a medium load using the wash level selection dial and an agitation speed of heavy duty is set using the speed selection dial. A medium wash load has a water volume of about 64 liters. The agitation speed for heavy duty is about 180 spins per minute, wherein a spin is one turn of the agitator in a clockwise direction. The wash cycle includes a spin portion at about 640 rpm and a single rinse. The total time for the wash cycle from beginning of the washer fill to completion of the last spin is about 40 minutes, as follows:

1. water fill (about 5 minutes for 64 liters);
2. wash cycle (about 14 minutes with agitation in clockwise direction only at about 180 spm);
3. water draining (about 2 minutes);
4. spin cycle (about 2 minutes at about 640 rpm);
5. rinse water fill (about 5 minutes for 64 liters);
6. rinse cycle (about 4 minutes with agitation in clockwise direction only at about 180 spm);
7. water draining (about 2 minutes); and
8. spin cycle (about 6 minutes at about 640 rpm).

Figure 16:
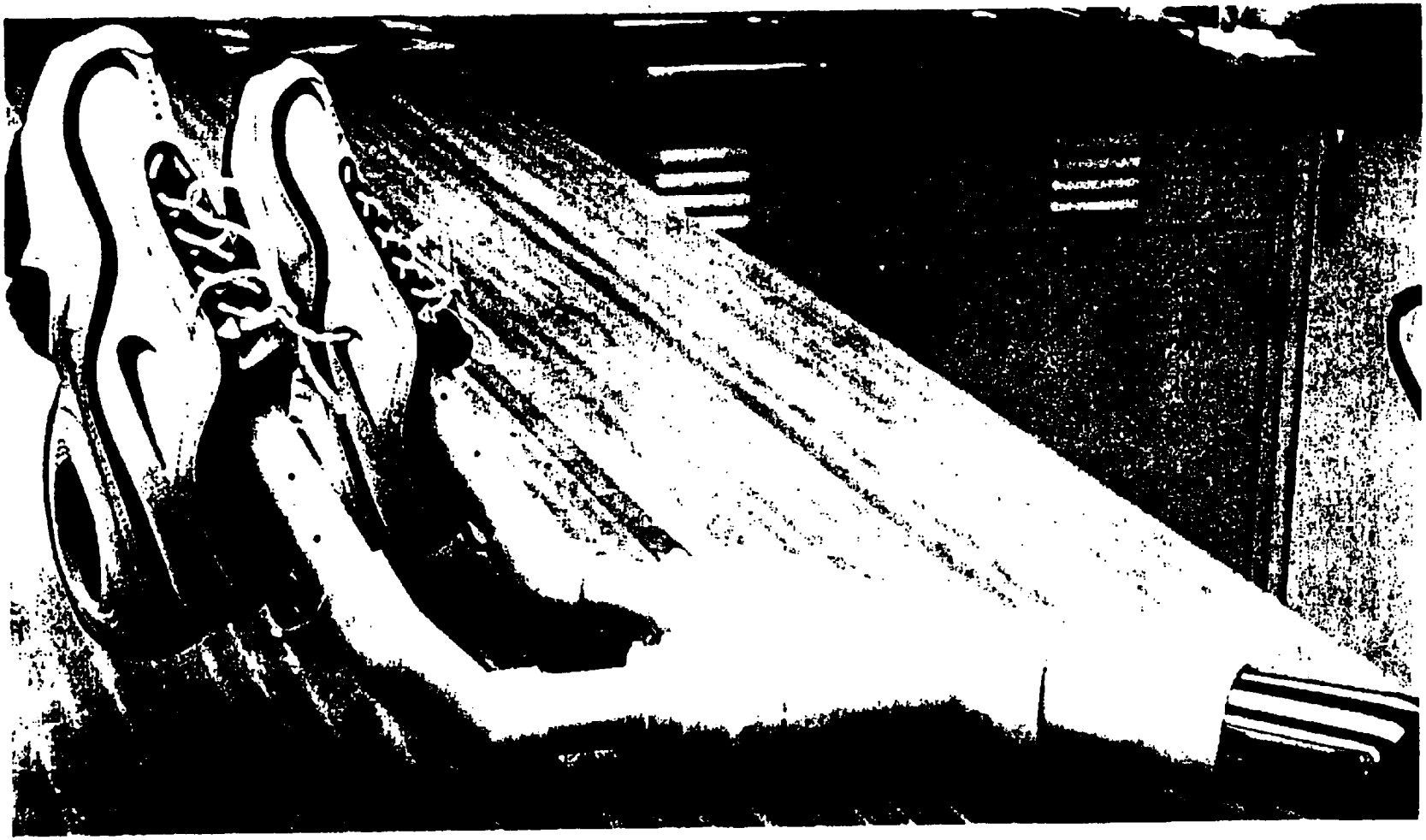
FIG. 16 is photograph of a system for drying shoes in accordance with the test methods described herein.

The water is preferably standard public supplied water, without any detergent or surfactant additives, and at a water temperature of between about 20 C. and about 30 C. The first sample shoe is washed for fifteen wash cycles at the above-specified conditions, with a dry cycle between each wash cycle. As used herein, the phrase "wash cycle" is intended to refer to the aggregate of the cycles 1 to 8 described above at the designated washer medium load conditions. As used herein, the phrase "dry cycle" is intended to refer to a cycle wherein the first sample shoe is dried using a heating apparatus, such as a hair dryer type apparatus. As shown in FIG. 16, a pipe 80 is interconnected between the dryer apparatus 82 and the first sample shoe 84, wherein the discharge end 86 of the pipe 80 is disposed within the heel opening of the first sample shoe 84. The first sample shoe is dried preferably using a low heat and high air setting for sixty minutes. A preferred drying apparatus is a PRO AIR™ hair dryer having a wattage of 1875W and manufactured by Remington, Inc. of Connecticut. The airflow rate at the discharge end 86 of the pipe 80 is preferably about 305 meters/minute. An irreversible temperature strip can be attached to the inside toe portion of the first sample shoe to monitor the shoe temperature. An exemplary temperature strip is manufactured by the Cole Palmer Instrument Company of Vernon Hills, Ill. and is catalog no. 08068-20 having a range between about 37C. to about 65C. During the drying cycle, the shoe temperature is preferably indicated to be a maximum of about 44C.

After completion of the fifteen wash and dry cycles for the first sample shoe, a second sample shoe which has not been previously washed machine is placed inside of a shoe bag, the combination of which is then placed in the test washer along with three ballast shoes as previously described. The ballast shoe must be the same type of ballast shoe as previously used with the first sample shoe. Fifteen wash and dry cycles are completed at the same previously described wash and dry cycle conditions.

After completion of the fifteen wash and dry cycles for the first and second sample shoes, these shoe samples can be analyzed according to the following procedures to determine the Relative Sockliner Fibrillation and the Relative Seam Abrasion of the subject shoe bag.

Sockliner Fibrillation Procedure

Figure 17:
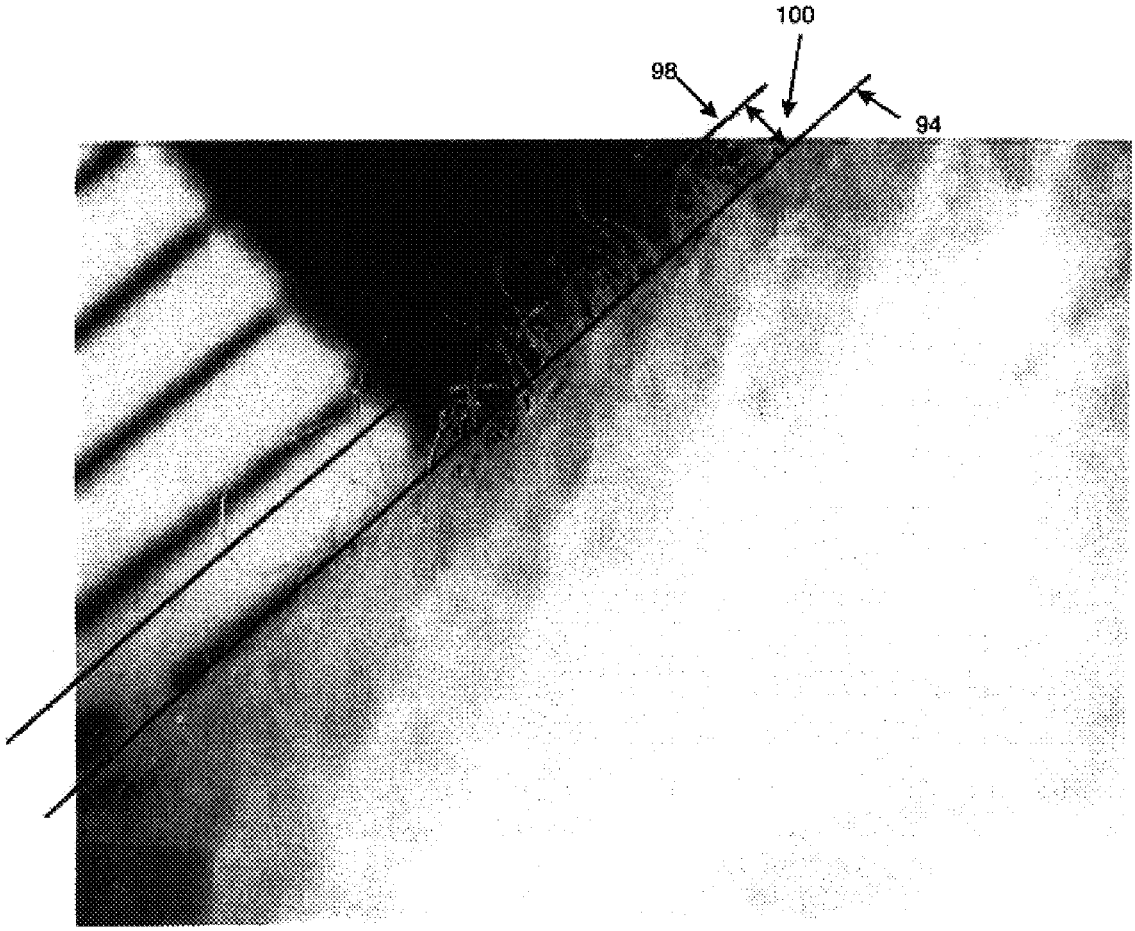
FIG. 17 is a photograph of a portion of a sockliner of an athletic shoe, wherein first and second lines have been drawn across a portion of the sockliner in accordance with the Sockliner Fibrillation Procedure.

This procedure is used to determine the Relative Sockliner Fibrillation of a shoe bag. Each sockliner of the first and second sample shoes is visually inspected using a magnification device, such as a Compact Micro Vision System, model no. KH2200 MD2, manufactured by HiRox, Inc. of Tokyo, Japan. A MX2010Z lens with an AD-2010H lens attachment can be used to provide a magnification between about 1× and about 200×, wherein the exact magnification is selected to bring the fibrils of the sockliners into view. While different magnifications may be necessary for each of the sockliners of the first and second sample shoes, the measurements and ratios herein are based upon the same scale. Each sockliner is individually visually inspected under the selected magnification and a representative portion is chosen for each sockliner where the greatest number of fibrils have formed (i.e., the highest fibril density) and where the majority of the fibril heights are neither the highest nor the lowest heights of the sockliner. After selection of the representative area for each sample shoe, photomicrographs are taken for the selected representative areas. Referring to FIG. 17, a first line 94 is drawn across the majority of the fibril bases for each selected representative area and a second line 98, parallel to the first line 94, is drawn for each selected representative area at the point where about 90% of the fibrils within the representative area have a height between the first line 94 and the second line 98. The distance 100 between the first and second lines is measured for each representative area. The Relative Sockliner Fibrillation is the percent difference between distance 100 of the first sample shoe and the distance 100 of the second sample shoe divided by the distance 100 of the first sample shoe. The Relative Sockliner Fibrillation is preferably at least about 10% and, more preferably, is between about 40% and about 85%. Most preferably, the Relative Sockliner Fibrillation is between about 60 % and about 100%.

The following are illustrative examples of application of the Relative Sockliner Fibrilation procedure:

EXAMPLE 1

Figure 18:
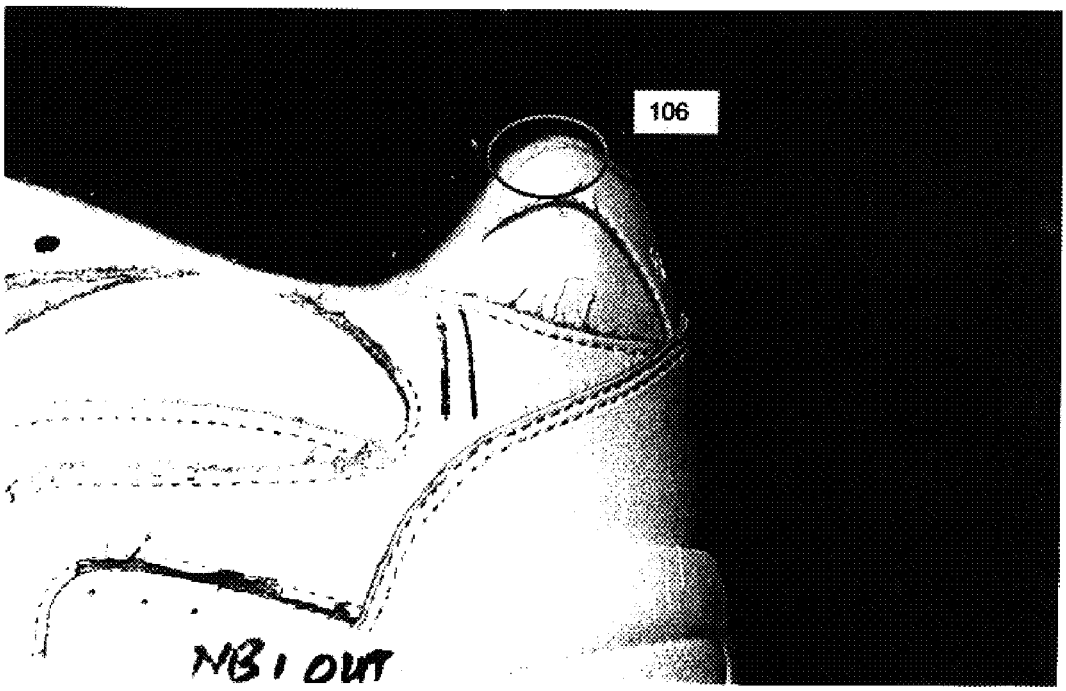
FIG. 18 is a photograph of a portion of the lateral side wall of the first sample shoe of Example 1.
Figure 19:
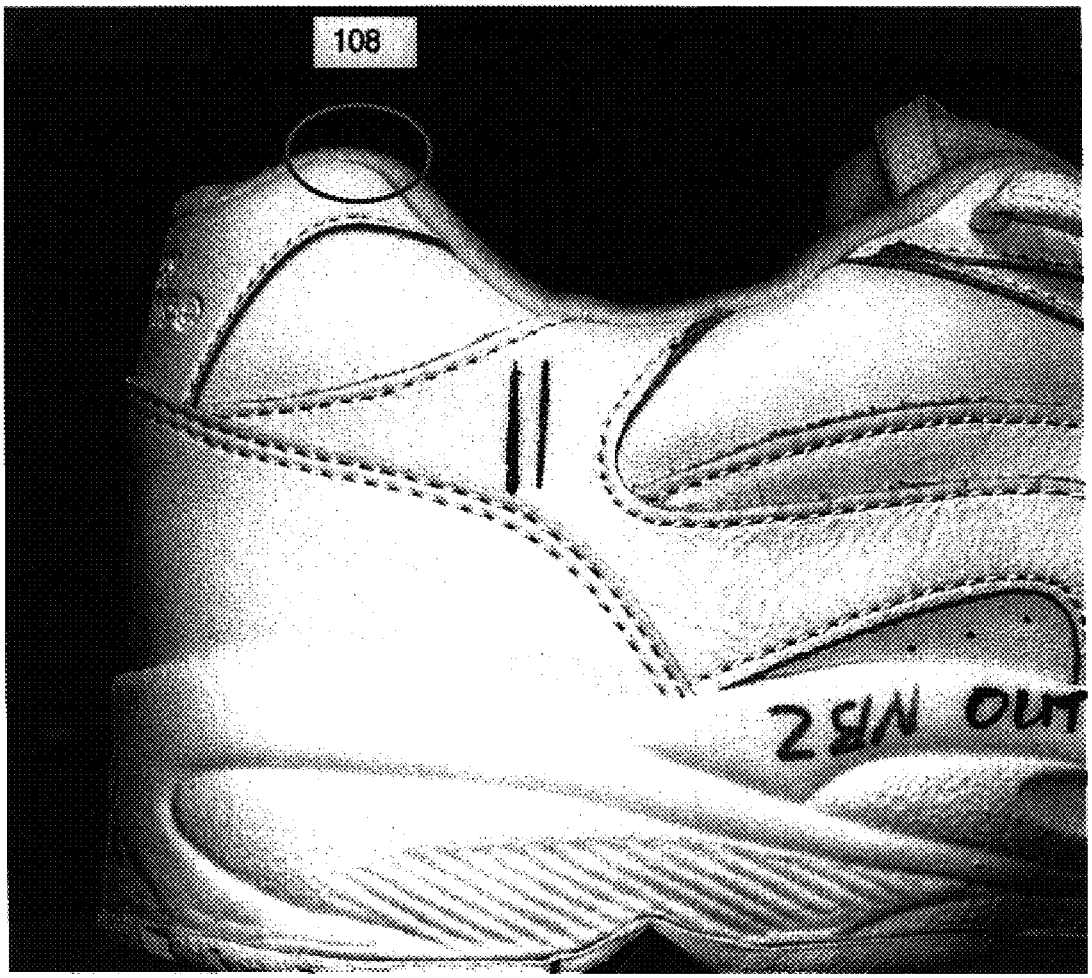
FIG. 19 is a photograph of a portion of the lateral side wall of the second sample shoe of Example 1.
Figure 20:
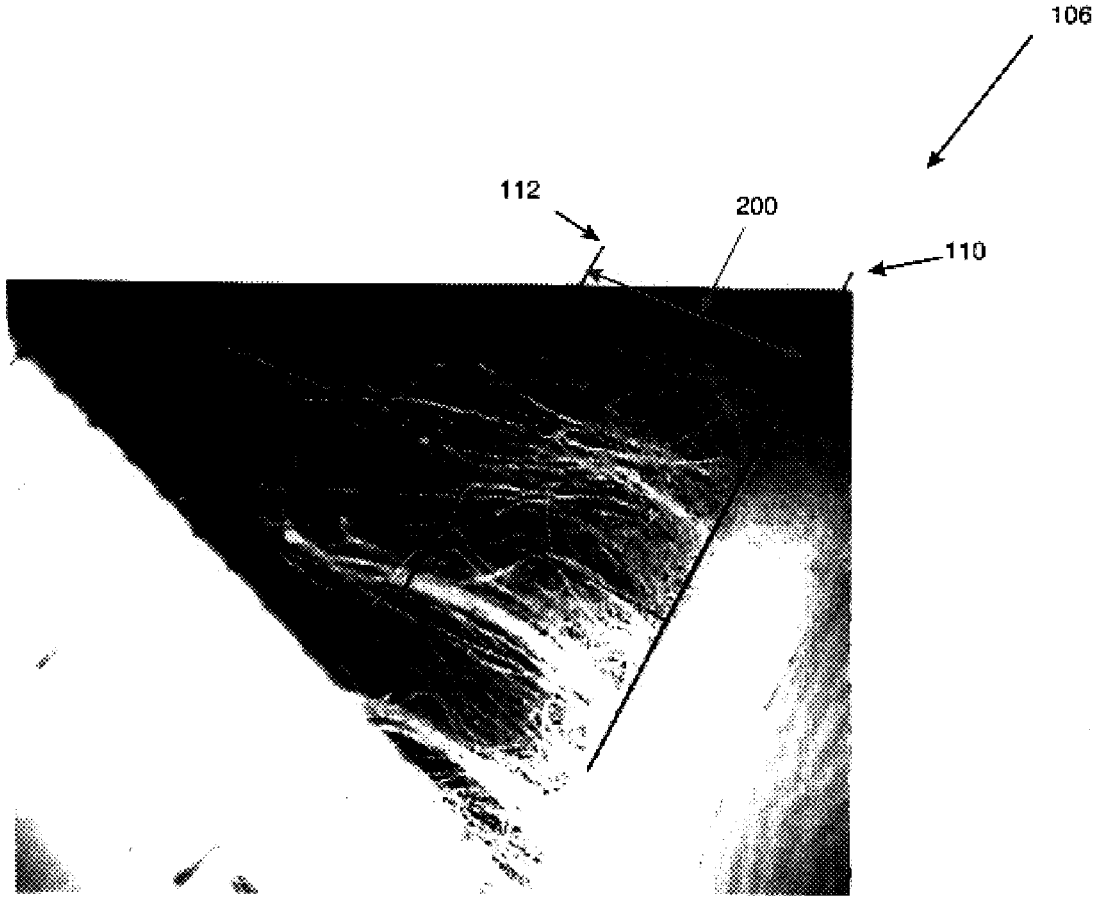
FIG. 20 is a photograph of a portion of the sockliner of the first sample shoe of FIG. 18, wherein first and second lines have been drawn across the sockliner portion in accordance with the Sockliner Fibrillation Procedure.
Figure 21:
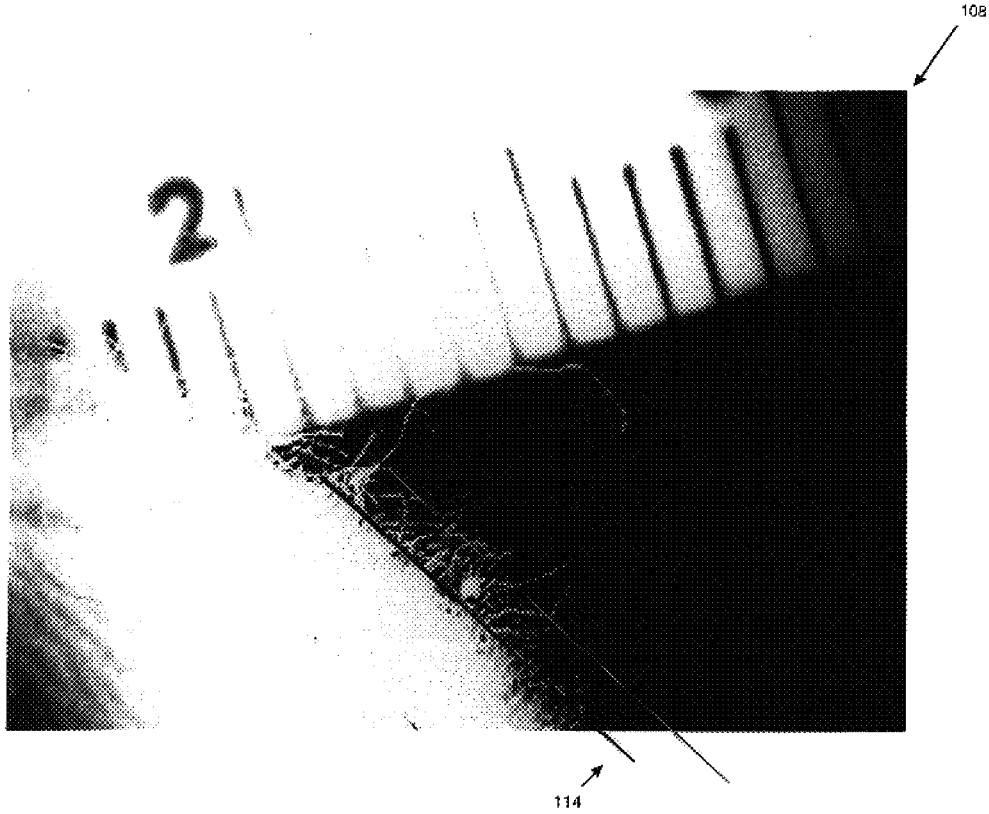
FIG. 21 is a photograph of a portion of the sockliner of the second sample shoe of FIG. 19, wherein first and second lines have been drawn across the sockliner portion in accordance with the Sockliner Fibrillation Procedure

Referring to FIGS. 18 to 21, a left (the first sample shoe) and right (the second sample shoe) men's shoe Model CMW435W manufactured by the New Balance Company of Massachusetts were washed in a top load Kenmore Super Capacity Plus Automatic washing machine Model No. Series 90 manufactured by the Sears Roebuck and Company of Illinois for fifteen wash and dry cycles according to the conditions previously described. FIG. 18 is a side view of the lateral side wall of the first sample shoe while FIG. 19 is a side view of the lateral side wall of the second sample shoe which completed fifteen wash cycles in a shoe bag made in accordance with the present invention. The sockliner of the first and second sample shoes were visually inspected, using a Compact Micro Vision System, model no. KH2200 MD2, manufactured by HiRox, Inc. of Tokyo, Japan, for a representative section as previously described. Representative section 106 of the first sample shoe was selected and the same representative section 108 of the second sample shoe was identified. Referring to FIGS. 20 (first sample shoe) and 21 (second sample shoe), first and second lines 110 and 112 were drawn through the representative section 106 for the first sample shoe while first and second lines 114 and 116 were drawn through the representative section 108 for the second sample shoe. The distance 200 for the representative section 106 of the first sample shoe was 4.8 mm while the distance 300 for the representative section 108 of the second sample shoe was 1.4 mm. The Relative Sockliner Fibrillation was therefore about 71%. In other words, the fibrils of the first sample shoe had about a 71% increase in average fibril height versus the sockliner fibrils of the second sample shoe which were protected by the shoe bag made in accordance with the present invention.

EXAMPLE 2

Figure 22:
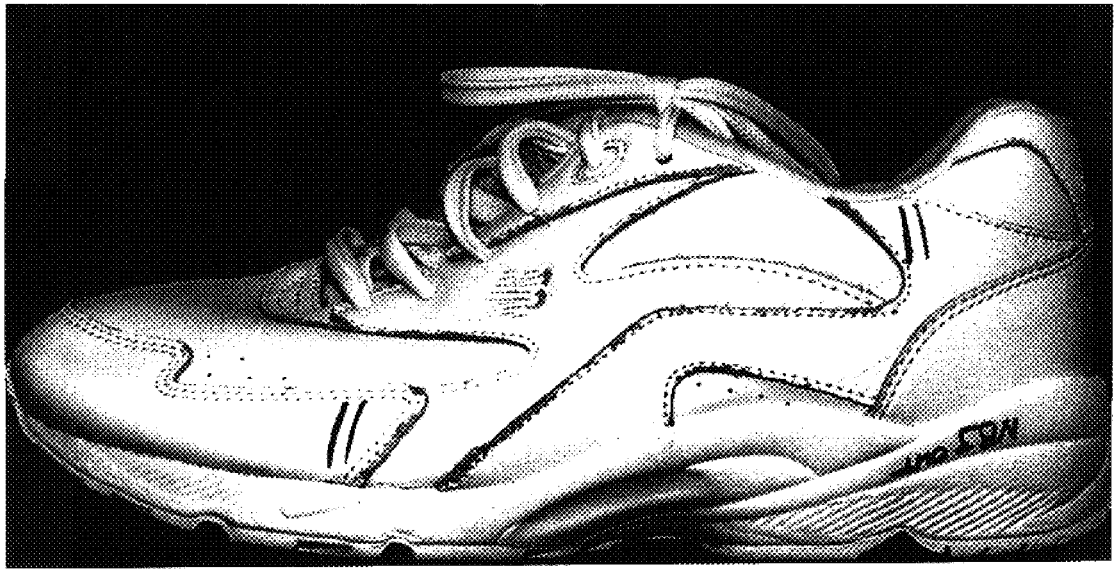
FIG. 22 is a photograph of the lateral side wall of the first sample shoe of Example 2.
Figure 23:
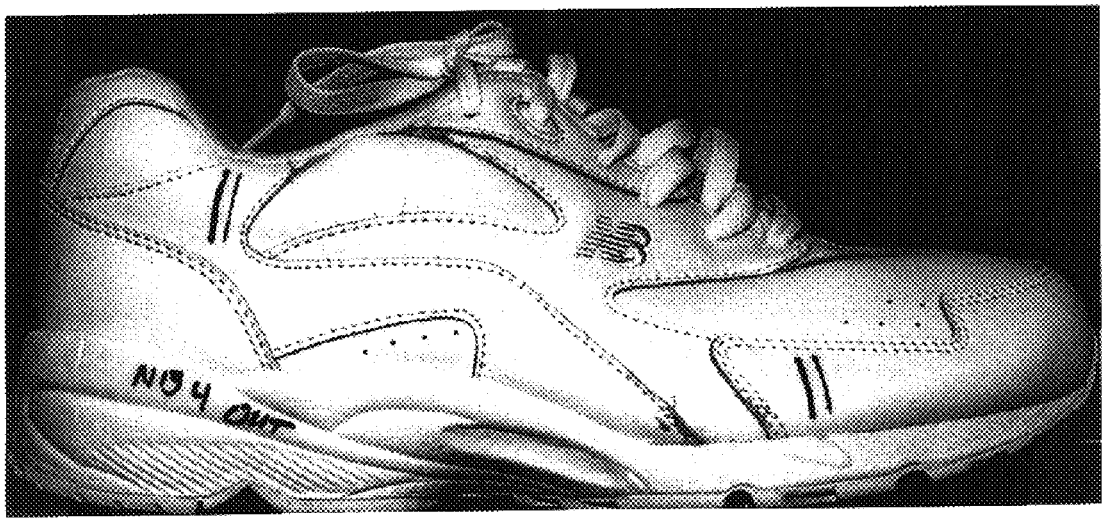
FIG. 23 is a photograph of the lateral side wall of the second sample shoe of Example 2.
Figure 24:
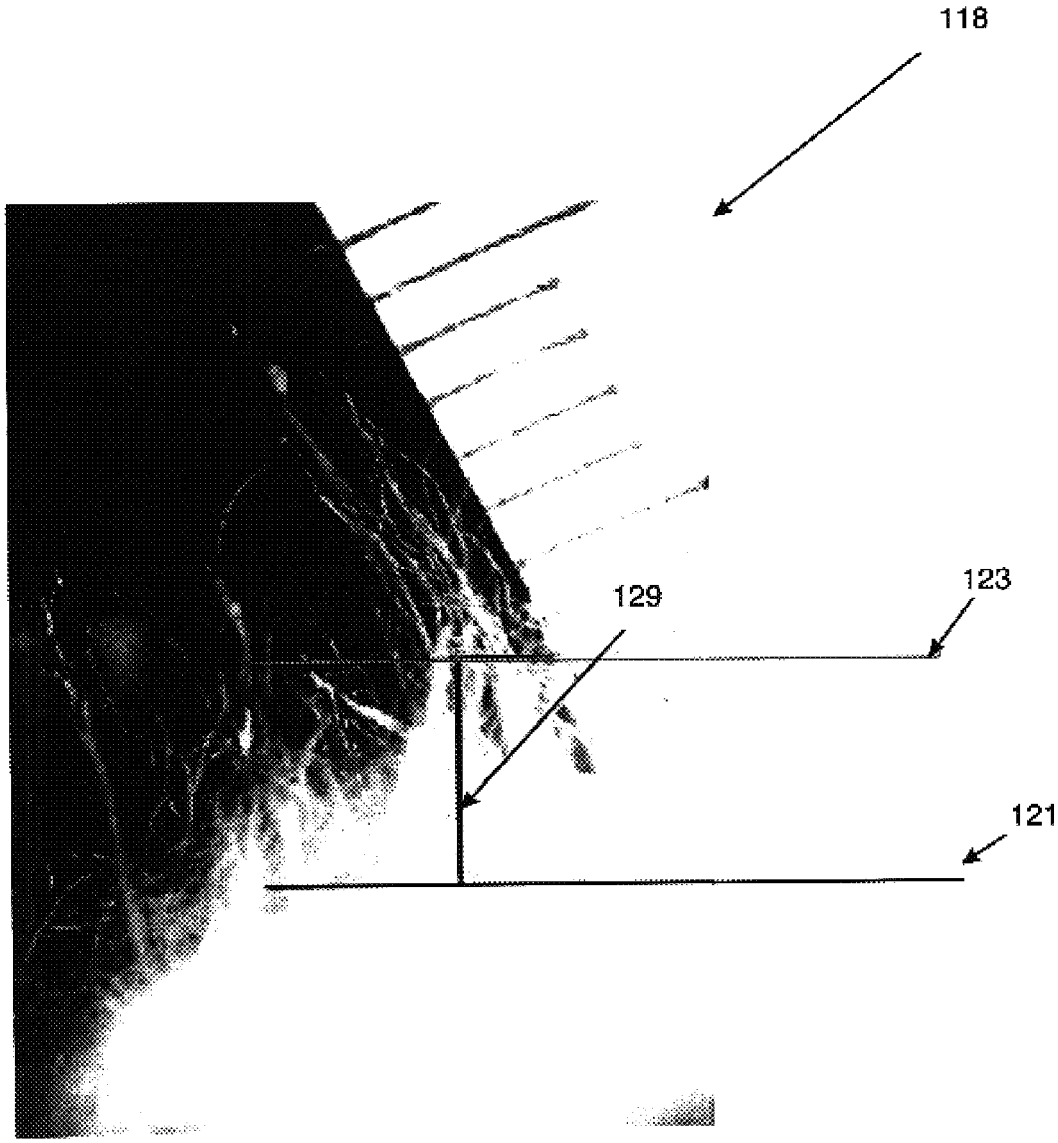
FIG. 24 is a photograph of a portion of the sockliner of the first sample shoe of FIG. 22, wherein first and second lines have been drawn across the sockliner portion in accordance with the Sockliner Fibrillation Procedure.
Figure 25:
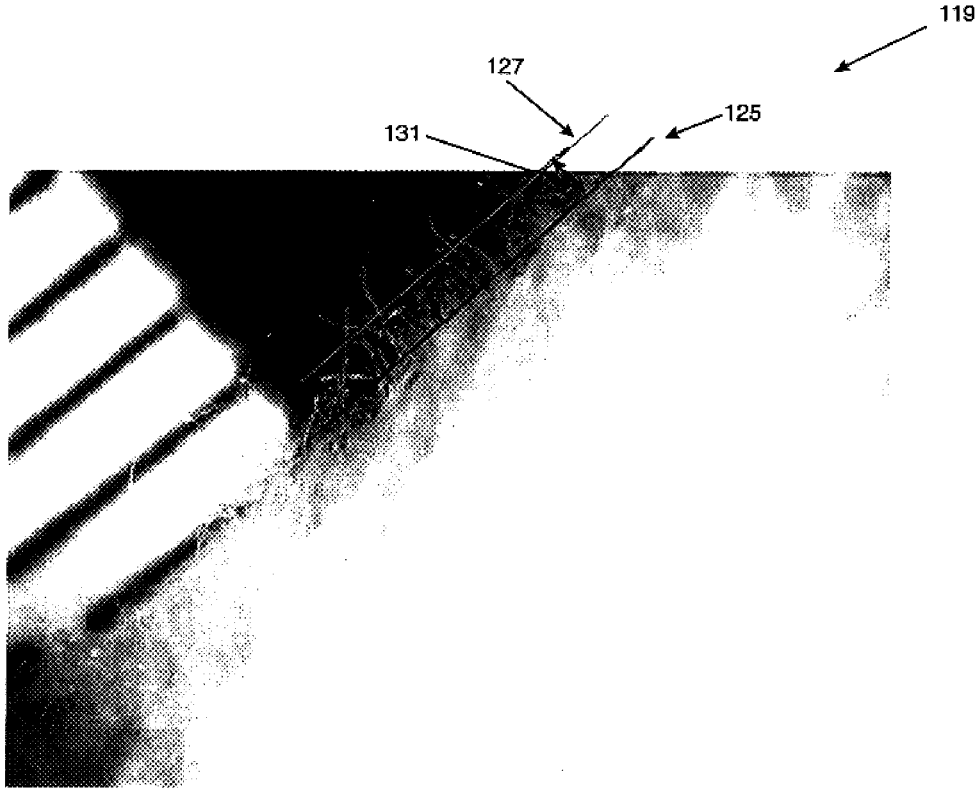
FIG. 25 is a photograph of of a portion of the sockliner of the first sample shoe of FIG. 23, wherein first and second lines have been drawn across the sockliner portion in accordance with the Sockliner Fibrillation Procedure.

Referring to FIGS. 22 to 25, a left (the first sample shoe) and right (the second sample shoe) men's shoe Model CMW435W manufactured by the New Balance Company of Massachusetts were washed in a top load Kenmore Super Capacity Plus Automatic washing machine Model No. Series 90 manufactured by the Sears Roebuck and Company of Illinois for fifteen wash and dry cycles according to the conditions previously described. FIG. 22 is a side view of the lateral side wall of the first sample shoe while FIG. 23 is a side view of the lateral side wall of the second sample shoe which completed fifteen wash cycles in a shoe bag made in accordance with the present invention. The sockliners of the first and second sample shoes were visually inspected, using a Compact Micro Vision System, model no. KH2200 MD2, manufactured by HiRox, Inc. of Tokoyo, Japan, for a representative section as previously described. Representative section 118 of the first sample shoe was selected and the same representative section 119 of the second sample shoe was correspondingly identified. Referring to FIG. 24 (first sample shoe) and 25 (second sample shoe), first and second lines 121 and 123 were drawn through the representative section 118 for the first sample shoe while first and second lines 125 and 127 were drawn through the representative section 119 for the second sample shoe. The distance 400 for the representative section 118 of the first sample shoe was 3.7 mm while the distance 500 for the representative section 119 of the second sample shoe was 0.6 mm. The Relative Sockliner Fibrillation was therefore about 84%. In other words, the fibrils of the first sample shoe had about a 84% increase in average fibril height versus the sockliner fibrils of the second sample shoe which were protected by the shoe bag made in accordance with the present invention.

Seam Abrasion Procedure

Figure 26:
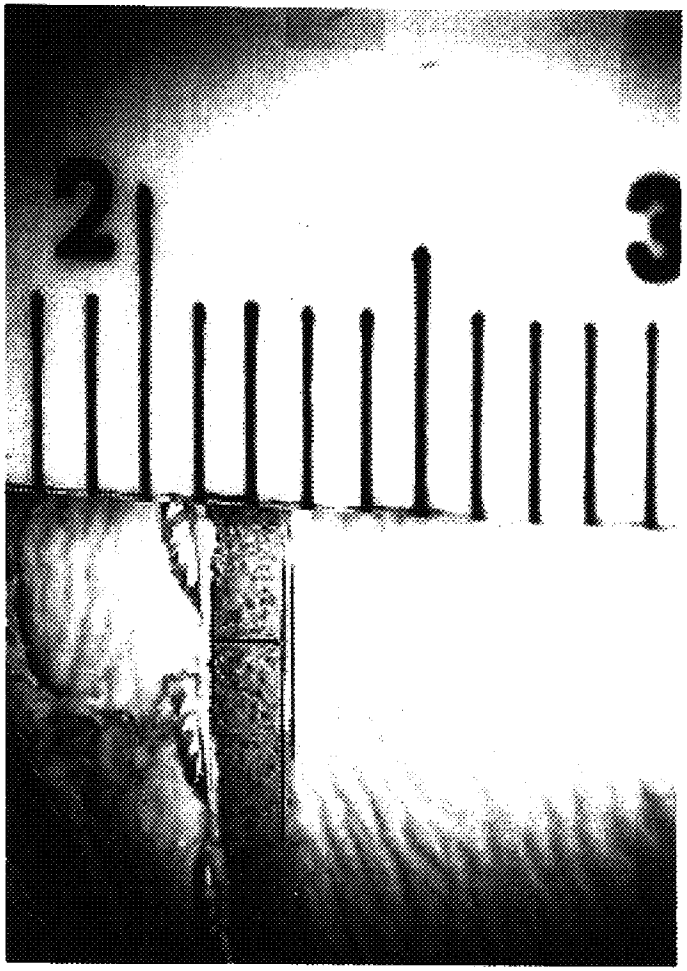
FIG. 26 is a photograph of exemplary seam abrasion of a synthetic portion of a shoe.
Figure 27:
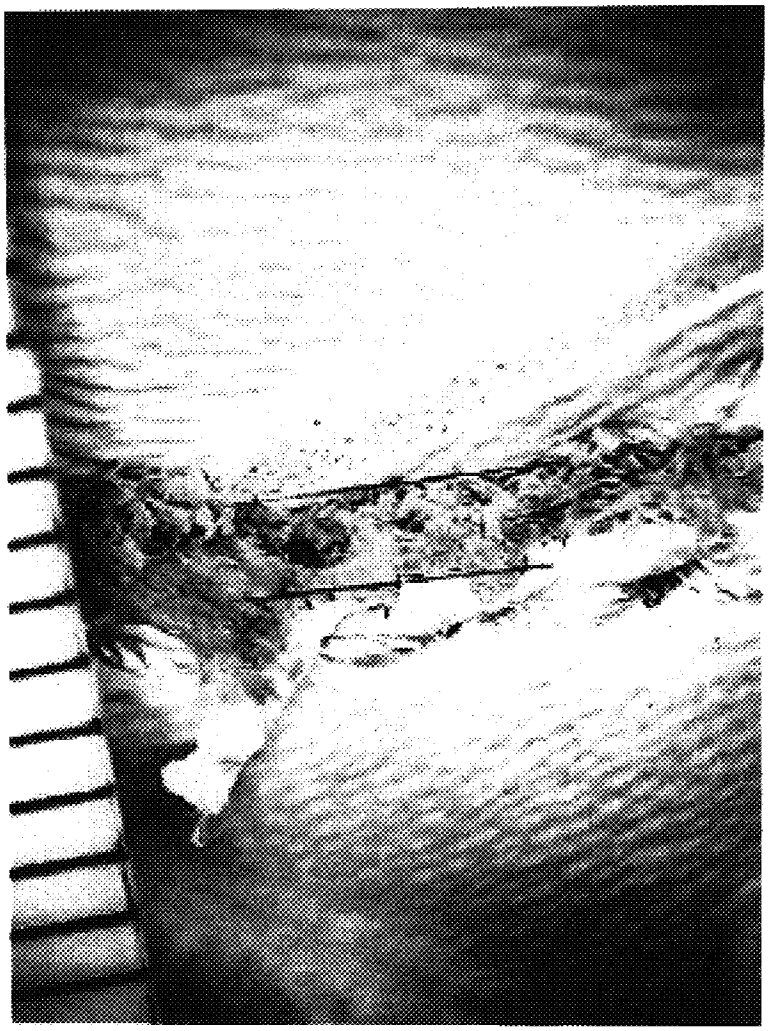
FIG. 27 is a photograph of exemplary seam abrasion of a leather portion of a shoe.

This procedure is used to determine the Relative Seam Abrasion of a shoe bag. The side seams of the lateral side wall of a first sample shoe are visually inspected and the side seam having the longest total length of abrasion is selected (hereinafter the "abraded seam") and the length of total abrasion of this seam is measured. As used herein, the term "abrasion" is intended to refer to cracking or loss of paint from the leather or synthetic material. Examples of such abrasion are illustrated in FIGS. 26 and 27. The same lateral side seam as selected from the first sample shoe is inspected at the second sample shoe and the total length of any abrasion within the corresponding seam of the second sample shoe is measured. The Relative Seam Abrasion is the difference between total length of the abrasion of the first sample shoe and the corresponding total length of abrasion, if any, of the second sample shoe divided by the total length of abrasion of the first sample shoe. The Relative Seam Abrasion is preferably at least about 10% and, more preferably, is between about 50% and about 90%. Most preferably, the Relative Seam Abrasion is between about 70% and about 100%.

The following are illustrative examples of application of the Relative Seam Abrasion procedure:

EXAMPLE 3

Figure 28:
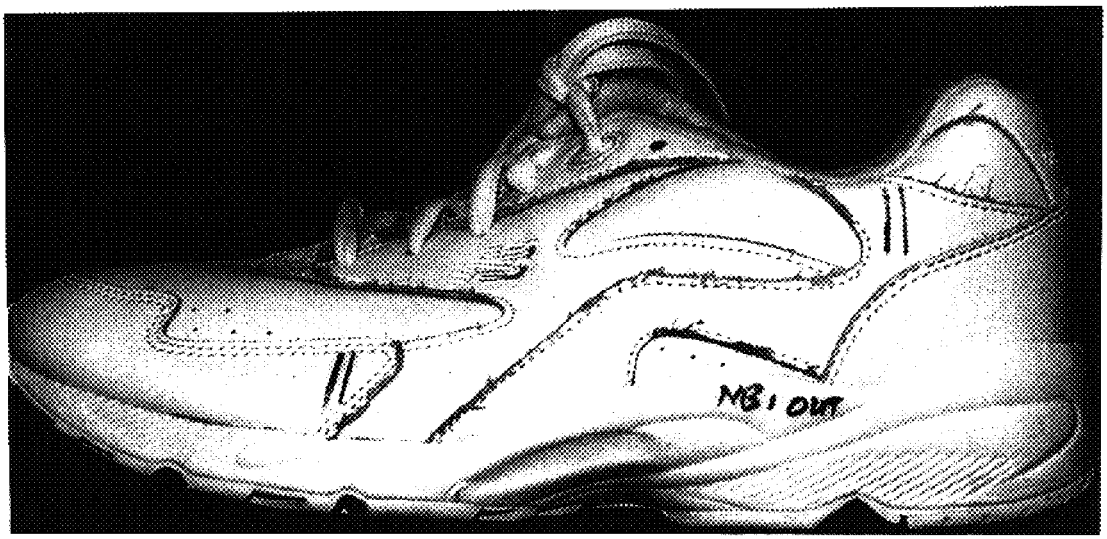
FIG. 28 is a photograph of the lateral side wall of the first sample shoe of Example 3.
Figure 29:
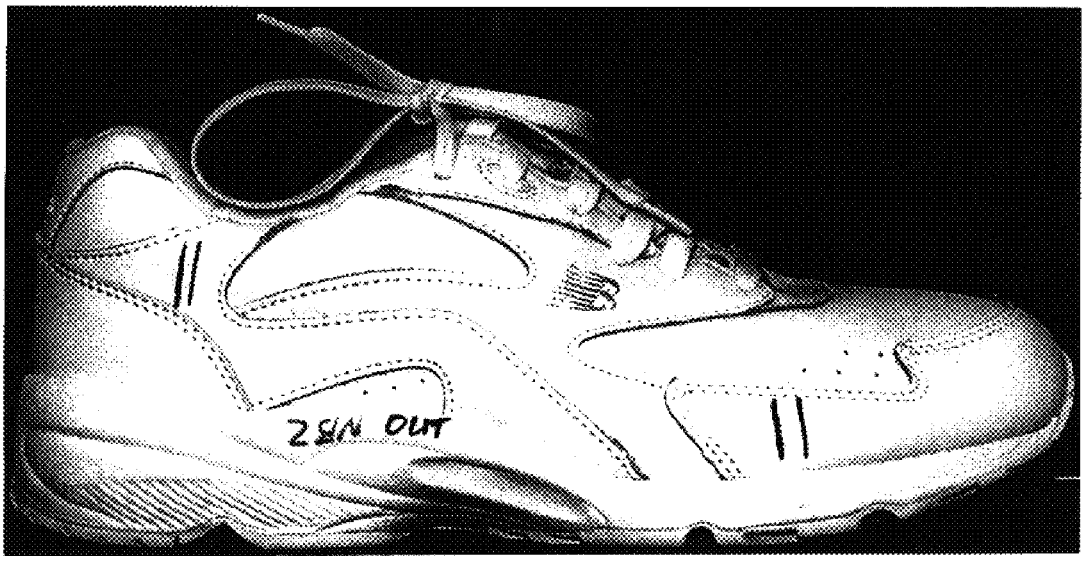
FIG. 29 is a photograph of the lateral side wall of the second sample shoe of Example 3.
Figure 30:
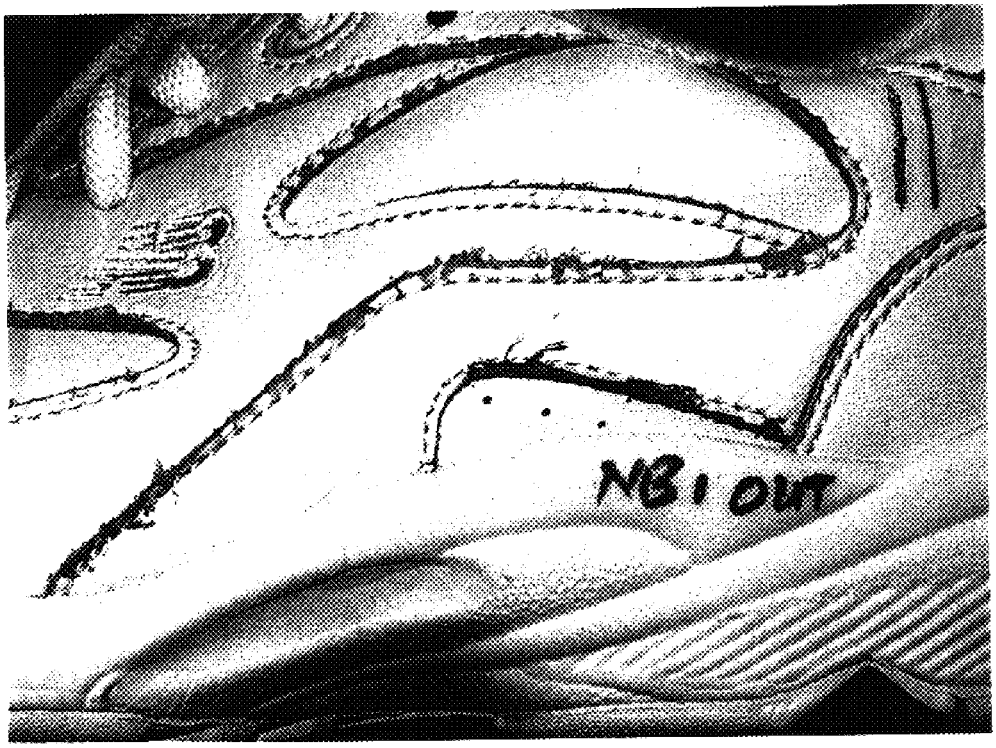
FIG. 30 is a photograph of exemplary abrasion along a seam of the shoe of FIG. 28.
Figure 31:
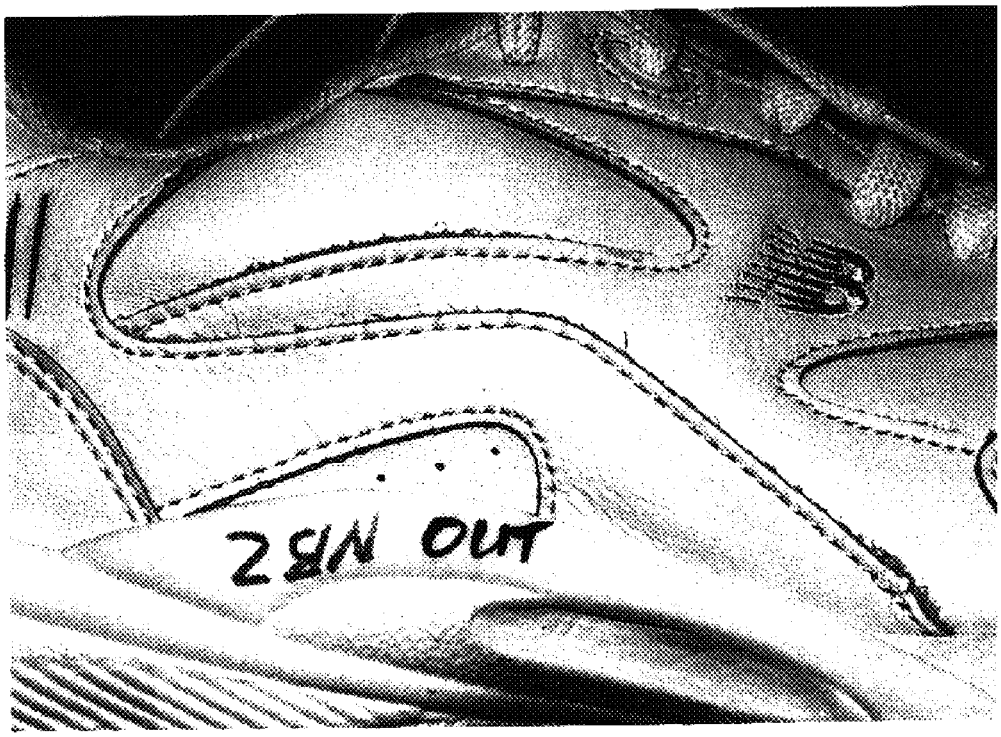
FIG. 31 is a photograph of exemplary abrasion along the corresponding seam of the shoe of FIG. 29.

Referring to FIGS. 28 to 31, the same left (the first sample shoe) and right (the second sample shoe) men's shoes described in Example 1 above were analyzed according to the Relative Seam Abrasion Procedure described herein. FIG. 28 is a side view of the lateral side wall of the first sample shoe while FIG. 29 is a side view of the lateral side wall of the second sample shoe which completed fifteen wash cycles in a shoe bag made in accordance with the present invention. The seam 133 (FIG. 30) was selected as the side seam of the lateral side wall of the first sample shoe which had the longest total length of abrasion and the total length of abrasion was measured to be about 141 mm. The corresponding seam 135 (FIG. 31) was examined on the second sample shoe and the total length of the abrasion was measured to be about 17 mm. The Relative Seam Abrasion was therefore about 88%. In other words, the seam 133 of the first sample shoe had about 88% increase in length of total abrasion versus the total abraded length of the corresponding seam 135 of the second sample shoe which was protected by the shoe bag made in accordance with the present invention.

EXAMPLE 4

Figure 32:
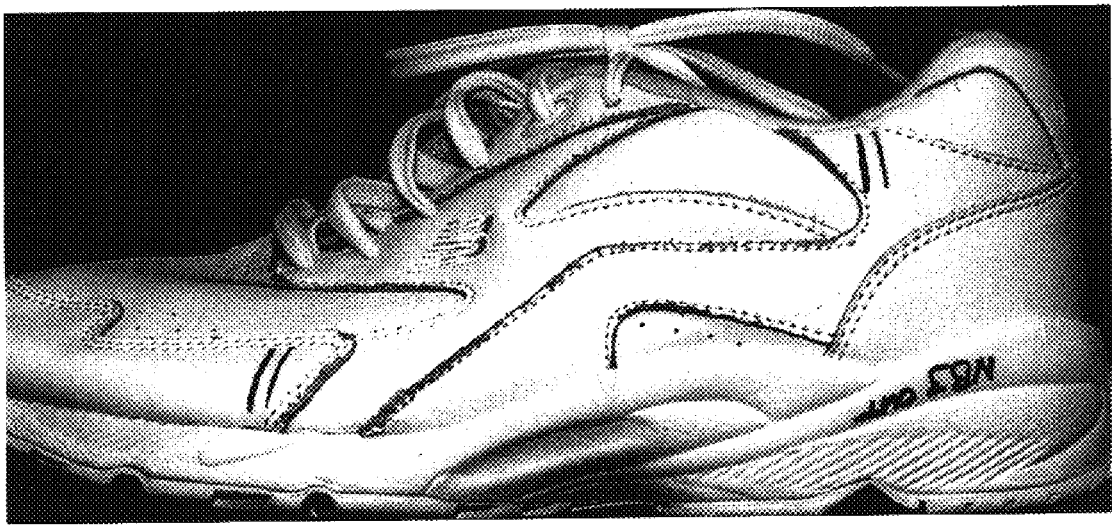
FIG. 32 is a photograph of the lateral side wall of the first sample shoe of Example 4.
Figure 33:
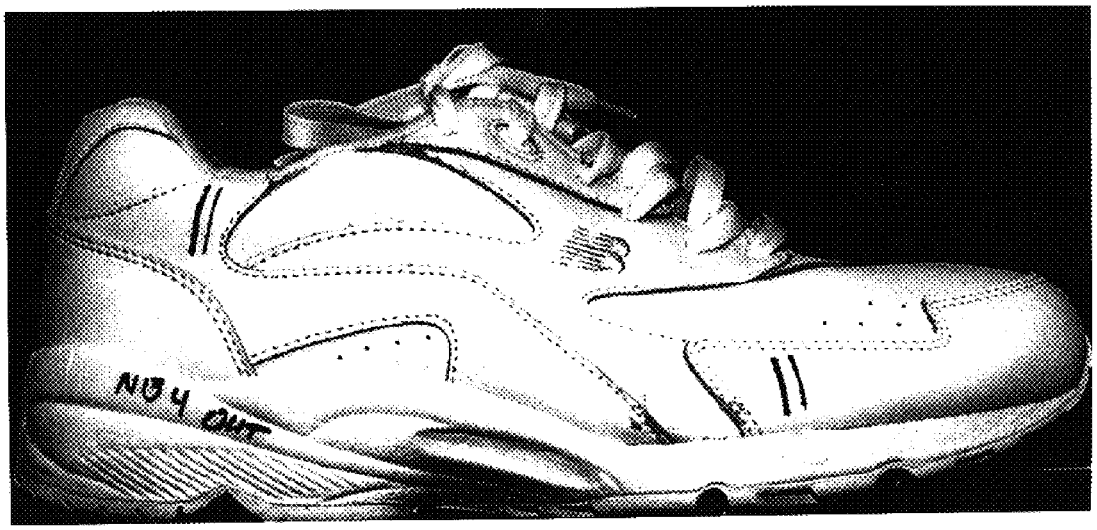
FIG. 33 is a photograph of the lateral side wall of the second sample shoe of Example 4.
Figure 34:
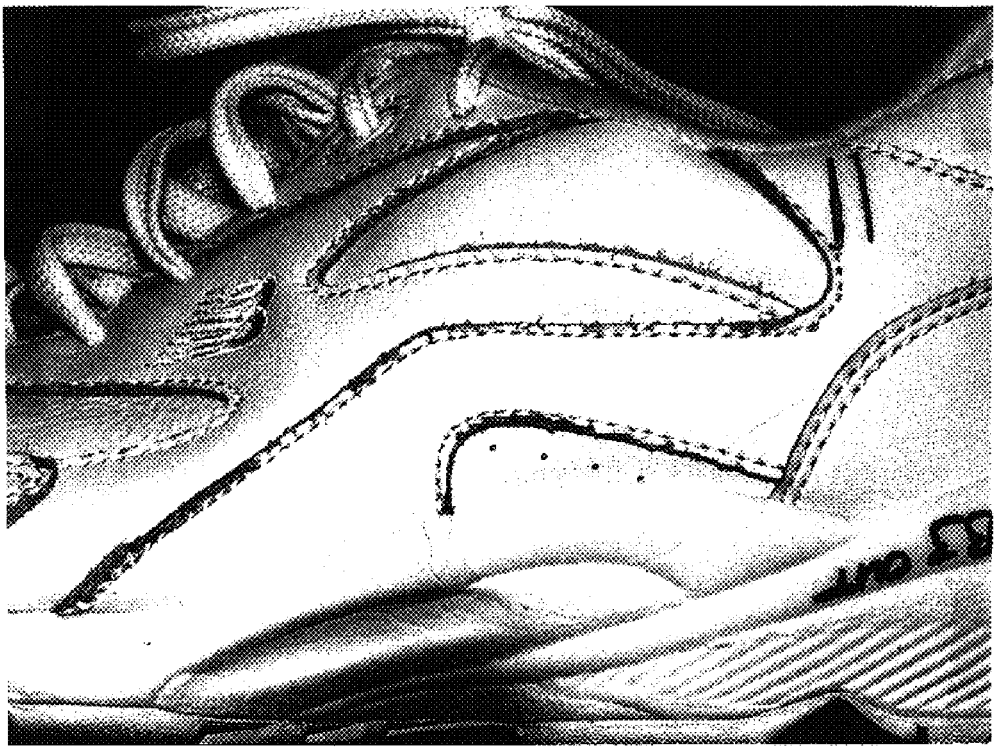
FIG. 34 is a photograph of exemplary abrasion along a seam of the shoe of FIG. 32.
Figure 35:
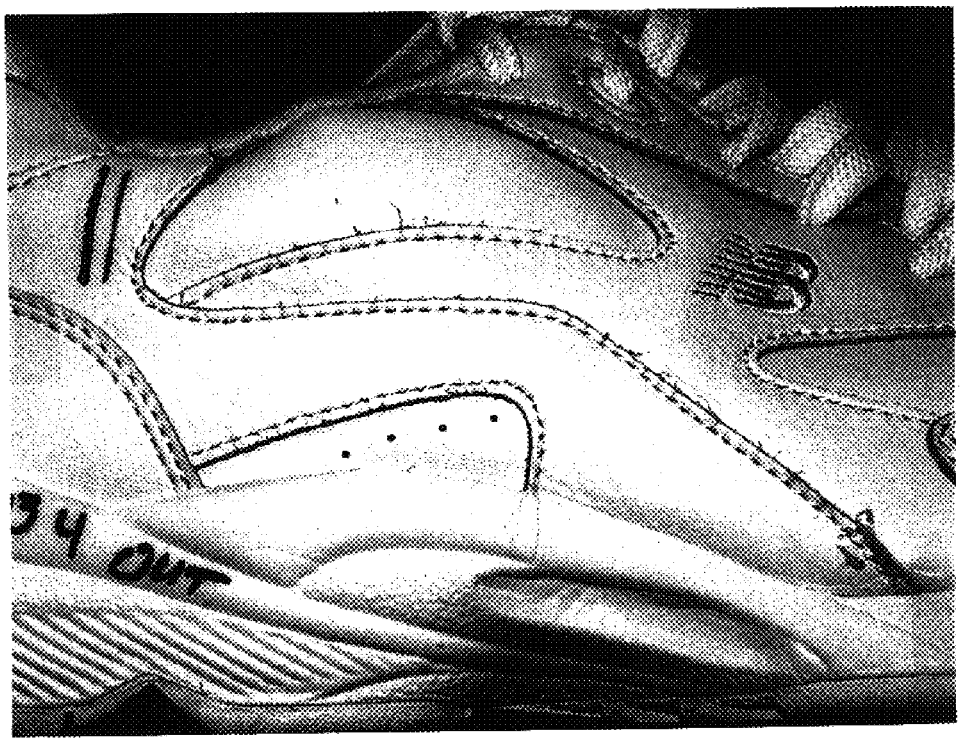
FIG. 35 is a photograph of exemplary abrasion along the corresponding seam of the shoe of FIG. 33.

Referring to FIGS. 32 to 35, the same left (the first sample shoe) and right (the second sample shoe) men's shoes described in Example 2 above were analyzed according to the Relative Seam Abrasion Procedure described herein. FIG. 32 is a side view of the lateral side wall of the first sample shoe while FIG. 33 is a side view of the lateral side wall of the second sample shoe which completed fifteen wash cycles in a shoe bag made in accordance with the present invention. The seam 137 (FIG. 34) was selected as the side seam of the lateral side wall of the first sample shoe which had the longest total length of abrasion and the total length of abrasion was measured to be about 154 mm. The corresponding seam 139 (FIG. 35) was examined on the second sample shoe and the total length of the abrasion was measured to be about 17 mm. The Relative Seam Abrasion was therefore about 89%. In other words, the seam 137 of the first sample shoe had about 89% increase in length of total abrasion versus the total abraded length of the corresponding seam 139 of the second sample shoe which was protected by the shoe bag made in accordance with the present invention.

Product/Instructions

The present invention also encompasses the inclusion of instructions on the use of the benefit agent-containing treating compositions with the packages containing the treating compositions herein or with other forms of advertising associated with the sale or use of the treating compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase of the treating compositions.

The instructions, for instance, may include information relating to the temperature of the wash water, preferably no more than 180° F. (82° C.), more preferably no more than 150° F. (66° C.), most preferably no more than 110° F. (43° C.); washing time; recommended settings on the washing machine; recommended amount of the treating composition to use; pre-treatment procedures; pre-soaking procedures; and spray-treatment procedures. Preferably, under typical U.S. wash conditions in residential and/or consumer equipment, the recommended settings on the washing machine are medium load, heavy duty, 12–14 minutes, warm wash, preferably in the range of from about 40° F. (5° C.) to about 175° F. (80° C.), more preferably from about 50° F. (10° C.) to about 140° F. (60° C.), most preferably from about 60° F. (15° C.) to about 100° F. (40° C.) and cold rinse cycle. For wash conditions other than U.S. wash conditions, preferably the recommended settings on the washing machine are equivalent to the U.S. recommended settings. Preferably, the shoes are set aside to air dry and not dried in a conventional automatic clothes dryer.

A product comprising a benefit agent-containing treating composition, the product further including instructions for using the treating composition to treat a shoe in need of treatment, the instructions including the step of: contacting said shoe with an effective amount of said treating composition for an effective amount of time such that said composition treats said shoe.

The product may be a cleaning composition, a conditioning composition, a disinfecting composition, cleaning/conditioning composition, cleaning/disinfecting composition, conditioning/disinfecting composition, or cleaning/conditioning/disinfecting composition.

Shoe Treatment Kit

The articles of manufacture and flexible containers of the present invention may be packaged together in an outer package to form a shoe treatment kit.

Preferably, a shoe treatment composition in kit form in accordance with the present invention, comprises the following components:

a) an article of manufacture comprising a treating composition for treating one or more shoes comprising one or more benefit agents in a package in association with instructions for use which direct a consumer to apply at least an effective amount of the one or more benefit agents to provide one or more desired benefits to the one or more shoes;

b) a flexible container, preferably reusable flexible container, suitable for holding one or more of the shoes; and c) an outer package containing the components a) and b).

Preferably, the article of manufacture is an applicator in accordance with the present invention, more preferably a brush applicator.

Preferably the flexible container is a bag in accordance with the present invention.

Additionally, an article, such as a benefit agent-impregnated cloth and/or applicator, may be part of the kit. Such an article is particularly useful for post-treatment imparting of one or more desired benefits to one or more shoes. The article could be rubbed or otherwise contacted with the treated shoe after washing the shoe. The post wash wipe or article would be used to deposit various benefit agents on the shoe. These would include but not be limited to Soil Release Agents, waterproofing agents, leather or fabric or plastic treatment agents, antimicrobial agents, shine enhancing ingredients, ingredients designed to improve the appearance of the often painted exterior of athlectic shoe leather. This post wash treatment can also be used, and preferably is used on new and/or clean shoes.

The post wash treatment could applied by any other practical means such sprays, creams, foams, aerosols etc.

A nonlimiting example of a post-treat composition useful for treating one or more shoes in need of treatment comprises:

a) an effective amount of a release agent, preferably a soil release agent, more preferably a mineral oil, such that the one or more shoes are imparted soil release benefits; and b) optionally, but preferably, an effective amount of a film-forming polymer such as hydroxypropylcellulose, such that the post-treat composition is without an oily and/or greasy feel or touch when the post-treat composition is applied to one or more surfaces of the one or more shoes.

The measurement of the greasy feel can be done by qualitative assessment by trained judges. Methods for similar tactile assessments are given in ASTM method E1490-92 which gives a methodology for descriptive skin feel analysis of creams and lotions. In this standard appropriate terms for greasy, oily, and waxy are given.

Alternatively, one may assess the greasy feel through friction measurements of untreated and treated substrates. Some suitable methods for doing this are described in ASTM D4518-91 and G 115-93 and the related articles cited therein.

The following examples are meant to exemplify compositions of the present invention, but are not necessarily meant to limit or otherwise define the scope of the invention. It should also be understood that the amounts and percentages specified in this specification and in the tables below can be rounded if desired, and/or provided in the form of a range which includes the amounts and percentages specified. In addition, any of these amounts and percentages can be considered to be "about" the amounts specified, or "about" the rounded amounts and percentages).

FORMULATION EXAMPLES

EXAMPLE 1

A cleaning agent-containing treating composition in accordance with the present invention, which has a whitening agent therein, can be formulated as follows:

| | % Active Material | | |
|---|---|---|---|
| | Example A | Example B | Example C |
| Acrylic Acid/Maleic Acid Copolymer (1) | 26.2 | 26.8 | 29.4 |
| Nonionic surfactant (2) | 12.6 | 12.8 | 11.6 |
| Tween 20 | 12.6 | 12.8 | 0.0 |
| Sodium Citrate | 1.7 | 1.7 | 0.0 |
| Sodium Hydroxide | 0.8 | 0.8 | 0.8 |
| Silicone suds suppresser | 0.3 | 0.3 | 0.3 |
| Glycerin | 0.0 | 0.0 | 2.0 |
| 2,2,4-Trimethyl-1, 3-Propanediol | 0.0 | 0.0 | 1.0 |
| Thickening agent (3) | 0.0 | 0.0 | 0.2 |
| Minors (dye, perfume, preservative, stabilizers) | 2 | 2 | 2 |
| Protease (4) | 0.08 | 0.0 | 0.08 |
| Fluorescent whitening agent (5) | 0.2 | 0.2 | 0.2 |
| Water | 43.5 | 42.6 | 52.4 |

(1) Commercially available under the trade name SOKALAN CP-5 (40% active) from BASF.
(2) Commercially available under the trade name Neodol 23-9 from Shell Chemical Co.
(3) Trihydroxystearin.
(4) Protease is typically a mixture containing 34 mg/mL active protease.
(5) A suitable fluorescent whitening agent is commercially available under the trade name of Optiblan LSN from 3V, Inc.

EXAMPLE 2

A cleaning agent-containing treating composition in accordance with the present invention can be formulated as follows:

| | formula % |
|---|---|
| Sodium Polyacrylate[1] | 39.35 |
| Nonionic Surfactant[2] | 11.67 |
| Silicone suds suppresser | 0.6 |

-continued

| | formula % |
|---|---|
| Perfume | 0.25 |
| Water | 48 |
| Minors (dyes, etc.) | 0.13 |
| Total | 100.00 |

[1]A suitable sodium polyacrylate is commercially available under the tradename ACUSOL 445N (45% active) from Rohm and Haas Company.
[2]A suitable nonionic surfactant is commercially available under the tradename NEODOL 23-9 from Shell Chemical Company.

EXAMPLE 3

A cleaning agent-containing treating composition in accordance with the present invention can be formulated as follows:

| | formula % |
|---|---|
| Acrylic Acid/Maleic Acid Copolymer[1] | 32.66 |
| Nonionic Surfactant[2] | 15 |
| Protease[3] | 1.49 |
| Silicone suds suppresser | 0.6 |
| Perfume | 0.25 |
| $Na_2CO_3$ | 1 |
| Water | 48.93 |
| Minors (dyes, etc.) | 0.07 |
| Total | 100.00 |

[1]A suitable acrylic acid/maleic acid copolymer is commercially available under the tradename SOKALAN CP-5 (40% active) from BASF.
[2]A suitable nonionic surfactant is commercially available under the tradename NEODOL 23-9 from Shell Chemical Company.
[3]Protease is typically a mixture containing 33.6 mg/ml active protease.

EXAMPLE 4

Conditioning agent-containing treating compositions in accordance with the present invention are formulated as follows:

| Component | Example A | Example B | Example C | Example D | Example E |
|---|---|---|---|---|---|
| | Weight % (Active Weight %) | | | | |
| Conditioning Agent[1] | 33 (12) | 40 (15) | 33 (12) | 33 (12) | 33 (12) |
| Conditioning Agent[2] | 0 | 0 | 6 (2) | 0 | 0 |
| Substantive Perfume | 0.3 | 0.3 | 0.3 | 0.3 | 0.3 |
| Disinfecting Agent[3] | 0 | 0.4 (0.2) | 0 | 0.4 (0.2) | 0.4 (0.2) |
| Nonionic Surfactant[4] | 0 | 0 | 1.0 | 1.0 | 1.0 |
| Odor Control Agent[5] | 0 | 2.0 (1.0) | 0 | 0 | 0 |
| Propylene glycol | 0 | 0 | 0 | 0 | 4.0 |
| Water | balance | balance | balance | balance | balance |

[1]A suitable conditioning agent is commercially available under the tradename LUBRITAN AS from Rohm and Haas Company.
[2]A suitable conditioning agent is commercially available under the tradename GE Silicone CM2233 from General Electric Company.
[3]A suitable disinfecting agent is commercially available under the tradename BARDAC 2250 from Lonza.
[4]A suitable nonionic surfactant is commercially available under the tradename NEODOL 23-6.5 from Shell Chemical Company.
[5]A suitable odor control agent is β-cyclodextrin.

EXAMPLE 5

A cleaning agent and conditioning agent-containing treating composition (2-in-1) in accordance with the present invention is formulated as follows:

| | Ex. 5A | Ex. 5B |
|---|---|---|
| Sodium Polyacrylate[1] | 28% | 28% |
| Alkyl ethoxylate carboxylate[2] | 14.8% | 14.8% |
| Nonionic Surfactant[3] | 8.4% | 8.4% |
| Disinfecting Agent[4] | 4% | 4% |
| Conditioning Agent[5] | 3.8% | 3.8% |
| Substantive Perfume[6] | 0.2% | — |
| Water | 40.8% | 41% |
| | 100.0% | 100.0% |

[1]A suitable sodium polyacrylate is commercially available under the tradename ACUSOL 445N (45% active) from Rohm and Haas Company.
[2]A suitable alkyl ethoxylate carboxylate is commercially available under the tradename NEODOX 25-6 from HicksonDan Chem.
[3]A suitable nonionic surfactant is commercially available under the tradename NEODOL 23-9 from Shell Chemical Company.
[4]A suitable disinfecting agent is commercially available under the tradename BARDAC 2250 from Lonza.
[5]A suitable conditioning agent is polydimethylsiloxane available from General Electric Company.
[6]Substantive perfume containing about 60% substantive perfume ingredients.

EXAMPLE 6

A cleaning agent and conditioning agent-containing treating composition (2-in-1) in accordance with the present invention is formulated as follows:

| | Ex. 6A | Ex. 6B |
|---|---|---|
| Acrylic acid/Maleic acid Copolymer[1] | 30.9% | 30.9% |
| Nonionic Surfactant[2] | 13.6% | 13.6% |
| Conditioning Agent[3] | 2.5% | 2.5% |
| Silwet L-7500 | 1.8% | 1.8% |

-continued

| | Ex. 6A | Ex. 6B |
|---|---|---|
| Substantive Perfume | — | 0.5% |
| Water | 51.2% | 50.7% |
| | 100.0% | 100.0% |

[1]A suitable acrylic acid/maleic acid copolymer is commercially available under the tradename SOKALAN CP-5 (40% active) from BASF.
[2]A suitable nonionic surfactant is commercially available under the tradename NEODOL 23-9 from Shell Chemical Company.
[3]A suitable conditioning agent is commercially available under the tradename LUBRITAN AS from Rohm and Haas Company.
[4]Silwet L-7500 is available from OSI Specialties.

EXAMPLE 7

Suitable treating compositions that are especially useful as post-treat compositions (suitable for making shoes easier to subsequently clean) in accordance with the present invention are formulated as follows:

| Component | A | B | C |
|---|---|---|---|
| Film-Forming Polymer[1] | 2.5% | 2.5% | 2.5% |
| Surfactant[2] | — | 3% | 3% |
| Softening agent[3] | — | 1% | 1% |
| Substantive perfume | — | — | 1% |
| Water | 97.5% | 93.5% | 92.5% |
| TOTAL | 100% | 100% | 100% |

[1]A suitable film-forming polymer is Carboxymethylcellulose available from Hercules, Type 7LF.
[2]A suitable surfactant is Neodol 23-9 available from Shell Chemicals.
[3]A suitable softening agent is DOWNY ® April Fresh Regular concentration fabric softener sold by The Procter & Gamble Company of Cincinnati, Ohio, USA, and described in one or both of U.S. Pat. Nos. 4,424,134 and 4,767,547.

EXAMPLE 8

Suitable treating compositions that are especially useful as disinfecting compositions in accordance with the present invention are formulated as follows:

| | | | |
|---|---|---|---|
| Distilled $H_2O$ | balance | balance | balance |
| Sodium xylene sulfonate | 1.5% | 1.5% | 1.5% |
| Na C25AE1.8S | 1.06% | 1.06% | 1.06% |
| decanoic acid | 1% | — | 1% |
| nonanoic acid | — | 3% | 3% |
| isopropanol | 2% | 2% | 2% |
| PEG 400 | 15% | 15% | 15% |
| Tween 20 | 1% | 1% | 1% |
| Perfume[1] | 0.5% | 0.5% | 0.5% |
| Glacial acetic acid | | pH adjustment | |
| final pH | 4.5 | 4.5 | 4.5 |

[1]Substantive perfume containing at least about 30% of substantive perfume ingredients.

In the case of canvas or mesh athletic shoes that do not comprise a significant amount of leather, ordinary commercially available detergents such as TIDE® laundry detergent, or if the shoes are white, TIDE® laundry detergent or TIDE® with Bleach laundry detergent, in either liquid or powder form, can be used. In addition, if the shoes do not contain leather, it is less necessary to control the temperature and pH of the wash water.

Alternatively, treating compositions can be specially formulated for canvas or mesh athletic shoes, such as in the following Example.

EXAMPLE 9

One non-limiting treating composition that is especially useful for treating canvas-containing shoes is formulated as follows:

| ingredient | weight % | weight % |
|---|---|---|
| Triacetin | 18.3% | 21.7% |
| Nonionic surfactant[1] | 21.9% | 26.1% |
| $Na_3$citrate.$2H_2O$ | 22.8% | 10.9% |
| $Na_3$citrate/$Na_2CO_3$/acrylic-maleic copolymer granule[2] | | 13% |
| $Na_2CO_3$ | 14.6% | 4.3% |
| EDDS[3] | 1.1% | 1.1% |
| Sodium perborate monohydrate | 11.0% | 10.9% |
| bleach activator[4] | 7.8% | 7.6% |
| Protease | 0.9% | 0.87% |
| Cellulase | 0.18% | 0.17% |
| Fluorescent whitening agent[5] | 0.18% | 0.17% |
| Antifoam | 0.09% | 0.09% |
| Structurant[6] | 0.9% | 3 |
| Perfume | 0.2% | 0.2% |

[1]A suitable nonionic surfactant is commercially available under the tradename NEODOL 23-5 from Shell Chemical Company.
[2]$Na_3$citrate/$Na_2CO_3$/acrylic-maleic copolymer granule is described in PCT application Serial No. PCT/US00/21572 filed Aug. 8, 2000.
[3]ethylenediaminedisuccinate, trisodium salt.
[4]N-nonanoyl-6-aminoheaxanoyloxybenzenesulfonate, Na+ salt.
[5]A suitable brightener is known by the tradename of TINOPAL AMS-GX, and is available from Ciba Specialty Chemicals, Corp.
[6]$Na_2SO_4$/sodium linear alkylbenzenesulfonate (described in PCT Publication WO 9942206 A1).

The composition comprises a substantially nonaqueous liquid detergent containing a nonionic surfactant, a peroxygen source, and optionally, a bleach activator. Preferably, the shoes are wetted before the composition in Example 9 is applied to the shoes.

EXAMPLE 10

Another suitable treating composition in accordance with the present invention is formulated as follows:

| | Ex. 10A | Ex. 10B |
|---|---|---|
| Acrylic Acid/Maleic Acid Copolymer (1) | 29.8% | 29.8% |
| Nonionic Surfactant (2) | 12% | 12% |
| Glycerin | 2% | 2% |
| 2,2,4-Trimethyl-1,3-Pentanediol | 1% | 1% |
| Silicone Suds Suppressor | 0.2% | 0.2% |
| Thickening Agent (3) | 0.2% | 0.2% |
| Substantive Perfume | 0.2% | — |
| Minors (dye, perfume, preservative) | 0.1% | 0.1% |
| Water | 54.6% | 54.7% |

(1) Commercially available under the tradename SOKALAN CP-5 (40% active) from BASF.
(2) Commercially available under the tradename NEODOL 23-9 from Shell Chemical Co.
(3) Trihydroxystearin.

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

The compositions of the present invention can be suitably prepared by any process chosen by the formulator, non-limiting examples of which are described in U.S. Pat. No. 5,691,297 Nassano et al., issued Nov. 11, 1997; U.S. Pat. No.

5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above examples, the treating compositions of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the invention in detail with reference to preferred embodiments and the examples, it will be clear to those skilled in the art that various changes and modifications may be made without departing from the scope of the invention and the invention is not to be considered limited to what is described in the specification.

What is claimed is:

1. A shoe treatment kit comprising:

a) an article of manufacture comprising a treating composition for treating one or more shoes comprising one or more benefit agents in a package in association with instructions for use, wherein the instructions direct a consumer to directly or indirectly apply at least an effective amount of the treating composition comprising chromium-binding agents that are capable of binding $Cr^{3+}$ with a log binding constant of more than 12 in an amount of less than 30% by weight to provide one or more desired benefits to the one or more shoes;

b) a flexible container suitable for holding one or more of the shoes; and c) an outer package containing the components a) and b).

2. The shoe treatment kit according to claim 1, wherein the article of manufacture includes an applicator;

the flexible container comprises a bag;

the flexible container is resusable; and/or the kit further comprises a post-wash article, optionally comprising a treating composition comprising a release agent, and optionally, a film-forming polymer.

3. The shoe treatment kit according to claim 2 wherein the applicator permits application of the treating composition directly onto the one or more shoes by squeezing and/or rubbing and/or pouring and/or spraying.

4. The shoe treatment kit according to claim 2 further comprising a pre-wear article, optionally comprising a treating composition comprising a release agent, and, optionally, a film-forming polymer.

5. The shoe treatment kit according to claim 3 wherein either or both of the pre-wash and post-wash articles are in the form of a wipe impregnated with their respective treating composition.

6. The shoe treatment kit according to claim 1 wherein the applicator comprises a brush for applying the one or more treating compositions onto the one or more interior or exterior surfaces of the one or more shoes.

7. The shoe treatment kit according to claim 1 wherein the treating composition is in a solid form.

8. The shoe treatment kit according to claim 6 wherein the solid form comprises a tablet.

9. The shoe treatment kit according to claim 1 wherein the flexible container includes a treating composition for treating one or more shoes comprising one or more benefit agents to provide one or more desired benefits to the one or more shoes.

10. The shoe treatment kit according to claim 1 further comprising at least one additional article of manufacture comprising a treating composition, wherein each article of manufacture comprises at least one benefit agent not included in the other articles of manufacture.

11. An article of manufacture comprising a treating composition for treating one or more shoes comprising one or more benefit agents in a package in association with instructions for use, wherein the instructions direct a consumer to directly or indirectly apply at least an effective amount of the one or more benefit agents comprising chromium-binding agents that are capable of binding $Cr^{3+}$ with a log binding constant of more than 12 in an amount of less than 30% by weight to provide one or more desired benefits to the one or more shoes.

12. An article of manufacture comprising at least one conditioning treating composition for treating one or more shoes and at least one cleaning treating composition for treating one or more shoes, each composition comprising one or more benefit agents and provided in a package in association with instructions for use, wherein the instructions direct a consumer to directly or indirectly apply at least an effective amount of each composition comprising chromium-binding agents that are capable of binding $Cr^{3+}$ with a log binding constant of more than 12 in an amount of less than 30% by weight to provide one or more desired benefits to the one or more shoes.

13. An article of manufacture according to claim 12 further comprising at least one post-wash treating composition for treating one or more shoes comprising one or more benefit agents in a package in association with instructions for use, wherein the instructions direct a consumer to directly or indirectly apply at least an effective amount of the post-wash treating composition to provide one or more desired benefits to the one or more shoes.

14. An article of manufacture according to claim 12 further comprising a bag.

* * * * *